US009069312B2

(12) United States Patent
Kanai et al.

(10) Patent No.: US 9,069,312 B2
(45) Date of Patent: Jun. 30, 2015

(54) IMAGE FORMING APPARATUS HAVING CAPACITANCE DETECTION

(71) Applicant: CANON KABUSHIKI KAISHA, Tokyo (JP)

(72) Inventors: Ryosuke Kanai, Kawasaki (JP); Kohei Matsuda, Fujisawa (JP); Masao Uyama, Mishima (JP); Koichiro Takashima, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 90 days.

(21) Appl. No.: 13/851,206

(22) Filed: Mar. 27, 2013

(65) Prior Publication Data

US 2013/0279921 A1 Oct. 24, 2013

(30) Foreign Application Priority Data

Apr. 18, 2012 (JP) ..... 2012-094684
Apr. 18, 2012 (JP) ..... 2012-094685
Mar. 1, 2013 (JP) ..... 2013-040556

(51) Int. Cl.
*G03G 15/00* (2006.01)
*G03G 15/08* (2006.01)
*G03G 21/16* (2006.01)

(52) U.S. Cl.
CPC ..... *G03G 15/50* (2013.01); *G03G 15/0813* (2013.01); *G03G 21/1652* (2013.01)

(58) Field of Classification Search
CPC ..... G03G 15/50; G03G 15/0856; G03G 21/1817; G03G 21/1825; G03G 2221/183
USPC ..... 399/12, 13, 27, 111, 113
See application file for complete search history.

(56) References Cited

U.S. PATENT DOCUMENTS 5,500,714 A 3/1996 Yashiro et al.
5,617,579 A 4/1997 Yashiro et al.
(Continued)

FOREIGN PATENT DOCUMENTS

CN 1091528 A 8/1994
CN 101334614 A 12/2008
(Continued)

OTHER PUBLICATIONS

Kohei Matsuda, et al., U.S. Appl. No. 13/267,240, filed Oct. 6, 2011.
(Continued)

*Primary Examiner* — Sophia S Chen
(74) *Attorney, Agent, or Firm* — Fitzpatrick, Cella, Harper & Scinto

(57) ABSTRACT

An image forming apparatus includes a conductive member paired with one of a developer carrying member and an image bearing member to form a capacitor. A contact-separation member assumes a first position for bringing the developer carrying member into contact with the image bearing member and a second position for separating the developer carrying member from the image bearing member. A detecting unit detects a value relating to a capacitance of the capacitor when a voltage is applied to the capacitor, and a control unit detects whether or not the image forming apparatus is ready for image formation by comparing a first detected result and a second detected result to each other. The first detected result is detected when the contact-separation member assumes the first position, and the second detected result is detected when the contact-separation member assumes the second position.

28 Claims, 23 Drawing Sheets

(56) References Cited

U.S. PATENT DOCUMENTS

| | | | | |
|---|---|---|---|---|
| 6,754,461 | B2 | 6/2004 | Hoshi et al. | |
| 6,839,534 | B2 | 1/2005 | Matsuda et al. | |
| 7,283,761 | B2 | 10/2007 | Matsuda et al. | |
| 7,962,057 | B2 | 6/2011 | Yamamoto et al. | |
| 7,991,315 | B2 | 8/2011 | Kawamura et al. | |
| 8,160,464 | B2 | 4/2012 | Yamamoto et al. | |
| 8,175,476 | B2 | 5/2012 | Yamamoto et al. | |
| 8,285,166 | B2 | 10/2012 | Yamamoto et al. | |
| 2009/0003850 | A1 | 1/2009 | Yamamoto et al. | |
| 2011/0206390 | A1 | 8/2011 | Yamamoto et al. | |
| 2011/0229175 | A1 | 9/2011 | Yamamoto et al. | |
| 2011/0255884 | A1* | 10/2011 | Matsuda | 399/27 |
| 2012/0070169 | A1 | 3/2012 | Yamamoto et al. | |
| 2012/0195611 | A1* | 8/2012 | Adachi et al. | 399/53 |
| 2012/0230714 | A1 | 9/2012 | Yamamoto et al. | |

FOREIGN PATENT DOCUMENTS

| | | | | |
|---|---|---|---|---|
| JP | 03-237476 | A | * | 10/1991 |
| JP | 11-15337 | A | | 1/1999 |
| JP | 3416664 | B2 | | 6/2003 |
| JP | 4402137 | B2 | | 1/2010 |

OTHER PUBLICATIONS

Chinese Office Action dated Mar. 24, 2015, in related Chinese Patent Application No. 201310134897.2 (with English translation).

* cited by examiner

IMAGE FORMING APPARATUS HAVING CAPACITANCE DETECTION

BACKGROUND OF THE INVENTION

1. Field of the Invention

The present invention relates to an image forming apparatus configured to form an image on a recording medium by electrophotography, electrostatic recording, magnetic recording, or the like.

2. Description of the Related Art

An electrophotographic image forming apparatus is now described as an example. Examples of the electrophotographic image forming apparatus include an electrophotographic copier, an electrophotographic printer (LED printer, laser beam printer, and the like), an electrophotographic facsimile device, and an electrophotographic image display device (electronic blackboard, electronic whiteboard, display device, and the like). It may be necessary to check whether or not the image forming apparatus is ready for image formation before an image is formed thereby. Some exemplary image forming apparatus that are configured so that a member such as an image bearing member (photosensitive drum) or a developer carrying member is removably mountable to an apparatus main body of the image forming apparatus in the form of a cartridge perform control of detecting whether or not the cartridge is properly mounted to the apparatus main body.

Exemplary image forming apparatus that are configured to determine whether the cartridge is not mounted or properly mounted to the apparatus main body are disclosed in Japanese Patent Application Laid-Open No. H11-015337 and Japanese Patent No. 3416664.

In the image forming apparatus disclosed in Japanese Patent Application Laid-Open No. H11-015337, a voltage is applied to a photosensitive drum included in a process cartridge from a transfer device which is in contact with the photosensitive drum, and a current flowing through the photosensitive drum is detected by a detection circuit of the apparatus main body. In this way, the image forming apparatus determines the mount state of the process cartridge.

In the image forming apparatus disclosed in Japanese Patent No. 3416664, an AC detection voltage is applied to a developer carrying member included in a process cartridge which is removably mountable to the apparatus main body, and an induced current flowing through an antenna member included in the process cartridge is detected by a detection circuit of the apparatus main body. In this way, the image forming apparatus determines the mount state of the process cartridge.

Another conventional technology is the structure in which a developing device is movable inside the image forming apparatus (Japanese Patent No. 4402137). In this structure, the state in which a developer carrying member provided in the developing device is brought into contact with an image bearing member and the state in which the developer carrying member is separated from the image bearing member are switched for image formation and non-image formation. It is therefore desired to confirm that the developer carrying member may become properly in contact with the image bearing member or separated from the image bearing member before image formation is performed by the image forming apparatus.

SUMMARY OF THE INVENTION

In view of the above-mentioned problem, the present invention has been made by further developing the conventional technologies. The present invention is aimed at detecting whether or not an image forming apparatus is ready for image formation by a simple structure. The present invention therefore provides an inexpensive image forming apparatus.

According to a representative configuration of an embodiment of the present invention, there is provided an image forming apparatus configured to form an image on a recording medium, the image forming apparatus including:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position.

Further features of the present invention will become apparent from the following description of exemplary embodiments with reference to the attached drawings.

DESCRIPTION OF THE EMBODIMENTS

Referring to the accompanying drawings, exemplary embodiments of the present invention are described in detail below.

First Embodiment (1) Overall Outline of Exemplary Image Forming Apparatus

Figure 1:
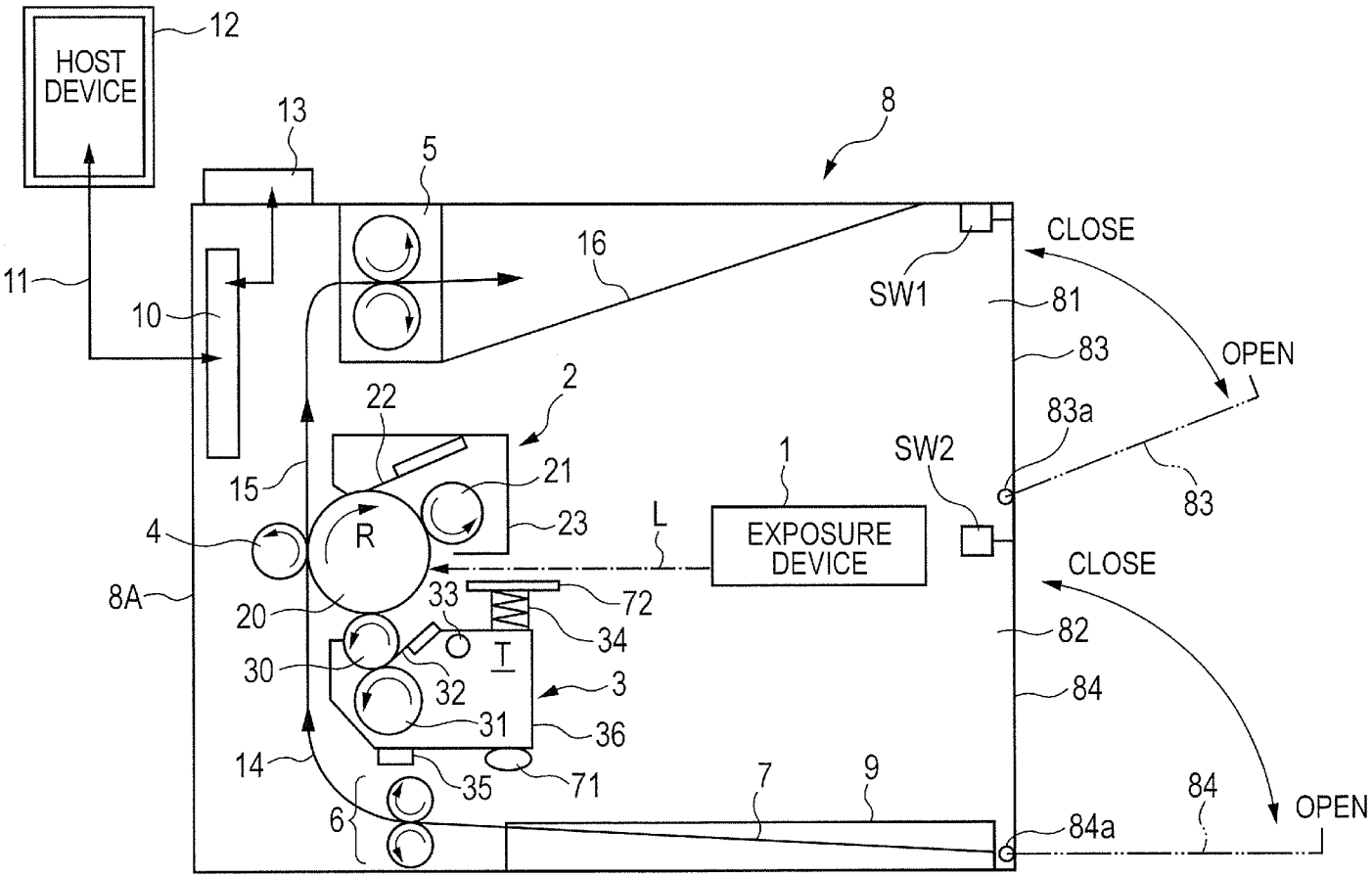
FIG. 1 is a schematic diagram of an image forming apparatus according to a first embodiment of the present invention.

FIG. 1 is a schematic configuration diagram of an image forming apparatus 8 according to an embodiment of the present invention. The image forming apparatus 8 in this embodiment is an electrophotographic image forming apparatus that forms an image on a transfer material (recording medium) 7 by executing a series of image forming process of charging, exposure, development, transfer, and cleaning on a photosensitive drum 20 as a rotatable image bearing member.

Specifically, the image forming apparatus 8 is configured to output an image-formed product by forming, on the transfer material 7, an image corresponding to image data (electrical image information) which is input from a host device 12 connected to a control unit (control portion: CPU) 10 via an interface 11. The transfer material 7 is plain paper, glossy paper, a resin sheet, a postcard, an envelope, or the like.

The control unit 10 is a control portion configured to control the overall operation of the image forming apparatus 8, and transmits and receives various kinds of electrical information signals to and from the host device 12 and an apparatus operation portion (control panel) 13. The control unit 10 further performs processing of electrical information signals input from various kinds of process devices and sensors, processing of command signals for the various kinds of process devices, predetermined initial sequence control, and predetermined image forming sequence control. The host device 12 is a personal computer, a network, an image reader, a facsimile machine, or the like. The apparatus operation portion 13 is provided with a main power switch, various kinds of operation keys, an indicator, and the like.

The photosensitive drum 20 is rotationally driven at a predetermined circumferential speed (process speed) in the clockwise direction indicated by the arrow R. Around the photosensitive drum 20, there are arranged image forming process units including a charging member 21, an exposure device 1, a developer carrying member 30, a transfer device 4, and a cleaning device 22 in this order along the rotation direction of the photosensitive drum 20.

In this embodiment, the photosensitive drum 20 uses a conductive cylinder such as aluminum having an undercoat layer, a carrier generation layer, and a carrier transport layer formed thereon. The charging member 21 uses a charging roller that comes into contact with the photosensitive drum 20 to be driven by the photosensitive drum 20. The charging member 21 is a conductive metal support having a semiconductive elastic member formed thereon. The charging member 21 is applied with a predetermined charging voltage, and charges the photosensitive drum 20 uniformly at a predetermined potential with a predetermined polarity. In this embodiment, the photosensitive drum 20 is charged by the charging member 21 uniformly at −500 V.

The surface of the photosensitive drum 20 uniformly charged by the charging member 21 is subjected to image exposure by the exposure device 1. In this embodiment, the exposure device 1 is a laser scanning exposure device, and includes a laser, a polygon mirror, and a lens system. The exposure device 1 outputs a laser light L that has been modulated in accordance with an image signal (image data) to expose the surface of the photosensitive drum 20 in a main scanning direction. In this way, an electrostatic latent image corresponding to a scanning exposure pattern is formed on the surface of the photosensitive drum 20.

The electrostatic latent image formed on the photosensitive drum surface is developed (visualized) into a developer image (toner image) by the rotatable developer carrying member 30. In this embodiment, the developer carrying member 30 uses a developing roller that comes into contact with the photosensitive drum 20 to be rotationally driven in the counterclockwise direction indicated by the arrow along the forward direction of the rotation of the photosensitive drum 20 at a predetermined circumferential speed ratio.

The developer carrying member 30 is a conductive metal support having a semiconductive elastic member such as urethane rubber formed thereon, and carries and conveys toner T as a developer. The developer carrying member 30 is applied with a predetermined developing voltage, and develops the electrostatic latent image with the toner T. The toner T uses non-magnetic single component toner. Although the non-magnetic single component toner is herein used, two-component toner or magnetic toner may be used instead.

A rotatable developer feeding member 31 is disposed in contact with the developer carrying member 30. In this embodiment, the developer feeding member 31 is an elastic sponge roller made of a conductive metal support having a semiconductor elastic member such as foamed urethane formed on its surface. The developer feeding member 31 is disposed side by side with the developer carrying member 30, and comes into contact with the developer carrying member 30 to be rotationally driven in the counter direction to the rotation direction of the developer carrying member 30 at a predetermined circumferential speed ratio in the contact portion with the developer carrying member 30. In this way, the toner T is applied as a thin layer from the developer feeding member 31 onto the surface of the rotating developer carrying member 30.

A developer layer thickness regulating member 32 is disposed in contact with the developer carrying member 30 on the downstream side of the developer feeding member 31 in the rotation direction of the developer carrying member 30. In this embodiment, the developer layer thickness regulating member 32 is a conductive elastic blade, and comes into contact with the developer carrying member 30 by a predetermined pressure to regulate the layer thickness of the toner T that has been applied onto the developer carrying member 30 by the developer feeding member 31. In this embodiment, the elastic blade uses a SUS thin plate having a thin elastomer member formed thereon.

In this embodiment, in the developing operation, a DC voltage of −350 V is applied to the developer carrying member 30 as a developing voltage, and only a DC voltage of −400 V is applied to the developer feeding member 31.

The toner T is applied onto the rotating developer carrying member 30 from the developer feeding member 31 in the contact portion with the developer feeding member 31, and the layer thickness of the applied toner is regulated by the developer layer thickness regulating member 32. The toner is charged with a predetermined polarity by friction. The toner layer having the regulated layer thickness is conveyed by the subsequent rotation of the developer carrying member 30 to a developing position which is the contact portion between the photosensitive drum 20 and the developer carrying member 30. Then, the toner of the toner layer on the developer carrying member 30 side is selectively transferred onto the surface of the photosensitive drum 20 in accordance with the pattern of the electrostatic latent image. In this way, the electrostatic latent image is developed into a toner image.

The toner on the developer carrying member 30 which has not been used for developing the electrostatic latent image is conveyed and returned by the subsequent rotation of the developer carrying member 30 to the contact portion between the developer carrying member 30 and the developer feeding member 31, and is scraped off from the developer carrying member 30 by the developer feeding member 31. Together with the scraping-off of the toner by the return conveyance, the toner T is applied onto the surface of the developer carrying member 30 by the developer feeding member 31. The above-mentioned operation is repeated to execute the development of the electrostatic latent image formed on the surface of the photosensitive drum 20.

The transfer device 4 is a device that transfers the toner image formed on the photosensitive drum 20 onto the transfer material 7. In this embodiment, the transfer device 4 is a rotatable transfer roller made of a conductive support having a semiconductive elastic member formed thereon, and is disposed side by side with the photosensitive drum 20 and comes into contact with the photosensitive drum 20 to form a transfer nip portion. The transfer device 4 is rotationally driven in the forward direction of the rotation of the photosensitive drum 20 at a circumferential speed substantially corresponding to the rotary circumferential speed of the photosensitive drum 20.

The transfer materials 7 that are stacked and contained in a feed cassette 9 are individually fed in a separate manner by the operation of a feed mechanism (not shown) including a feed roller 6 at a predetermined control timing. The transfer material 7 is introduced to the transfer nip portion along a sheet path 14, and is conveyed while being nipped by the transfer nip portion. The transfer device 4 is applied with a predetermined transfer voltage when the transfer material 7 is being conveyed while being nipped by the transfer nip portion. In this way, the toner image formed on the photosensitive drum 20 is electrostatically transferred onto the transfer material 7 sequentially.

The transfer material 7 after passing the transfer nip portion is separated from the surface of the photosensitive drum 20 and is conveyed to a fixing device 5 along a sheet path 15. The fixing device 5 fixes an unfixed toner image onto the transfer material 7 as a fixed image, and then the transfer material 7 is discharged as an image-formed product to a discharge tray 16 provided outside the apparatus.

The surface of the photosensitive drum 20 after the separation of the transfer material is cleaned by removing a residue such as a transfer residual developer by the cleaning device 22, and is used for image formation repeatedly. In this embodiment, the cleaning device 22 is a blade cleaning device that uses a cleaning blade made of an elastic blade. The cleaning blade is disposed so that a distal edge portion thereof may be brought into counter contact with the surface of the rotating photosensitive drum 20. The residue on the photosensitive drum surface is wiped off by the cleaning blade.

(2) Photosensitive Drum Cartridge and Developing Cartridge

The photosensitive drum 20 is consumed through repeated use. The photosensitive drum 20 is therefore integrated into a unit as a photosensitive drum cartridge 2 (image bearing member cartridge) including at least the photosensitive drum 20, so as to be easily removably mountable to a predetermined mount portion of an apparatus main body (image forming apparatus main body) 8A of the image forming apparatus 8.

Figure 2A:
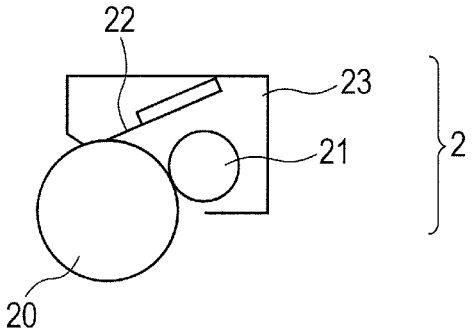
FIG. 2A is a schematic diagram of a photosensitive drum cartridge.

In this embodiment, as illustrated in FIG. 2A, the photosensitive drum (second member) 20, the charging member 21, the cleaning device 22, and a cleaning container (cleaning frame) 23 are integrated to constitute the photosensitive drum cartridge (second unit) 2. The photosensitive drum 20 and the charging member 21 are rotatably supported by bearings on the cleaning container 23. The cleaning device 22 is fixedly supported on the cleaning container 23.

The developer T is consumed through repeated use. The toner T is therefore integrated into a unit as a developing cartridge 3 including at least the toner T and the developer carrying member 30, so as to be easily removably mountable to the apparatus main body 8A of the image forming apparatus 8.

Figure 2B:
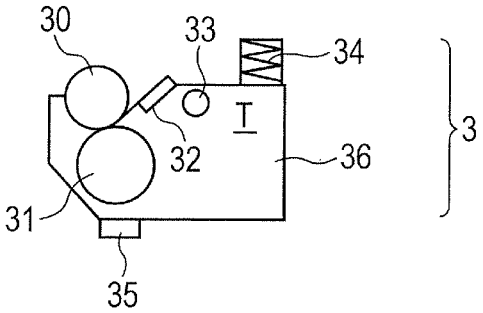
FIG. 2B is a schematic diagram of a developing cartridge.

In this embodiment, as illustrated in FIG. 2B, the toner T, a developing container (developing frame) 36, the developer carrying member 30, the developer feeding member (first member) 31, and the developer layer thickness regulating member 32 are integrated to constitute the developing cartridge (first unit) 3.

The developer carrying member 30 and the developer feeding member 31 are rotatably supported by bearings on the developing container 36. The developer layer thickness regulating member 32 is fixedly supported on the developing container 36. The toner T as a developer (dry developer) is contained in the developing container 36. The developing cartridge 3 is further provided with a swing center portion (shaft) 33, a development pressure member (a compression spring being an elastic member (bias member)) 34, and a storage unit (memory) 35.

Figure 3:
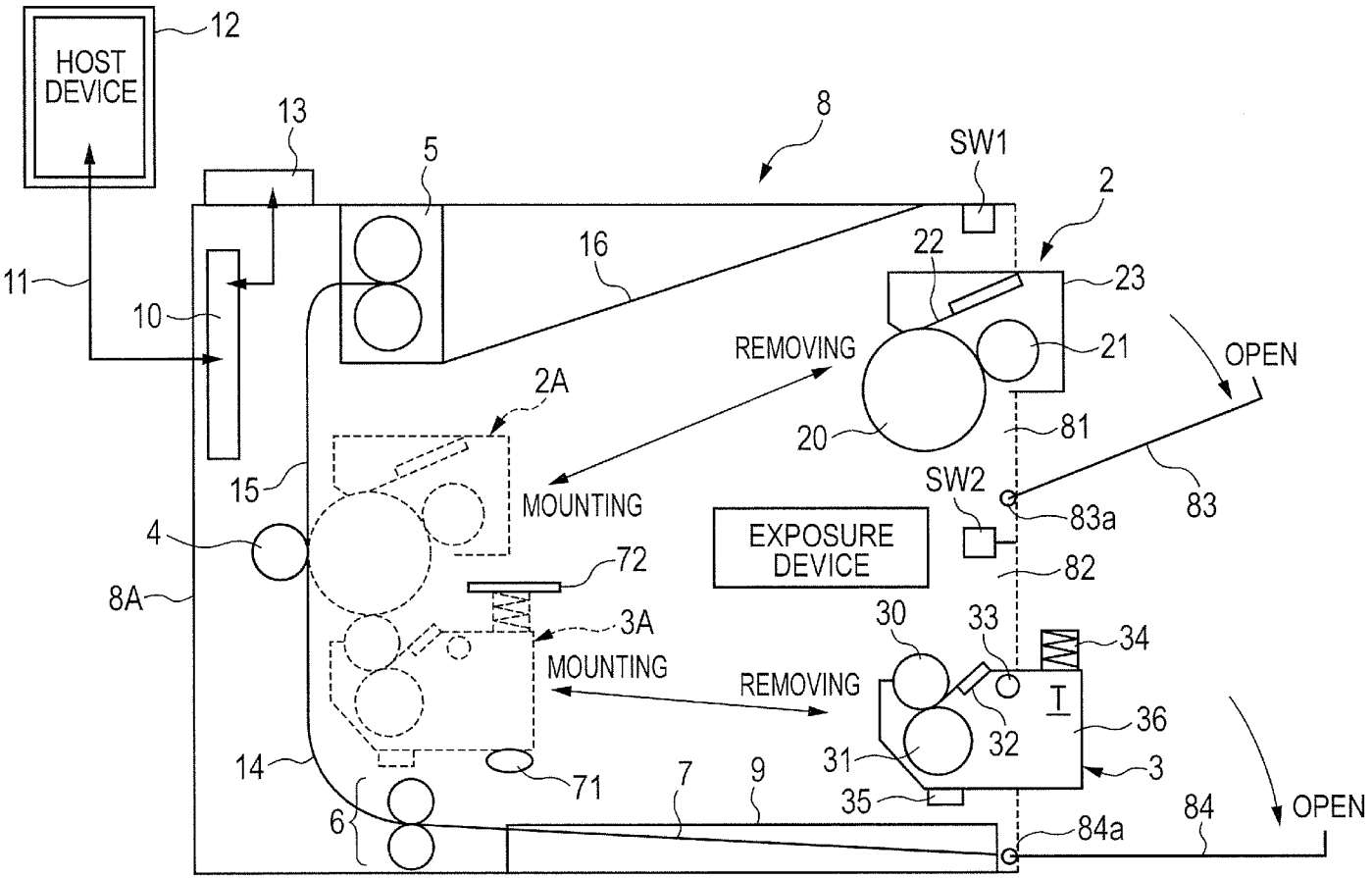
FIG. 3 is an explanatory diagram of how the photosensitive drum cartridge and the developing cartridge are mounted.

When used, the photosensitive drum cartridge 2 and the developing cartridge 3 are respectively mounted in a predetermined manner to a photosensitive drum cartridge mount portion 2A (FIG. 3) and a developing cartridge mount portion 3A, which are provided vertically in the apparatus main body 8A. The photosensitive drum cartridge 2 and the developing cartridge 3 are removably mountable to the mount portions 2A and 3A of the apparatus main body 8A individually in respective manners to be described later.

The photosensitive drum cartridge 2 is mounted to the mount portion 2A. The photosensitive drum cartridge 2 is positioned and fixed at a positioning portion (not shown) of the apparatus main body 8A by being pressed by a pressing mechanism (not shown) of the apparatus main body 8A. In the state in which the photosensitive drum cartridge 2 is positioned and fixed, the photosensitive drum 20 is in contact with the transfer device 4 of the apparatus main body 8A with a predetermined pressing force. In the image forming operation, power is transmitted from a drive output portion (not shown) of the apparatus main body 8A to a drive input portion (not shown) of the photosensitive drum cartridge 2, thereby rotationally driving the photosensitive drum 20.

When the photosensitive drum cartridge 2 is properly mounted to the mount portion 2A, electrical contacts "a" and "b" (FIGS. 4A and 4B) of the photosensitive drum cartridge 2 are electrically connected to electrical contacts "e" and "f" of the apparatus main body 8A, respectively. In this way, a predetermined charging voltage may be applied from charging voltage applying unit 90 of the apparatus main body 8A to the charging member 21 of the photosensitive drum cartridge 2. Although a DC voltage is used as a charging voltage in this embodiment, this is not a limitation. A charging voltage obtained by superimposing an AC voltage on a DC voltage may be used instead. The conductive cylinder of the photosensitive drum 20 is connected to the ground.

When the photosensitive drum cartridge 2 is not located at the mount portion 2A or not properly mounted to the mount portion 2A, the electrical contacts "a" and "b" of the photosensitive drum cartridge 2 are not connected to the electrical contacts "e" and "f" of the apparatus main body 8A.

The developing cartridge 3 is mounted to the mount portion 3A in the apparatus main body 8A in a state in which the swing center portion 33 is pivotally supported by a holder (not shown) of the apparatus main body 8A and the development pressure member 34 is received by a force receiving portion 72 of the apparatus main body 8A.

Figure 4B:
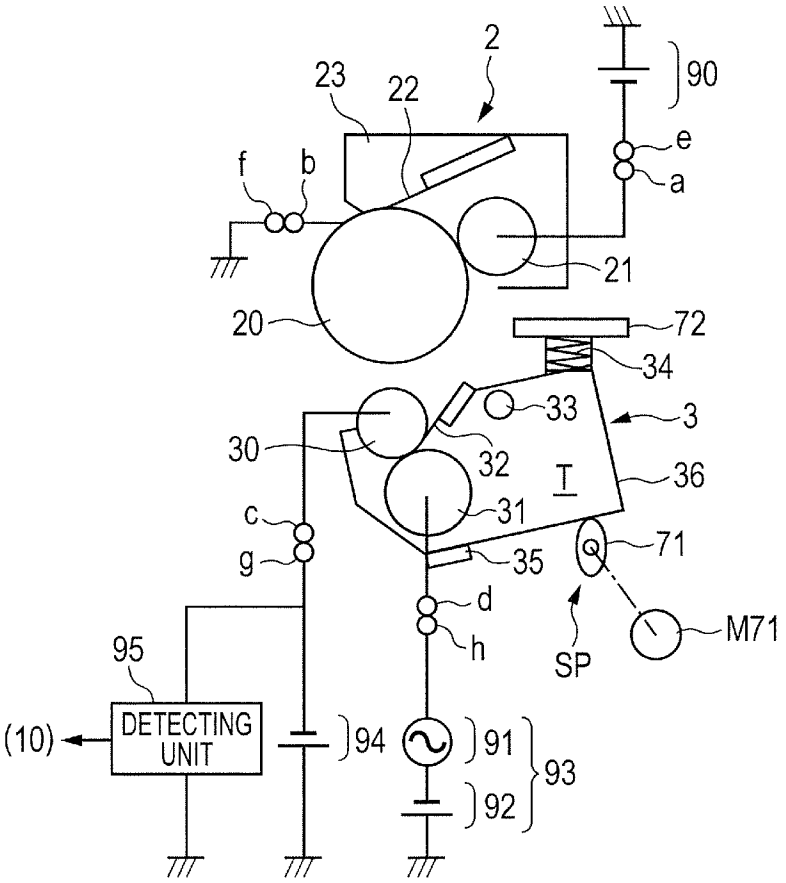
FIG. 4B is a schematic diagram of a separation state of the developing cartridge and its electrical connection.
Figure 4A:
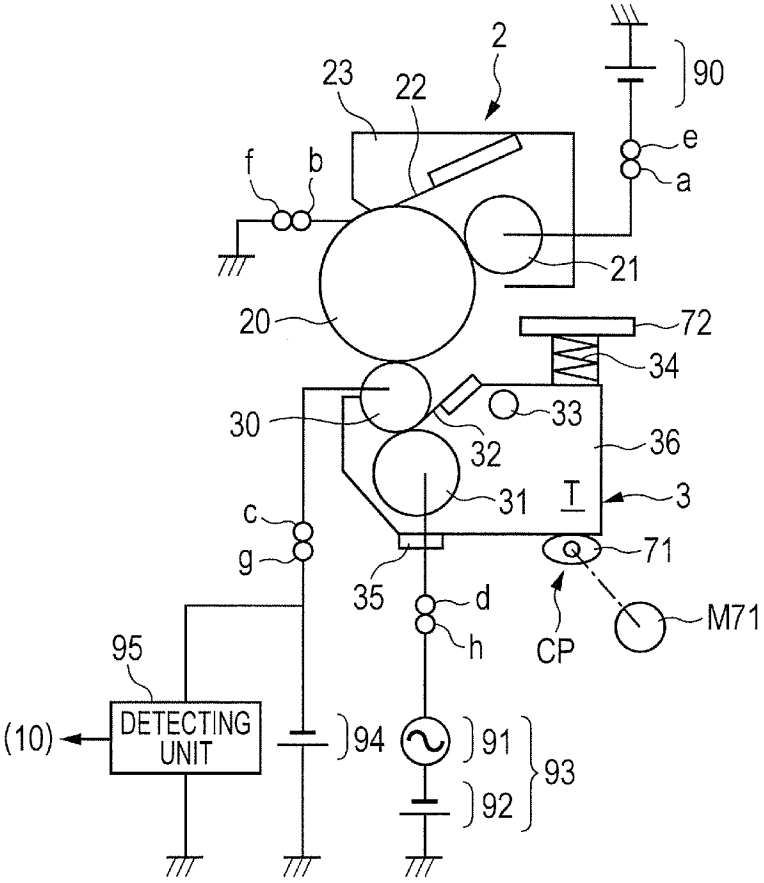
FIG. 4A is a schematic diagram of a contact state of the developing cartridge and its electrical connection.

In this mount state, as illustrated in FIGS. 4A and 4B, electrical contacts "c" and "d" of the developing cartridge 3 are electrically connected to electrical contacts "g" and "h" of the apparatus main body 8A, respectively. In this way, a predetermined DC voltage may be applied as a developing voltage from developing voltage applying unit 94 of the apparatus main body 8A to the developer carrying member 30 of the developing cartridge 3. In addition, a predetermined detection voltage may be applied from detection voltage applying unit 93 of the apparatus main body 8A to the developer feeding member 31 of the developing cartridge 3.

The developing cartridge 3 mounted to the mount portion 3A is pivotable about the swing center portion 33 by rotation operation of a cam being a contact-separation member 71 of the apparatus main body 8A. This pivot operation enables the developing cartridge 3 to move (pivot) to two positions, a contact position of FIG. 4A and a separation position of FIG. 4B.

The contact position is a developing cartridge movement position at which the developer carrying member 30 included in the developing cartridge 3 is brought into contact with a predetermined pressing force with the photosensitive drum 20 included in the photosensitive drum cartridge 2 positioned and mounted to the mount portion 2A. In other words, the contact position is an image forming position of the developing cartridge 3.

The separation position is a developing cartridge movement position at which the developer carrying member 30 included in the developing cartridge 3 is separated by a predetermined distance from the photosensitive drum 20 included in the photosensitive drum cartridge 2 positioned and mounted to the mount portion 2A. In other words, the separation position is a non-image forming position of the developing cartridge 3.

In the state in which the developing cartridge 3 is mounted to the mount portion 3A, the cam as the contact-separation member 71 is positioned correspondingly to a predetermined region of the lower surface of the developing container 36. The contact-separation member 71 includes a large elevated portion and a small elevated portion. The contact-separation member 71 is controlled in posture by a drive source M71 controlled by the control unit 10 to a first rotation angle posture in which the small elevated portion corresponds to the lower surface of the developing container 36 as illustrated in FIG. 4A and a second rotation angle posture in which the large elevated portion corresponds to the lower surface of the developing container 36 as illustrated in FIG. 4B.

The developing cartridge 3 mounted to the mount portion 3A is always applied with a pivoting moment about the swing center portion 33 by a bias force of the development pressure member 34 interposed between the upper surface of the developing container 36 and the force receiving portion 72 of the apparatus main body 8A. Regarding the pivoting moment, the relative positions of the swing center portion 33, the development pressure member 34, and the force receiving portion 72 are set so that the developer carrying member 30 of the developing cartridge 3 may face the photosensitive drum 20 of the photosensitive drum cartridge 2.

The contact-separation member 71 does not interfere with the developing container 36 in the first rotation angle posture in which the small elevated portion corresponds to the lower surface of the developing container 36. Thus, the developing cartridge 3 pivots by the above-mentioned pivoting moment of the development pressure member 34 until the developer carrying member 30 is brought into contact with a predetermined pressing force with the photosensitive drum 20 of the photosensitive drum cartridge 2 mounted to the mount portion 2A and received by the photosensitive drum 20. In other words, the developing cartridge 3 is moved to the contact position of FIG. 4A. The first rotation angle posture of the contact-separation member 71 for bringing the developing cartridge 3 into the contact position is hereinafter referred to as "contact position (first position) CP".

In the state in which the developing cartridge 3 is moved to the contact position, in the image forming operation, power is transmitted from the drive output portion (not shown) of the apparatus main body 8A to the drive input portion (not shown) of the developing cartridge 3, thereby rotationally driving the developer carrying member 30 and the developer feeding member 31.

The contact-separation member 71 acts to push up the developing container 36 against the bias force of the development pressure member 34 in the second rotation angle posture in which the large elevated portion corresponds to the lower surface of the developing container 36. In other words, the developing cartridge 3 receives a larger counter force from the contact-separation member 71 than the force received from the development pressure member 34.

Thus, the developing cartridge 3 is pivoted about the swing center portion 33 in the direction of separating the developer carrying member 30 from the photosensitive drum 20 while compressing the development pressure member provided between the upper surface of the developing container 36 and the force receiving portion 72 against the bias force. The developing cartridge 3 is then retained at a pivot position away from the photosensitive drum 20 by a predetermined distance. In other words, the developing cartridge 3 is moved to the separation position of FIG. 4B. The second rotation angle posture of the contact-separation member 71 for bringing the developing cartridge 3 into the separation position is hereinafter referred to as "separation position (second position) SP".

The electrical contacts "c" and "d" of the developing cartridge 3 mounted to the mount portion 3A are maintained to be electrically connected to the electrical contacts "g" and "h" of the apparatus main body 8A, respectively, when the developing cartridge 3 assumes any one of the contact position and the separation position. When the developing cartridge 3 is not located at the mount portion 3A or not properly mounted to the mount portion 3A, the electrical contacts "c" and "d" of the developing cartridge 3 are not connected to the electrical contacts "g" and "h" of the apparatus main body 8A.

The storage unit (memory) 35 of the developing cartridge 3 and the control unit 10 are configured to transmit and receive information therebetween via a communication unit (not shown) when the developing cartridge 3 assumes any one of the contact position and the separation position.

In the case where the photosensitive drum cartridge 2 and the developing cartridge 3 are properly mounted to the respective mount portions 2A and 3A, and the contact-separation member 71 assumes the contact position CP, the developing cartridge 3 assumes the contact position to be in the contact state in which the developer carrying member 30 and the photosensitive drum 20 are brought into contact with each other. Image formation is performed in this contact state. In the case where the photosensitive drum cartridge 2 and the developing cartridge 3 are properly mounted to the respective mount portions 2A and 3A, and the contact-separation member 71 assumes the separation position SP, the developing cartridge 3 assumes the separation position to be in the separation state in which the developer carrying member 30 and the photosensitive drum 20 are not in contact with but separated from each other.

In this embodiment, the cam is used as the contact-separation member 71 so that the developing cartridge 3 may be movable selectively between the contact position and the separation position. However, the configuration for moving the developing cartridge 3 between the contact position and the separation position is not limited thereto, and another configuration may be used. Alternatively, the photosensitive drum cartridge 2 may be movable instead.

(3) Mounting and Removing Structure for Photosensitive Drum Cartridge and Developing Cartridge Next, the mounting and removing structure for the photosensitive drum cartridge 2 and the developing cartridge 3 to and from the respective mount portions 2A and 3A is described.

In the image forming apparatus according to this embodiment, a first opening 81 for taking in and out the photosensitive drum cartridge 2 and a second opening 82 for taking in and out the developing cartridge 3 are arranged at two vertical positions of a predetermined side wall of the apparatus main body 8A. First and second doors 83 and 84 for opening and closing the first and second openings 81 and 82, respectively, are arranged. The first and second doors 83 and 84 are pivotable to open and close the respective first and second openings 81 and 82 about hinge shafts 83*a* and 84*a* provided on the lower side.

When the first and second doors 83 and 84 are pivoted and closed with respect to the side wall surface of the apparatus main body 8A about the respective hinge shafts 83*a* and 84*a* as indicated by solid lines of FIG. 1, the first and second openings 81 and 82 are closed. When the first and second doors 83 and 84 are pivoted and tilted by a predetermined angle outwardly from the apparatus main body 8A about the respective hinge shafts 83*a* and 84*a* as indicated by chain double-dashed lines of FIG. 1 and solid lines of FIG. 3, the first and second openings 81 and 82 are each opened widely.

A first door switch SW1 configured to detect the open/close of the first door 83 is provided on the apparatus main body 8A. The first door switch SW1 is turned ON when the first door 83 is closed in a predetermined manner, and is turned OFF when the first door is opened. A second door switch SW2 configured to detect the open/close of the second door 84 is provided on the apparatus main body 8A. The second door switch SW2 is turned ON when the second door 84 is closed in a predetermined manner, and is turned OFF when the second door 84 is opened.

When the first and second door switches SW1 and SW2 are both ON, that is, the first and second doors 83 and 84 are both closed, a power supply circuit (not shown) of the image forming apparatus is closed. On the other hand, when at least one of the first and second door switches SW1 and SW2 is turned OFF, that is, at least one of the first and second doors 83 and 84 is open, the power supply circuit is opened.

The photosensitive drum cartridge 2 mounted to the mount portion 2A is removed as follows. The user opens the first door 83 to widely open the first opening 81. Because the first door 83 is opened, the first door switch SW1 is turned OFF to open the power supply circuit. Further, the pressure to the photosensitive drum cartridge 2 from the pressing mechanism (not shown) of the apparatus main body 8A is released. Specifically, the positioning and fixing of the photosensitive drum cartridge 2 at the positioning portion of the apparatus main body 8A is released.

In this state, the user puts his/her hand in the apparatus main body 8A through the first opening 81 to take hold of the photosensitive drum cartridge 2. Then, the user slides and moves the photosensitive drum cartridge 2 along a guide portion (not shown) from the mount portion 2A toward the first opening 81, thereby removing the photosensitive drum cartridge 2 out of the apparatus main body 8A through the first opening 81.

The photosensitive drum cartridge 2 is mounted in a reverse procedure to the above-mentioned removal. Specifically, the user takes hold of the photosensitive drum cartridge 2 by his/her hand, and inserts the photosensitive drum cartridge 2 into the apparatus main body 8A through the first opening 81 with the photosensitive drum 20 in front, and pushes the photosensitive drum cartridge 2 sufficiently into the mount portion 2A along the guide portion so that the photosensitive drum cartridge 2 is positioned.

Then, the user closes the first door 83. By a mechanism that operates in association with the pivoting and closing of the first door 83, the pressing mechanism of the apparatus main body 8A operates to push the photosensitive drum cartridge 2. In this way, the photosensitive drum cartridge 2 is positioned and fixed at the positioning portion of the apparatus main body 8A. Further, the electrical contacts "a" and "b" of the photosensitive drum cartridge 2 are electrically connected to the electrical contacts "e" and "f" of the apparatus main body 8A, respectively. Then, the first door switch SW1 is turned ON to close the power supply circuit.

On the other hand, the developing cartridge 3 mounted to the mount portion 3A is removed as follows. The user opens the second door 84 to widely open the second opening 82. Because the second door 84 is opened, the second door switch SW2 is turned OFF to open the power supply circuit. If the contact-separation member 71 assumes the separation position SP, the contact-separation member 71 is turned to the contact position CP.

In this state, the user puts his/her hand in the apparatus main body 8A through the second opening 82 to take hold of the developing cartridge 3 positioned at the contact position, and slides and moves the developing cartridge 3 along a guide portion (not shown) from the mount portion 3A toward the second opening 82. Then, at the initial timing of the slide movement, the swing center portion 33 of the developing cartridge 3 comes off the holder of the apparatus main body 8A, and the development pressure member 34 also comes off the force receiving portion 72 of the apparatus main body 8A. The contact-separation member 71 assumes the contact position CP, and hence the contact-separation member 71 does not interfere with the developing container 36 in the above-mentioned removal process of the developing cartridge 3. Thus, the contact-separation member 71 does not hinder the removal of the developing cartridge.

Subsequently, the user slides and moves the developing cartridge 3 along the guide portion toward the second opening 82, thereby removing the developing cartridge 3 out of the apparatus main body 8A through the second opening 82.

The developing cartridge 3 is mounted in a reverse procedure to the above-mentioned removal. Specifically, the user takes hold of the developing cartridge 3 by his/her hand, and inserts the developing cartridge 3 into the apparatus main body 8A through the second opening 82 with the developer carrying member 30 in front, and pushes the developing cartridge 3 sufficiently into the mount portion 3A along the guide portion through the second opening 82.

When the developing cartridge 3 is sufficiently pushed into the mount portion 3A, the swing center portion 33 of the developing cartridge 3 is engaged with the holder of the apparatus main body 8A and retained, and the development pressure member 34 is positioned and received by the force receiving portion 72 of the apparatus main body 8A. In this way, the developing cartridge 3 is retained at the contact position. The contact-separation member 71 assumes the contact position CP, and hence the contact-separation member 71 does not interfere with the developing container 36 in the above-mentioned inserting process of the developing cartridge 3. Thus, the contact-separation member 71 does not hinder the insertion of the developing cartridge. Then, the user closes the second door 84. The second door switch SW2 is turned ON to close the power supply circuit.

In this embodiment, the photosensitive drum cartridge 2 and the developing cartridge 3 are individually removably mountable to the apparatus main body 8A. Alternatively, the photosensitive drum cartridge 2 and the developing cartridge 3 may be mounted through the same opening so that the developing cartridge 3 is mounted after the photosensitive drum cartridge 2 is mounted. Contrary, the photosensitive drum cartridge 2 may be mounted after the developing cartridge 3 is mounted.

(4) Detection of Remaining Amount of Toner of Developing Cartridge 3

As described above, when the photosensitive drum cartridge 2 is positioned at the mount portion 2A, the photosensitive drum 20 is connected to the ground via the electrical contacts "b" and "f". The charging member 21 is connected via the electrical contacts "a" and "e" to the charging voltage applying unit 90 of the apparatus main body 8A for applying a predetermined charging voltage. In this embodiment, a DC voltage is used as the charging voltage, but this is not a limitation. A charging voltage obtained by superimposing an AC voltage on a DC voltage may be used instead.

When the developing cartridge 3 assumes the contact position or the separation position in the mount portion 3A, the developer feeding member 31 is connected to the detection voltage applying unit 93 of the apparatus main body 8A via the electrical contacts "d" and "h". The detection voltage applying unit 93 includes at least AC voltage applying unit 91 configured to apply an AC voltage. In this embodiment, the detection voltage applying unit 93 includes DC voltage applying unit 92 configured to apply a DC voltage and the AC voltage applying unit 91.

When the developing cartridge 3 assumes the contact position or the separation position, the developer carrying member 30 is connected via the electrical contacts "c" and "g" to developing voltage applying unit 94 of the apparatus main body 8A for applying a predetermined DC voltage as a developing voltage and to capacitance detecting unit 95 of the apparatus main body 8A.

In the case where the photosensitive drum cartridge 2 and the developing cartridge 3 are not positioned at the mount portions 2A and 3A or not properly mounted to the mount portions 2A and 3A, respectively, the electrical contacts "b" and "f", "a" and "e", "d" and "h", and "c" and "g" are not connected.

The capacitance detecting unit (detecting unit) is a current detecting unit configured to detect a current flowing between the developer carrying member 30 and the developer feeding member 31. The capacitance detecting unit 95 detects an AC current amount which is induced in the developer carrying member 30 when a predetermined detection voltage containing at least an AC component is applied to the developer feeding member 31, to thereby detect the capacitance between the developer carrying member 30 and the developer feeding member 31.

The capacitance may be detected by applying a DC voltage to detect a DC current amount, rather than by applying an AC current to detect the AC current amount. In the case of the configuration of detecting the capacitance by applying a DC voltage to detect a DC current amount, it is necessary to provide a potential difference to a capacitor formed by the developer carrying member 30 and the developer feeding member 31 so as to detect the amount of an ultra-short current that flows when the capacitor with capacitance is charged.

In this embodiment, the AC current entering and exiting the developer carrying member 30 flows through the capacitance detecting unit 95, and the capacitance detecting unit 95 forms a circuit for dropping the voltage in accordance with the AC current amount. Specifically, the voltage output from the capacitance detecting unit 95 is reduced as the value of the current flowing through the capacitance detecting unit 95 becomes larger. The capacitance detecting unit 95 is configured to measure how the voltage output from the capacitance detecting unit 95 to the control unit 10 (detected voltage) drops (reduces) from a predetermined reference voltage V0. Based on this result, the capacitance detecting unit 95 measures the amount of the AC current flowing through the capacitor (the amount of the current flowing through the capacitance detecting unit 95). As the capacitance between the developer carrying member 30 and the developer feeding member 31 becomes larger, a larger amount of the AC current is induced in the developer carrying member 30 (a larger amount of the current flows through the capacitance detecting unit 95). As a result, the detected voltage of the capacitance detecting unit 95 greatly reduces from the reference voltage V0 to have a smaller value.

Specifically, the capacitance C of the capacitor is calculated from the following expression.

$$Iac=2\pi FCV$$

"Iac" represents the amount of the AC current flowing through the capacitor, that is, the current amount calculated by the capacitance detecting unit 95. "V" represents an effective voltage applied to the developer feeding member 31 by the detection voltage applying unit 93. When the voltage applied to the developer feeding member 31 is a square wave having a peak-to-peak voltage Vpp, the effective voltage V is V=Vpp/2. "F" represents the frequency of the voltage applied to the developer feeding member 31 by the detection voltage applying unit 93.

In this embodiment, the capacitance detecting unit 95 is used to detect the remaining amount of the toner (developer) T in the developing container 36. The capacitance detecting unit 95 outputs the detected voltage corresponding to the capacitance between the developer carrying member 30 and the developer feeding member 31 to the control unit 10. As a larger amount of toner is present between the developer carrying member 30 and the developer feeding member 31, the capacitance between the developer carrying member 30 and the developer feeding member 31 becomes larger. Contrary, when the toner is consumed by the developing operation and the amount of toner between the developer carrying member 30 and the developer feeding member 31 becomes smaller, the capacitance between the developer carrying member 30 and the developer feeding member 31 becomes smaller.

Thus, the remaining amount of toner may be detected in a manner that a detection voltage containing at least an AC component is applied to the developer feeding member 31, and a voltage corresponding to the amount of an AC current induced in the developer carrying member 30 is detected by the capacitance detecting unit 95. The remaining amount of toner may be detected when the developing cartridge 3 assumes any one of the contact position and the separation position. However, the detected voltage of the capacitance detecting unit 95 differs depending on whether the developing cartridge 3 assumes the contact state or the separation state with respect to the photosensitive drum cartridge 2.

This is because the photosensitive drum cartridge 2 is brought into contact with the developer carrying member 30 in the contact state as opposed to the separation state and hence an apparent capacitance between the developer carrying member 30 and the developer feeding member 31 becomes smaller. In other words, in the contact state of the developing cartridge 3, as compared to the separation state, when the detection voltage is applied to the developer feeding member 31, an induced current flows through the photosensitive drum cartridge 2 as well as the developer carrying member 30, and the amount of the AC current flowing through the developer carrying member 30 is reduced.

Specifically, the detected voltage of the capacitance detecting unit 95 in the contact state of the developing cartridge 3 becomes larger than the detected voltage in the separation state. It is therefore desired to detect the remaining amount of toner in any one of the contact state and the separation state. In this embodiment, the remaining amount of toner is detected in the separation state of the developing cartridge 3, that is, in the non-developing operation.

Figure 5:
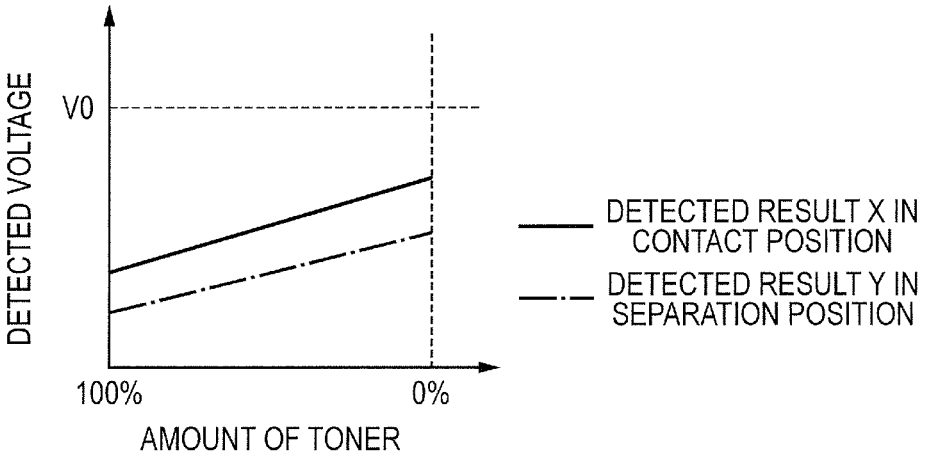
FIG. 5 is a schematic graph showing a relationship between the remaining amount of toner and a detected result of capacitance detecting unit.

FIG. 5 shows the relationship between the remaining amount of toner in the developing container 36 and the detected voltage of the capacitance detecting unit 95. The photosensitive drum cartridge 2 and the developing cartridge 3 were properly mounted to the respective mount portions of the apparatus main body 8A. The solid line represents a detected result X of the detected voltage of the capacitance detecting unit 95 with respect to the remaining amount of toner, which was detected in the contact position (contact state). The dashed line represents a detected result Y of the detected voltage of the capacitance detecting unit 95 with respect to the remaining amount of toner, which was detected in the separation position (separation state).

The applied detection voltage was a sinewave AC voltage having a frequency of 50 kHz and an amplitude of 0.1 kV. The use environments of the image forming apparatus 8 were a temperature of 23° C. and a humidity of 50% RH. The remaining amount of toner of a new developing cartridge 3 is defined as 100%, and the remaining amount of toner after the toner is too consumed to output a solid image is defined as 0%. V0 is a reference voltage.

As shown in FIG. 5, both the detected result X detected in the contact position and the detected result Y detected in the separation position indicate that the detected voltage of the capacitance detecting unit 95 increases as the remaining amount of toner becomes smaller. This is because the capacitance between the developer carrying member 30 and the developer feeding member 31 decreases when the toner is consumed. The detected result X detected in the contact position has a larger detected voltage than that of the detected result Y detected in the separation position. This is because the capacitance between the developer carrying member 30 and the developer feeding member 31 becomes smaller in the contact state than in the separation state due to the capacitance of the photosensitive drum cartridge 2.

The detected voltage of the capacitance detecting unit 95 detected in the contact position or the separation position has a correlation with the remaining amount of toner of the developing cartridge 3. Therefore, by storing the relationship between the detected voltage of the capacitance detecting unit 95 and the remaining amount of toner in the storage unit 35 of the developing cartridge 3 in advance, the remaining amount of toner of the developing cartridge can be detected based on the detected voltage of the capacitance detecting unit 95. Although the relationship between the detected voltage of the capacitance detecting unit 95 and the remaining amount of toner is stored in the storage unit 35 of the developing cartridge 3 in this embodiment, the relationship may be stored in another storage unit.

Although the use environments of the image forming apparatus 8 were a temperature of 23° C. and a humidity of 50% RH, the same effects may be obtained in other use environments, though the magnitude of the detected result slightly differs.

Figure 6A:
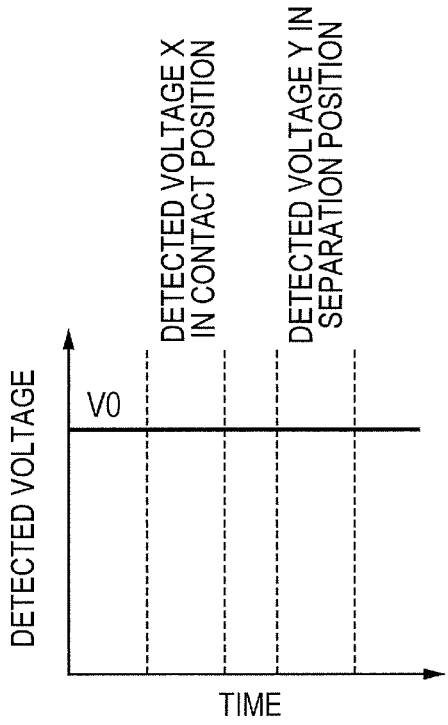
FIGS. 6A, 6B, and 6C are schematic graphs showing capacitance detected results in various mount states of the photosensitive drum cartridge and the developing cartridge.
Figure 6B:
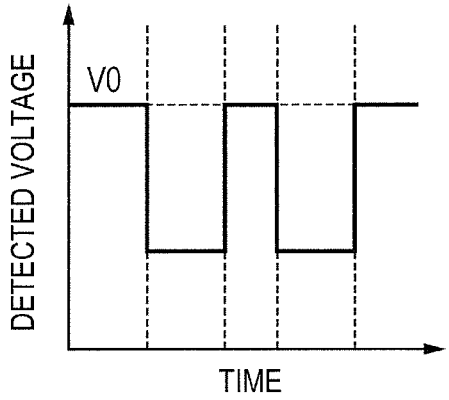
Figure 6C:
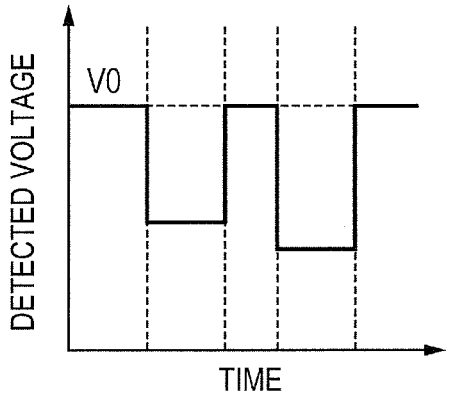

(5) Configuration Configured to Detect Mount States of Photosensitive Drum Cartridge and Developing Cartridge Next, a description is given of a method of determining whether or not the photosensitive drum cartridge 2 and the developing cartridge 3, which are each removably mountable to the apparatus main body 8A, are properly mounted to the respective mount portions 2A and 3A. FIGS. 6A, 6B, and 6C show detected results of the capacitance detecting unit 95 when each of (both of) the photosensitive drum cartridge 2 and the developing cartridge 3 was mounted to the mount portion of the apparatus main body 8A.

In this experiment, each of (both of) the photosensitive drum cartridge 2 and the developing cartridge 3 is mounted to the mount portion of the apparatus main body 8A. First, the contact-separation member 71 is driven and turned to the contact position CP. Then, a detection voltage containing an AC voltage is applied from the detection voltage applying unit 93 to the developer feeding member 31, and a detected voltage X is detected by the capacitance detecting unit 95. After the detection of the detected voltage X, the detection voltage applying unit 93 is turned OFF.

Subsequently, the contact-separation member 71 is driven and turned to the separation position SP. Then, the same detection voltage as the above-mentioned voltage applied in the case of the contact position is applied from the detection voltage applying unit 93 to the developer feeding member 31, and a detected voltage Y is detected by the capacitance detecting unit 95. After the detection of the detected voltage Y, the detection voltage applying unit 93 is turned OFF.

In this experiment, the developing cartridge 3 having the remaining amount of toner of 50% was used, and the applied detection voltage was a sinewave AC voltage having a frequency of 50 kHz and an amplitude of 0.1 kV. The use environments of the image forming apparatus 8 were a temperature of 23° C. and a humidity of 50% RH.

FIG. 6A shows a detected result when neither the photosensitive drum cartridge 2 nor the developing cartridge 3 is mounted and a detected result when the photosensitive drum cartridge 2 is mounted but the developing cartridge 3 is not mounted. The developing cartridge 3 is not mounted, and hence the capacitance between the developer carrying member 30 and the developer feeding member 31 cannot be detected. Thus, the detected voltage X in the contact position CP and the detected voltage Y in the separation position SP both have a value substantially equal to the reference voltage V0.

FIG. 6B shows a detected result when the developing cartridge 3 is mounted but the photosensitive drum cartridge 2 is not mounted. The photosensitive drum cartridge 2 is not mounted, and hence the developer carrying member 30 is separated from the photosensitive drum 20 in both the cases of the contact position CP and the separation position SP. Thus, the detected voltage X in the contact position CP and the detected voltage Y in the separation position SP both have a value substantially equal to the detected voltage Y of FIG. 5 measured when the remaining amount of toner is 50%.

FIG. 6C shows a detected result when the photosensitive drum cartridge 2 and the developing cartridge 3 are both mounted. The photosensitive drum cartridge 2 and the developing cartridge 3 are both mounted, and hence the photosensitive drum 20 and the developer carrying member 30 are brought into contact with each other by a predetermined pressure. Thus, the detected voltage X in the contact position CP has a value substantially equal to the detected voltage X of FIG. 5 measured when the remaining amount of toner is 50%.

In the case of the separation position SP, the photosensitive drum cartridge 2 and the developer carrying member 30 are not in contact with but separated from each other, and hence an apparent capacitance becomes larger than the capacitance in the case of the contact position CP. Thus, the detected voltage Y in the separation position has a value smaller than the detected voltage X in the contact position CP. In other words, the detected voltage Y in the separation position SP has a value substantially equal to the detected voltage Y of FIG. 5 measured when the remaining amount of toner is 50%.

In the above-mentioned experiment, the developing cartridge 3 having the remaining amount of toner of 50% was used. However, the same results are obtained even when a developing cartridge having another remaining amount of toner is used.

In view of the results described above, the photosensitive drum 20 included in the photosensitive drum cartridge 2 and the developer carrying member 30 included in the developing cartridge 3 are configured to be in contact with and separated from each other. The capacitance detecting unit 95, which is connectable to the developing cartridge 3, is used to detect the capacitance of the capacitor formed by the developer carrying member 30 and the developer feeding member 31 when the contact-separation member 71 assumes the contact position CP and the separation position SP.

It is understood from the above that this configuration may discriminate at least the following three states (1) to (3) relating to the mount states of the photosensitive drum cartridge and the developing cartridge with respect to the apparatus main body 8A, regardless of the use environments and the remaining amount of toner:

(1) the state in which the developing cartridge 3 (cartridge provided with capacitor) is not properly mounted;

(2) the state in which the developing cartridge 3 is properly mounted but the photosensitive drum cartridge 2 is not properly mounted; and (3) the state in which the developing cartridge 3 and the photosensitive drum cartridge 2 are both properly mounted.

In other words, at least the above-mentioned three states (1) to (3) relating to the mount states of the photosensitive drum cartridge and the developing cartridge with respect to the apparatus main body 8A may be discriminated by the capacitance detecting unit 95 alone. Specifically, detailed information on whether or not the image forming apparatus is ready for image formation may be obtained. When the image forming apparatus is ready for image formation, the preparation for image formation is started. When it is determined that image formation cannot be performed, on the other hand, appropriate measures may be taken to stop the image forming apparatus or alert a user.

Figure 7:
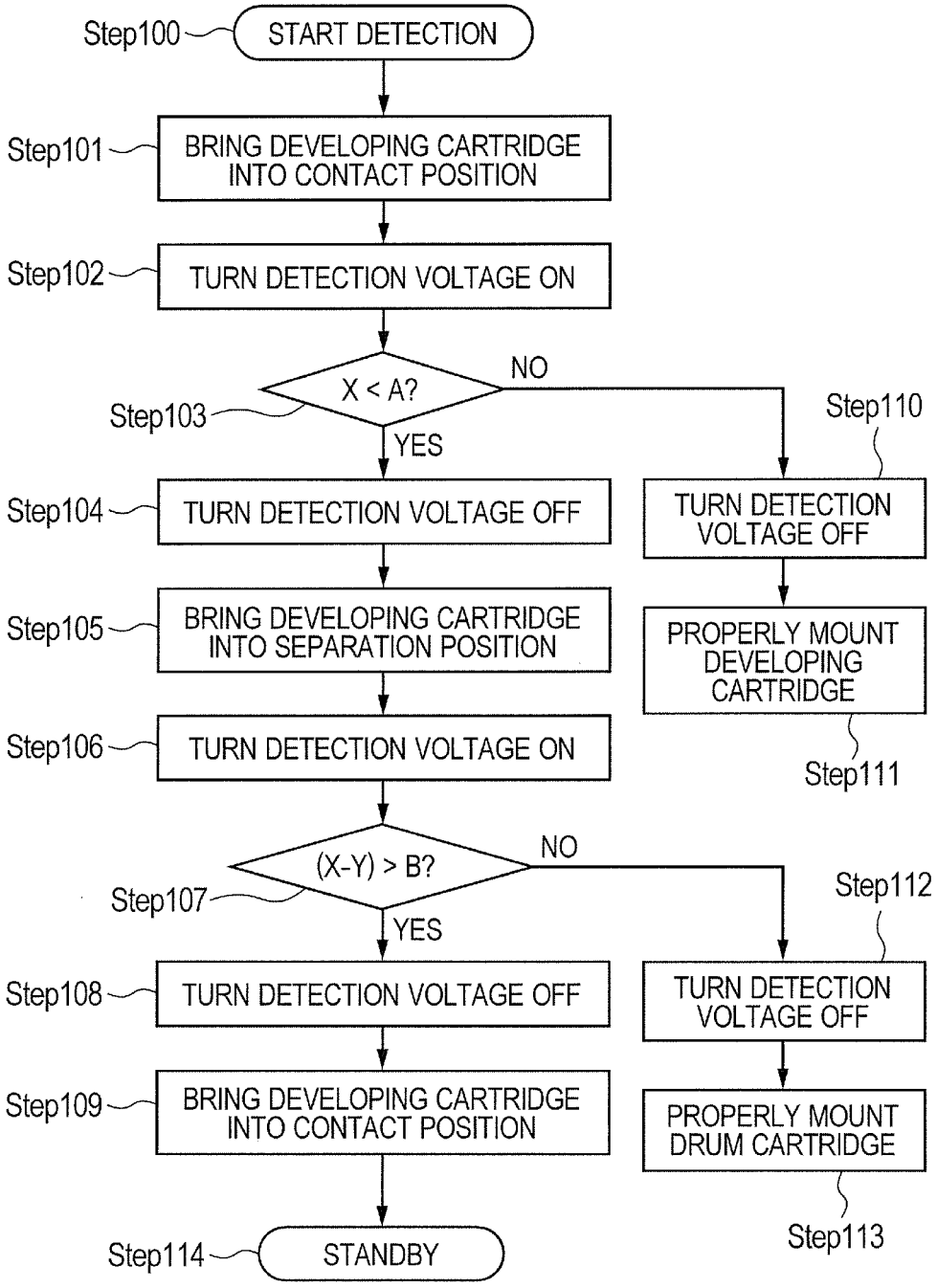
FIG. 7 is a sequence chart for detecting the mount states of the photosensitive drum cartridge and the developing cartridge.

FIG. 7 is a sequence chart for determining the mount states of the photosensitive drum cartridge 2 and the developing cartridge 3 to the apparatus main body 8A according to this embodiment. This sequence is executed by the control unit 10.

This sequence is started when the first and second doors 83 and 84 are closed to turn ON the first and second door switches SW1 and SW2 and when the main power switch is turned ON (Step 100). Alternatively, this sequence is started when the main power switch is turned ON and when the first and second doors 83 and 84 are both closed to turn ON the first and second door switches SW1 and SW2 (Step 100).

First, in Step 101, the control unit 10 turns the contact-separation member 71 to the contact position if the contact-separation member 71 assumes the separation position. Next, in Step 102, the detection voltage applying unit 93 is turned ON to apply a detection voltage, and a detected voltage X (first detected result) in the contact position is detected by the capacitance detecting unit 95. The applied detection voltage was a sinewave AC voltage having a frequency of 50 kHz and an amplitude of 0.1 kV, which are different from those in the developing operation but the same as those in the detection of the remaining amount of toner. However, the detection voltage is not limited thereto as long as the capacitance between the developer carrying member 30 and the developer feeding member 31 may be detected as described above.

Subsequently, in Step 103, the detected voltage X is compared to a threshold A (first predetermined value) stored in the control unit 10 in advance. The threshold A is determined in advance as a value in the range expressed by Expression (1) below. In Expression (1), "Xmax" is a maximum value of the detected voltage X in the range of the remaining amount of toner of 0% to 100% by taking into account of use environments and fluctuations in detected result.

$$Xmax<A<V0 \quad \text{Ex. (1)}$$

When the detected voltage X is equal to or larger than the threshold A, the sequence proceeds to Step 110, and the detection voltage is turned OFF. Then, in Step 111, the control unit 10 controls a display portion of the apparatus operation portion 13 to display a message indicating that the developing cartridge 3 is not properly mounted, such as a message "Properly mount the developing cartridge", to thereby notify the user. In this case, the user opens the second door 84, and mounts the unmounted developing cartridge 3 or properly mounts the developing cartridge 3 that has not been properly mounted. Then, the user closes the second door 84. The control unit 10 restarts this sequence (Step 100). Note that, in Step 111, the control unit 10 displays information about the developing cartridge 3 on the display portion of the apparatus operation portion 13, but may display the information on the host device 12 connected to the image forming apparatus 8. In other words, in Step 111, the control unit 10 only needs to notify the user that the image forming apparatus 8 is not ready for image formation in any form, and hence the display unit is selected as appropriate depending on the configuration and type of usage of the image forming apparatus 8.

In Step 103, when the detected voltage X is smaller than the threshold A, the sequence proceeds to Step 104, and the detection voltage applying unit 93 is turned OFF. After that, in Step 105, the contact-separation member 71 is driven to the separation position SP.

Next, in Step 106, the detection voltage applying unit 93 is turned ON to apply a detection voltage, and a detected voltage Y (second detected result) in the separation position is detected by the capacitance detecting unit 95. Subsequently, in Step 107, a difference (X−Y) between the detected voltage X and the detected voltage Y is compared to a threshold B (second predetermined value) stored in the control unit 10 in advance. The threshold B is determined in advance as a value in the range expressed by Expression (2) below. In Expression (2), "(X−Y)min" is a minimum value of the difference between the detected voltage X and the detected voltage Y in the range of the remaining amount of toner of 0% to 100% by taking into account of use environments and fluctuations in detected result.

$$0<B<(X-Y)\text{min} \quad \text{Ex. (2)}$$

When the difference (X−Y) between the detected voltage X and the detected voltage Y is equal to or smaller than the threshold B, the sequence proceeds to Step 112, and the detection voltage applying unit 93 is turned OFF. Then, in Step 113, the control unit 10 controls the display portion of the apparatus operation portion 13 to display a message indicating that the photosensitive drum cartridge 2 is not properly mounted, such as a message "Properly mount the photosensitive drum cartridge", to thereby notify the user.

In response to the notification, the user opens the first door 83, and mounts the unmounted photosensitive drum cartridge 2 or properly mounts the photosensitive drum cartridge 2 that has not been properly mounted. Then, the user closes the first door 83. The control unit 10 restarts this sequence (Step 100).

In Step 107, when the difference (X−Y) between the detected voltage X and the detected voltage Y is larger than the threshold B, the sequence proceeds to Step 108, and the detection voltage applying unit 93 is turned OFF. After that, the sequence proceeds to Step 109, and the contact-separation member 71 is driven to the contact position CP.

Then, in Step 114, the image forming apparatus 8 becomes the standby state for waiting for a print job. When receiving a print job in the standby state, the image forming apparatus 8 starts printing to form an image.

As exemplified by this sequence, it is preferred to determine the mount state of the photosensitive drum cartridge 2 after determining the mount state of the developing cartridge 3. This is because the mount state of the developing cartridge 3 may be checked merely based on the detected voltage X in the contact state, which enables quick notification to the user that image formation cannot be executed because the developing cartridge 3 is not properly mounted.

Although the difference (X−Y) is used to compare the detected voltage X and the detected voltage Y, another parameter such as a ratio therebetween may be used as long as the comparison is possible. For example, the control in Step 107 may be performed in a manner that the ratio between the detected voltage X and the detected voltage Y is used to determine that the photosensitive drum cartridge 2 is mounted when the ratio X/Y is larger than a predetermined threshold C.

As described above, in this embodiment, at least the following three states may be discriminated by the capacitance detecting unit 95 alone:

(1) the state in which the developing cartridge 3 is not properly mounted;

(2) the state in which the developing cartridge 3 is properly mounted but the photosensitive drum cartridge 2 is not properly mounted; and (3) the state in which the developing cartridge 3 and the photosensitive drum cartridge 2 are both properly mounted.

The image forming apparatus 8 according to the above-mentioned first embodiment is summarized as follows. In the image forming apparatus 8, the developing cartridge (first unit) 3 and the photosensitive drum cartridge (second unit) 2 are mountable. The image forming apparatus 8 includes the developer carrying member 30, which is retained in the developing cartridge 3 and bears a developer. The image forming apparatus 8 includes the developer feeding member (first member) 31, which is retained in the developing cartridge 3 and forms a capacitor by being paired with the developer carrying member 30. The image forming apparatus 8 includes the photosensitive drum (second member) 20, which is retained in the photosensitive drum cartridge 2 and is provided to be contactable to the developer carrying member 30.

The image forming apparatus 8 further includes the current detecting unit 95 configured to detect a current flowing between the developer carrying member 30 and the developer feeding member (first member) 31. The image forming apparatus 8 includes the contact-separation member 71, which is movable between the contact position (first position) CP for bringing the developer carrying member 30 and the photosensitive drum 20 into contact with each other and the separation position (second position) SP for separating the developer carrying member 30 and the photosensitive drum 20 from each other.

The value of the current detecting unit 95 detected when a voltage is applied to one of the developer carrying member 30 and the developer feeding member 31 with the contact-separation member 71 being located at the contact position CP is referred to as "first detected result X". The value of the current detecting unit 95 detected when a voltage is applied to one of the developer carrying member 30 and the developer feeding member 31 with the contact-separation member 71 being located at the separation position SP is referred to as "second detected result Y". Then, the image forming apparatus 8 includes the control unit (control portion) 10, which is configured to transmit an information signal relating to the mount states of the developing cartridge 3 and the photosensitive drum cartridge 2 based on the first detected result X and the second detected result Y.

The control unit (control portion) 10 is configured to transmit an information signal relating to the following three states:

(1) the state in which the developing cartridge (first unit) 3 is not mounted to the apparatus main body 8A;

(2) the state in which the developing cartridge 3 is mounted to the apparatus main body 8A but the photosensitive drum cartridge (second unit) 2 is not mounted; and (3) the state in which the developing cartridge 3 and the photosensitive drum cartridge 2 are mounted to the apparatus main body 8A.

When it is determined from the first result that the developing cartridge (first unit) 3 is not mounted, the control unit (control portion) 10 transmits the information signal relating to the state in which the developing cartridge 3 is not mounted, without obtaining the second result.

The above-mentioned apparatus configuration may detect the mount states of the two cartridges 2 and 3 without using two detecting units. Thus, a more inexpensive image forming apparatus and a more compact image forming apparatus may be provided.

Further, in the image forming apparatus which is configured to detect the remaining amount of toner by detecting the capacitance between conductive members such as the developer carrying member 30 and the developer feeding member 31, the mount states of the developing cartridge 3 and the photosensitive drum cartridge 2 may be determined without adding an additional member. Thus, a more inexpensive image forming apparatus and a more compact image forming apparatus may be provided.

Second Embodiment

A second embodiment of the present invention is now described below. In this embodiment, the first unit is the developing cartridge 3, the second unit is the photosensitive drum cartridge 2, the first member is the developer layer thickness regulating member 32, the second member is the photosensitive drum 20, the first position is the contact position CP, and the second position is the separation position SP.

Figure 8B:
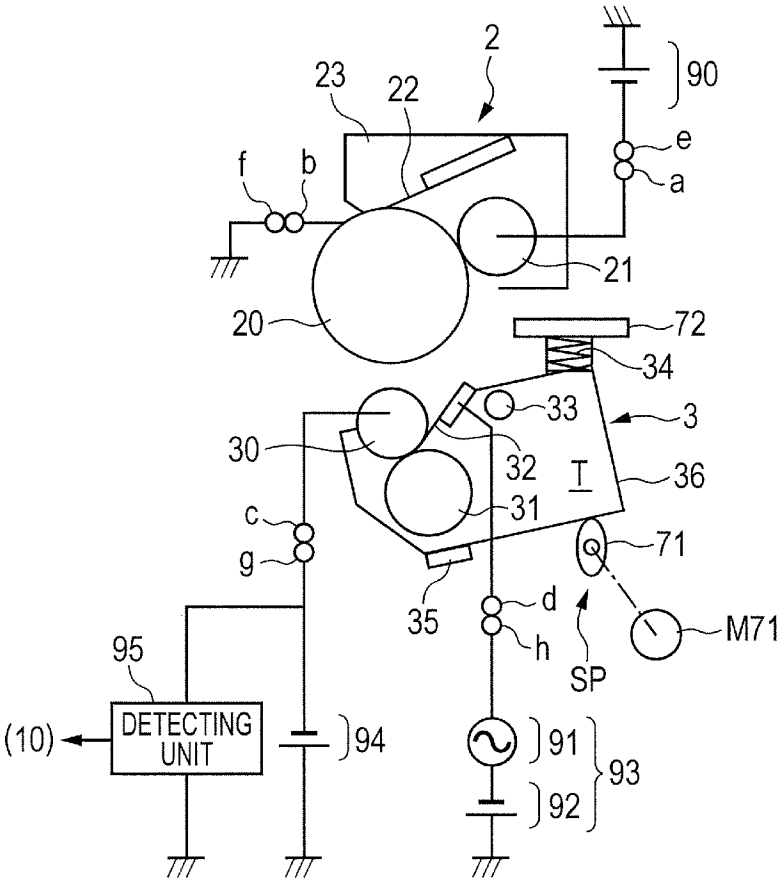
FIG. 8B is a schematic diagram of a separation state of the developing cartridge and its electrical connection according to a second embodiment of the present invention.
Figure 8A:
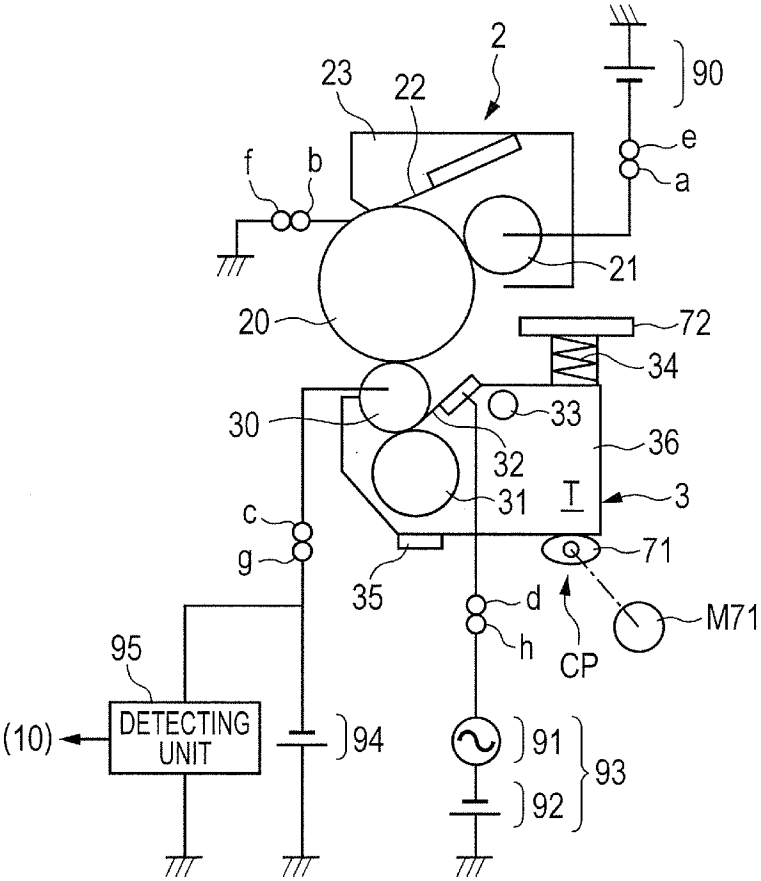
FIG. 8A is a schematic diagram of a contact state of the developing cartridge and its electrical connection.

FIG. 8A is a schematic diagram of the contact state in which the developer carrying member 30 is brought into contact with the photosensitive drum 20. FIG. 8B is a schematic diagram of the separation state in which the developer carrying member 30 is separated from the photosensitive drum 20 in a non-contact state.

When the photosensitive drum cartridge 2 is positioned and fixed at the mount portion 2A, the photosensitive drum 20 is connected to the ground. The charging member 21 is connected to the charging voltage applying unit 90 configured to apply a predetermined charging voltage.

When the developing cartridge 3 assumes the contact position or the separation position in the mount portion 3A, the developer layer thickness regulating member 32 is connected to the detection voltage applying unit 93. The detection voltage applying unit 93 includes the AC voltage applying unit 91 configured to apply an AC voltage. When the developing cartridge 3 assumes the contact position or the separation position, the developer carrying member 30 is connected to the developing voltage applying unit 94 configured to apply a predetermined DC voltage as a developing voltage, and to the capacitance detecting unit (current detecting unit) 95.

In the case where the photosensitive drum cartridge 2 and the developing cartridge 3 are not mounted to the mount portions 2A and 3A or not properly mounted to the mount portions 2A and 3A, respectively, the electrical contacts "b" and "f", "a" and "e", "d" and "h", and "c" and "g" are not connected.

In the developing operation, the photosensitive drum 20 was charged at −500 V, a DC voltage of −350 V was applied as the developing voltage, and a DC voltage of −400 V was applied to the developer feeding member 31. Only a DC voltage of −450 V was applied to the developer layer thickness regulating member 32.

The detection voltage applied to the developer layer thickness regulating member 32 was a sinewave AC voltage having a frequency of 50 kHz and an amplitude of 0.1 kV, which are different from those in the developing operation. However, the detection voltage is not limited thereto. Any voltage may be applied as long as the capacitance between the developer layer thickness regulating member 32 and the developer carrying member 30 may be detected.

In this embodiment, the developer layer thickness regulating member 32 uses a conductive blade. However, this is not a limitation. The developer layer thickness regulating member 32 only needs to have a conductive member so that the capacitance between the conductive member and the developer carrying member 30 may be detected.

The other configurations and control are the same as in the first embodiment, and hence the same configurations are denoted by the same reference symbols and detailed description thereof is omitted.

Also in this embodiment, the same three mount states as those (1) to (3) of the first embodiment may be discriminated by the capacitance detecting unit (detecting unit) 95 alone. Therefore, the mount states of two cartridges may be detected without using two detecting units. Thus, a more inexpensive image forming apparatus and a more compact image forming apparatus may be provided. The present invention may be carried out as long as the member which is paired with the developer carrying member 30 to form a capacitor is a conductive member included in the developing cartridge 3 as in this embodiment.

Third Embodiment

A third embodiment of the present invention is now described below. In this embodiment, the first unit is the developing cartridge 3, the second unit is the photosensitive drum cartridge 2, the first member is the developer feeding member 31, the second member is the photosensitive drum 20, the first position is the contact position CP, and the second position is the separation position SP.

Figure 9B:
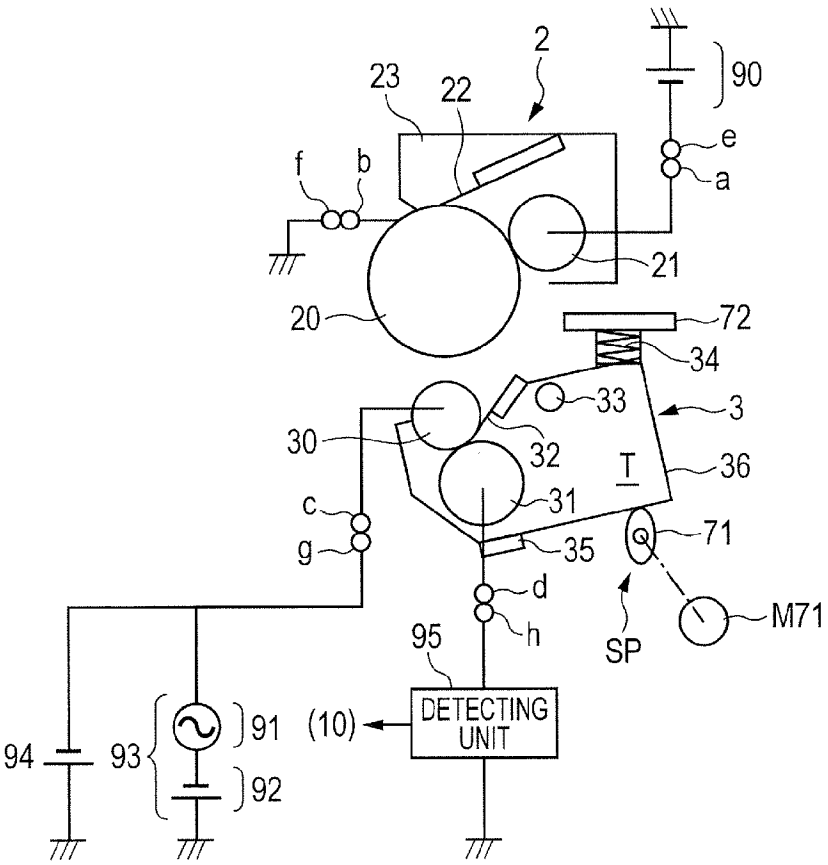
FIG. 9B is a schematic diagram of a separation state of the developing cartridge and its electrical connection according to a third embodiment of the present invention.
Figure 9A:
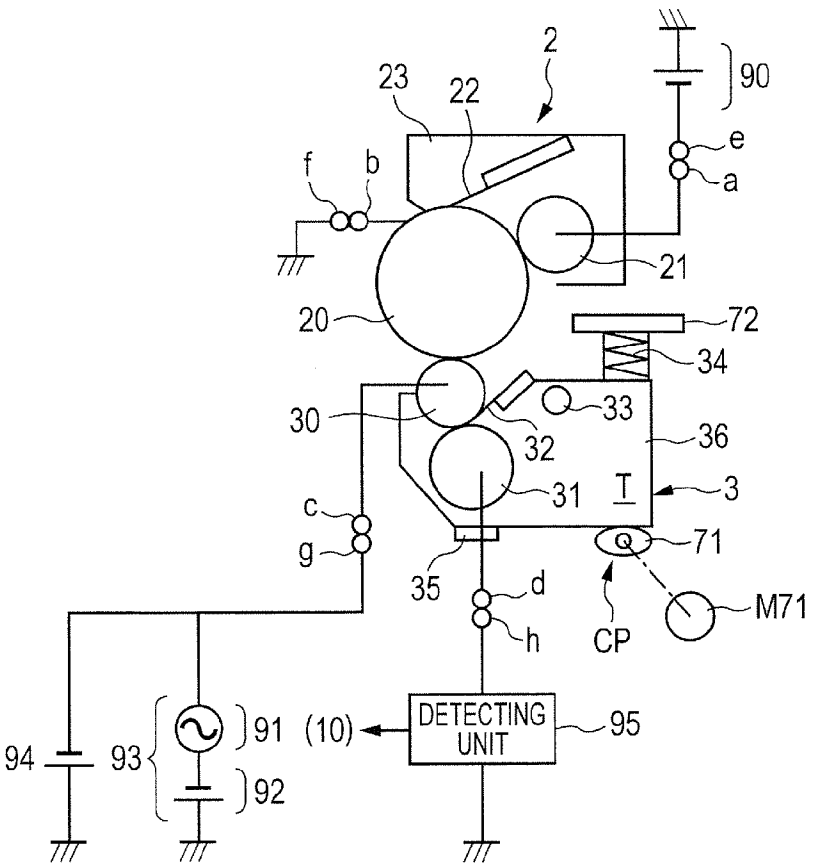
FIG. 9A is a schematic diagram of a contact state of the developing cartridge and its electrical connection.

FIG. 9A is a schematic diagram of the contact state in which the developer carrying member 30 is brought into contact with the photosensitive drum 20. FIG. 9B is a schematic diagram of the separation state in which the developer carrying member 30 is separated from the photosensitive drum 20 in a non-contact state.

When the photosensitive drum cartridge 2 is positioned and fixed at the mount portion 2A of the apparatus main body 8A, the photosensitive drum 20 is connected to the ground. The charging member 21 is connected to the charging voltage applying unit 90 configured to apply a predetermined charging voltage.

When the developing cartridge 3 assumes the contact position or the separation position in the mount portion 3A, the developer carrying member 30 is connected to the detection voltage applying unit 93 and the developing voltage applying unit 94. The detection voltage applying unit 93 includes the AC voltage applying unit 91 configured to apply an AC voltage. When the developing cartridge 3 assumes the contact position or the separation position, the developer feeding member 31 is connected to the capacitance detecting unit (current detecting unit) 95.

In the case where the photosensitive drum cartridge 2 and the developing cartridge 3 are not mounted to the apparatus main body 8A or not properly mounted to the predetermined positions, respectively, the electrical contacts "b" and "f", "a" and "e", "d" and "h", and "c" and "g" are not connected.

In the developing operation, the photosensitive drum 20 was charged at −500 V, a DC voltage of −350 V was applied as the developing voltage, and a DC voltage of −400 V was applied to the developer feeding member 31. The detection voltage applied to the developer carrying member 30 was a sinewave AC voltage having a frequency of 50 kHz and an amplitude of 0.1 kV, which are different from those in the developing operation. However, the detection voltage is not limited thereto. Any voltage may be applied as long as the capacitance between the developer carrying member 30 and the developer feeding member 31 may be detected as described above.

The other configurations and control are the same as in the first embodiment, and hence the same configurations are denoted by the same reference symbols and detailed description thereof is omitted.

Also in this embodiment, the same three mount states as those (1) to (3) of the first embodiment may be discriminated by the capacitance detecting unit (detecting unit) 95 alone. Therefore, the mount states of two cartridges may be detected without using two detecting units. Thus, a more inexpensive image forming apparatus and a more compact image forming apparatus may be provided. As described in this embodiment, the capacitance between the developer carrying member 30 and the conductive member included in the developing cartridge 3 may be detected also by applying a detection voltage to any one of the developer carrying member 30 and the conductive member included in the developing cartridge 3.

Fourth Embodiment

A fourth embodiment of the present invention is now described below. In this embodiment, the first unit is the photosensitive drum cartridge 2, the second unit is the developing cartridge 3, the first member is the charging member 21, the second member is the developer carrying member 30, the first position is the contact position CP, and the second position is the separation position SP. The feature of this embodiment is that the capacitor whose capacitance is detected by the capacitance detecting unit 95 is provided in the photosensitive drum cartridge. The details are described below.

Figure 10B:
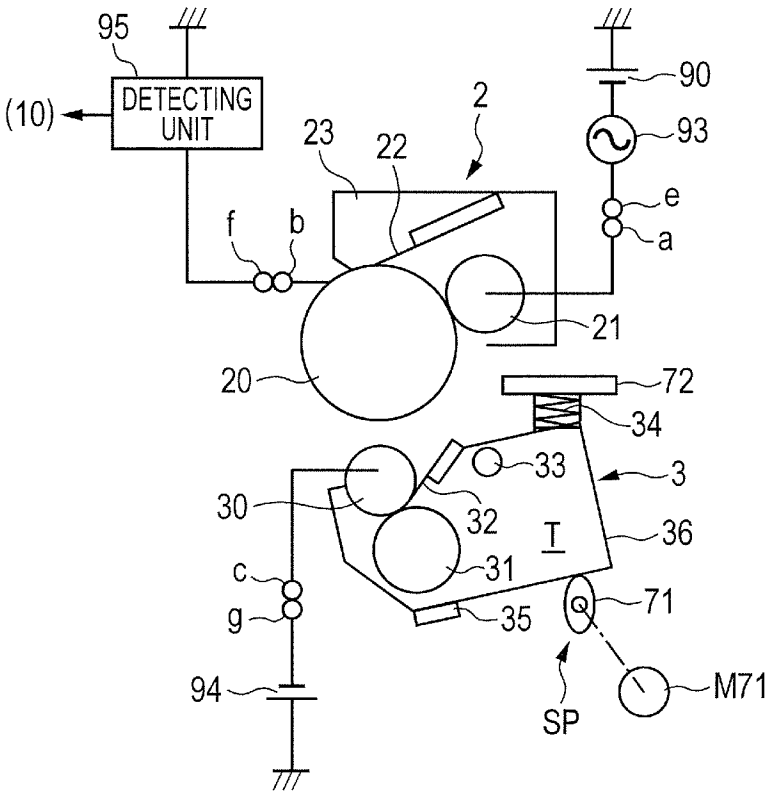
FIG. 10B is a schematic diagram of a separation state of the developing cartridge and its electrical connection according to a fourth embodiment of the present invention.
Figure 10A:
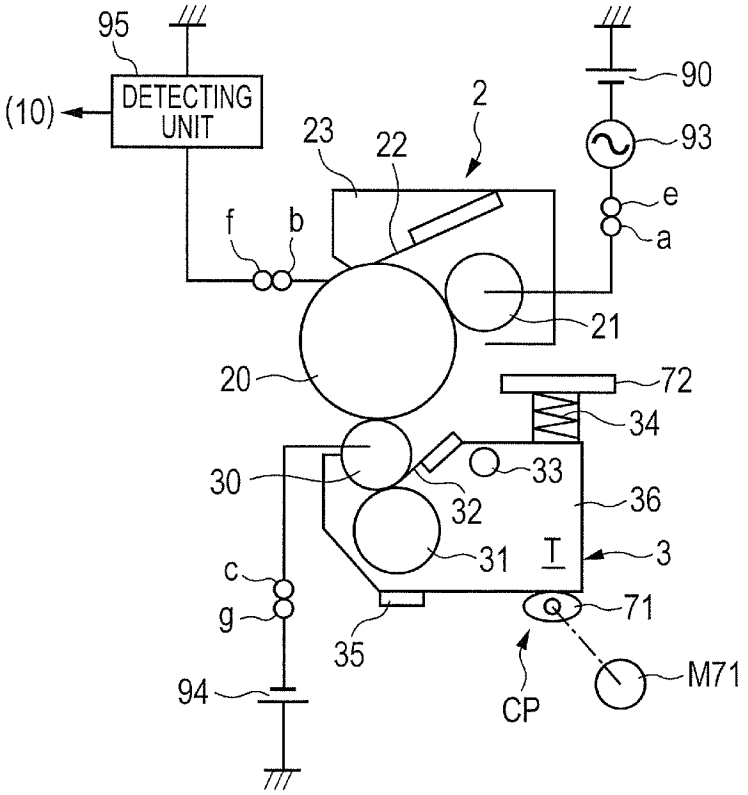
FIG. 10A is a schematic diagram of a contact state of the developing cartridge and its electrical connection.

FIG. 10A is a schematic diagram of the contact state in which the developer carrying member 30 is brought into contact with the photosensitive drum 20. FIG. 10B is a schematic diagram of the separation state in which the developer carrying member 30 is separated from the photosensitive drum 20 in a non-contact state.

When the photosensitive drum cartridge 2 is positioned and fixed at the mount portion 2A, the photosensitive drum 20 is connected to the ground via the capacitance detecting unit (current detecting unit) 95 through the connection of the electrical contacts "b" and "f". The charging member 21 is connected to the charging voltage applying unit 90 configured to apply a predetermined charging voltage and the detection voltage applying unit 93 through the connection of the electrical contacts "a" and "e". The detection voltage applying unit 93 includes the AC voltage applying unit 91 configured to apply an AC voltage.

In this embodiment, a voltage obtained by superimposing an AC voltage on a DC voltage was used as the charging voltage. In this embodiment, a charging voltage used for a new photosensitive drum cartridge was a voltage obtained by superimposing a sinewave AC voltage having a frequency of 2 kHz and an amplitude of 0.9 kV on a DC voltage of −500 V. However, this is not a limitation. The photosensitive drum may be charged with the use of another AC voltage or only a DC voltage.

The developing voltage applying unit 94 is connected to the developer carrying member 30 of the developing cartridge 3 mounted to the mount portion 3A through the connection of the electrical contacts "c" and "g". In this embodiment, the developing voltage applying unit 94 is connected to the developer carrying member 30 when the developing cartridge 3 assumes any one of the contact position and the separation position. However, it is sufficient that the developing voltage applying unit is connected to the developer carrying member 30 when the developing cartridge 3 assumes least at the contact position.

In the case where the photosensitive drum cartridge 2 and the developing cartridge 3 are not mounted to the mount portions 2A and 3A or not properly mounted to the mount portions 2A and 3A, respectively, the electrical contacts "b" and "f", "a" and "e", and "c" and "g" are not connected.

The capacitance detecting unit (detecting unit) 95 is configured to detect the capacitance between the charging member 21 and the photosensitive drum 20 by detecting an AC current amount which is induced in the photosensitive drum 20 when a predetermined detection voltage containing an AC component is applied to the charging member 21. This embodiment uses a circuit for outputting to the control unit 10 a detected voltage obtained by dropping a predetermined reference voltage V0 in accordance with the detected AC current amount.

Specifically, a larger amount of the AC current is induced in the photosensitive drum 20 as the capacitance between the charging member 21 and the photosensitive drum 20 becomes larger, and as a result, the detected voltage of the capacitance detecting unit 95 in this embodiment has a smaller value. The capacitance may be detected by applying a DC voltage to detect a DC current amount, rather than by applying the AC current to detect the AC current amount. In the case of the configuration of detecting the capacitance by applying a DC voltage to detect a DC current amount, it is necessary to provide a potential difference to a capacitor formed by the photosensitive drum 20 and the charging member 21 so as to detect the amount of an ultra-short current that flows when the capacitor with capacitance is charged.

Figure 11:
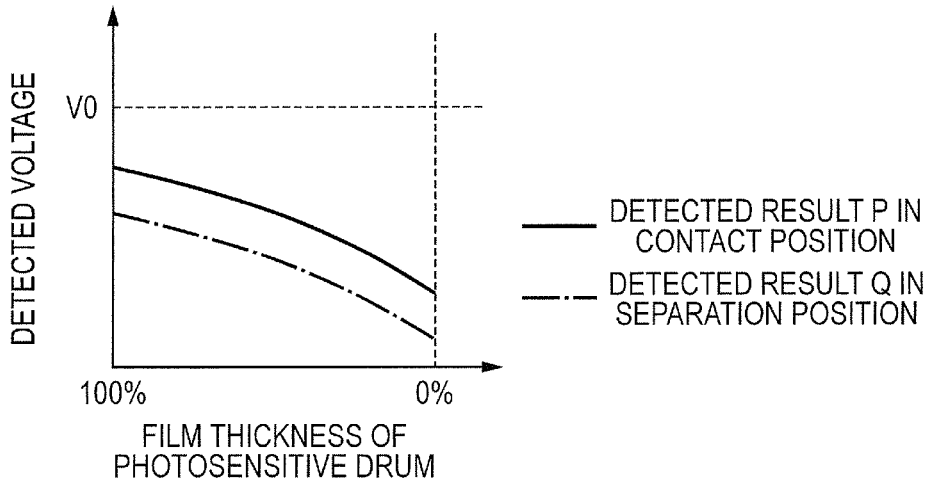
FIG. 11 is a schematic graph showing a relationship between the film thickness of a photosensitive drum and a detected result of the capacitance detecting unit.

FIG. 11 shows the relationship between the film thickness of the photosensitive drum 20 and the detected voltage of the capacitance detecting unit 95. The photosensitive drum cartridge 2 and the developing cartridge 3 were properly mounted to the respective mount portions 2A and 3A. The solid line represents a detected result P of the detected voltage of the capacitance detecting unit 95 with respect to the film thickness of the photosensitive drum, which was detected in the contact position. The dashed line represents a detected result Q of the detected voltage of the capacitance detecting unit with respect to the photosensitive drum film thickness, which was detected in the separation position. The applied detection voltage was a sinewave AC voltage having a frequency of 2 kHz and an amplitude of 0.9 kV. The use environments of the image forming apparatus 8 were a temperature of 23° C. and a humidity of 50% RH.

The film thickness of the photosensitive drum of a new photosensitive drum cartridge 2 is defined as 100%, and the film thickness of the photosensitive drum of a photosensitive drum cartridge at the end of the life is defined as 0%. V0 is a reference voltage.

As shown in FIG. 11, both the detected result P detected in the contact position and the detected result Q detected in the separation position indicate that the detected voltage of the capacitance detecting unit 95 decreases as the film thickness of the photosensitive drum becomes smaller. This is because the capacitance between the charging member 21 and the photosensitive drum 20 increases when the film thickness of the photosensitive drum is reduced through use. The detected result P detected in the contact position has a larger detected voltage than that of the detected result Q detected in the separation position. This is because the capacitance between the charging member 21 and the photosensitive drum becomes smaller in the contact state than in the separation state due to the capacitance of the developing cartridge 3.

Although the use environments of the image forming apparatus 8 were a temperature of 23° C. and a humidity of 50% RH, the same effects may be obtained in other use environments, though the magnitude of the detected result slightly differs.

In this embodiment, the charging voltage in the image formation is controlled by constant current control of an AC current in which the capacitance detecting unit 95 is used to control the AC voltage so that the amount of the AC current flowing through the charging member 21 and the photosensitive drum 20 may be constant irrespective of different film thicknesses of the photosensitive drum 20 and different use environments. This constant current control is effective because the wear of the photosensitive drum 20 may be suppressed.

Subsequently, a description is given of a method of determining whether or not the photosensitive drum cartridge 2 and the developing cartridge 3 are properly mounted to the respective mount portions 2A and 3A.

Figure 12A:
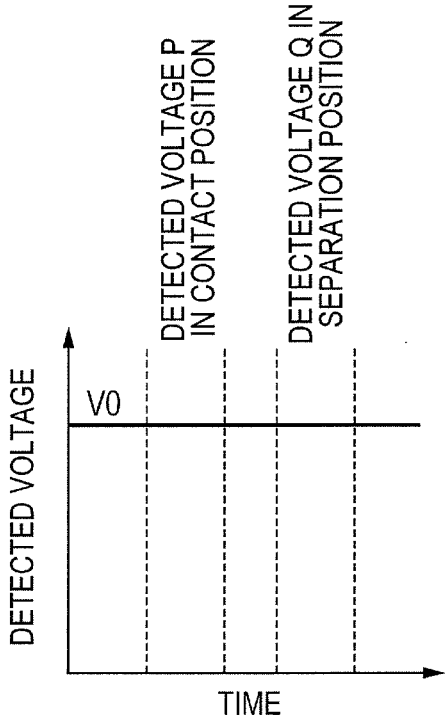
FIGS. 12A, 12B, and 12C are schematic graphs showing capacitance detected results in various mount states of the photosensitive drum cartridge and the developing cartridge.
Figure 12B:
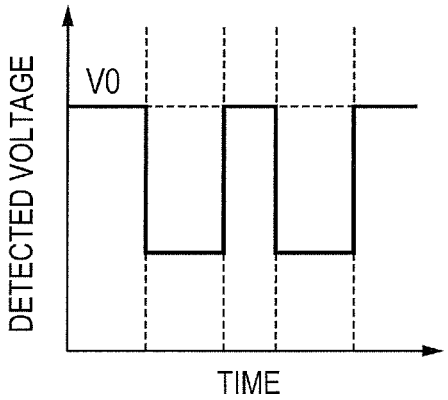
Figure 12C:
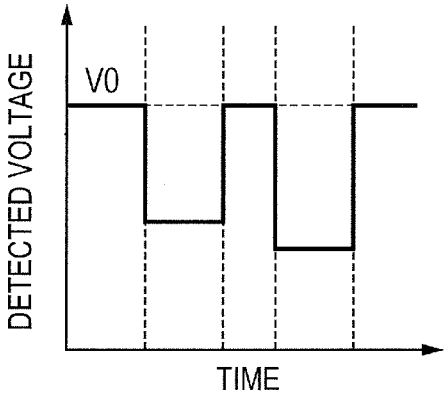

FIGS. 12A, 12B, and 12C show detected results of the capacitance detecting unit 95 when each of (both of) the photosensitive drum cartridge 2 and the developing cartridge 3 was mounted to the mount portion 2A or 3A. In this experiment, each of (both of) the photosensitive drum cartridge 2 and the developing cartridge 3 was mounted to the mount portion 2A or 3A. First, the contact-separation member 71 was driven and turned to the contact position (first position) CP. Then, a detection voltage containing an AC voltage was applied to the charging member 21, and a detected voltage P was detected by the capacitance detecting unit 95. After the detection of the detected voltage P, the detection voltage was turned OFF.

Subsequently, the contact-separation member 71 was driven and turned to the separation position (second position) SP. Then, the same detection voltage as the above-mentioned voltage applied in the case of the contact position CP was applied to the charging member 21, and a detected voltage Q was detected by the capacitance detecting unit 95. After the detection of the detected voltage Q, the detection voltage was turned OFF. In this experiment, the photosensitive drum cartridge 2 having a photosensitive drum film thickness of 50% was used, and the applied detection voltage was a sinewave AC voltage having a frequency of 2 kHz and an amplitude of 0.9 kV. The use environments of the image forming apparatus 8 were a temperature of 23° C. and a humidity of 50% RH.

FIG. 12A shows a detected result when neither the photosensitive drum cartridge 2 nor the developing cartridge 3 is mounted to the respective mount portions 2A and 3A and a detected result when the developing cartridge 3 is mounted to the mount portion 3A but the photosensitive drum cartridge 2 is not mounted to the mount portion 2A. The photosensitive drum cartridge 2 is not mounted, and hence the capacitance between the charging member 21 and the photosensitive drum 20 cannot be detected. Thus, the detected voltage P in the contact position CP and the detected voltage Q in the separation position SP both have a value substantially equal to the reference voltage V0.

FIG. 12B shows a detected result when the photosensitive drum cartridge 2 is mounted to the mount portion 2A but the developing cartridge 3 is not mounted to the mount portion 3A. The developing cartridge 3 is not mounted, and hence the developer carrying member 30 is separated from the photosensitive drum 20 in both the cases of the contact position CP and the separation position SP. Thus, the detected voltage P in the contact position CP and the detected voltage Q in the separation position SP both have a value substantially equal to the detected voltage Q of FIG. 11 measured when the photosensitive drum film thickness is 50%.

FIG. 12C shows a detected result when the photosensitive drum cartridge 2 and the developing cartridge 3 are both mounted to the respective mount portions 2A and 3A. The photosensitive drum cartridge 2 and the developing cartridge 3 are both mounted, and hence the photosensitive drum 20 and the developer carrying member 30 are brought into contact with each other by a predetermined pressure. Thus, the detected voltage P in the contact position CP has a value substantially equal to the detected voltage P of FIG. 11 measured when the photosensitive drum film thickness is 50%. In the case of the separation position SP, the photosensitive drum cartridge 2 and the developer carrying member 30 are not in contact with but separated from each other, and hence an apparent capacitance becomes larger than the capacitance in the case of the contact position CP.

Thus, the detected voltage Q in the separation position SP has a value smaller than the detected voltage P in the contact position CP. In other words, the detected voltage Q in the separation position SP has a value substantially equal to the detected voltage Q of FIG. 11 measured when the photosensitive drum film thickness is 50%.

In the above-mentioned experiment, the photosensitive drum cartridge 2 having a photosensitive drum film thickness of 50% was used. However, the same results are obtained even when a photosensitive drum cartridge 2 having another photosensitive drum film thickness is used.

In view of the results described above, the photosensitive drum 20 included in the photosensitive drum cartridge 2 and the developer carrying member 30 included in the developing cartridge 3 are configured to be in contact with and separated from each other. The capacitance detecting unit 95, which is connectable to the photosensitive drum cartridge 2, is used to detect the capacitance of the capacitor formed by the charging member and the photosensitive drum 20 when the contact-separation member 71 assumes the contact position CP and the separation position SP.

It is understood from the above that this configuration may discriminate at least the following three states (1) to (3) regardless of the use environments and the film thickness of the photosensitive drum:

(1) the state in which the photosensitive drum cartridge 2 (cartridge provided with capacitor) is not properly mounted;

(2) the state in which the photosensitive drum cartridge 2 is properly mounted but the developing cartridge 3 is not properly mounted; and (3) the state in which the developing cartridge 3 and the photosensitive drum cartridge 2 are both properly mounted.

In other words, at least the above-mentioned three states (1) to (3) relating to the mount states of the photosensitive drum cartridge 2 and the developing cartridge 3 with respect to the apparatus main body 8A may be discriminated by the capacitance detecting unit 95 alone.

Figure 13:
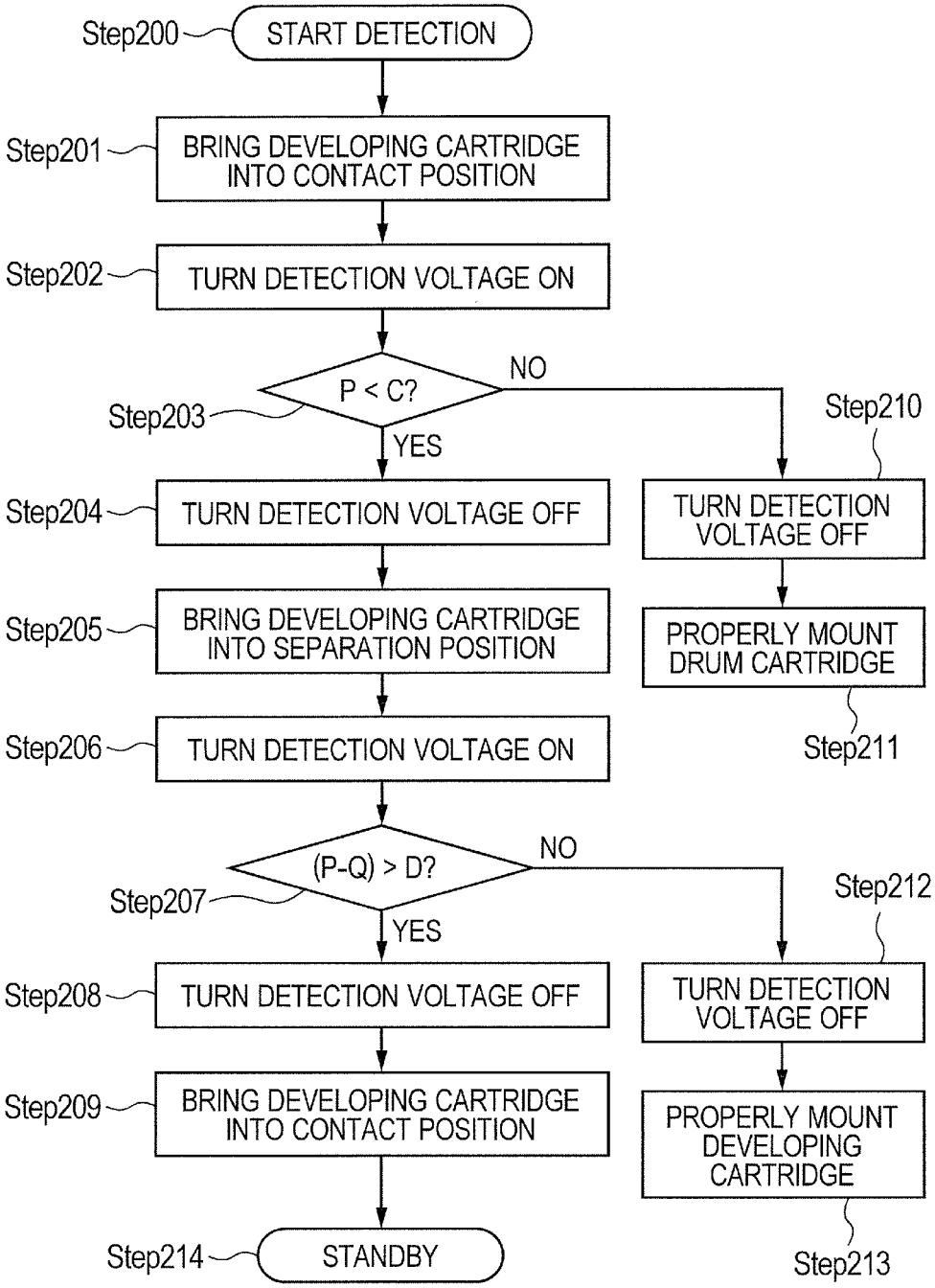
FIG. 13 is a sequence chart for detecting the mount states of the photosensitive drum cartridge and the developing cartridge.

FIG. 13 is a sequence chart for determining the mount states of the photosensitive drum cartridge 2 and the developing cartridge 3 to the apparatus main body 8A according to this embodiment. This sequence is executed by the control unit 10.

This sequence is started when the first and second doors 83 and 84 are closed to turn ON the first and second door switches SW1 and SW2 and when the main power switch is turned ON (Step 200). Alternatively, this sequence is started when the main power switch is turned ON and when the first and second doors 83 and 84 are both closed to turn ON the first and second door switches SW1 and SW2 (Step 200).

First, in Step 201, the control unit 10 turns the contact-separation member 71 to the contact position CP if the contact-separation member 71 assumes the separation position SP. Next, in Step 202, a detection voltage is applied, and a detected voltage (first result) P in the contact position is detected by the capacitance detecting unit 95. The DC voltage was not applied, and the applied detection voltage was a sinewave AC voltage having a frequency of 2 kHz and an amplitude of 0.9 kV. However, the detection voltage is not limited thereto as long as the capacitance between the charging member 21 and the photosensitive drum 20 may be detected as described above.

Subsequently, in Step 203, the detected voltage P is compared to a threshold C stored in the control unit 10 in advance. The threshold C is determined in advance as a value in the range expressed by Expression (3) below. In Expression (3), "Pmax" is a maximum value of the detected voltage P in the range of the photosensitive drum film thickness of 0% to 100% by taking into account of use environments and fluctuations in detected result.

$$P\max < C < V0 \qquad \text{Ex. (3)}$$

When the detected voltage P is equal to or larger than the threshold C, the sequence proceeds to Step 210, and the detection voltage is turned OFF. Then, in Step 211, the control unit 10 controls an indicator (display portion) of the apparatus operation portion 13 to display a message indicating that the photosensitive drum cartridge is not properly mounted, such as a message "Properly mount the photosensitive drum cartridge", to thereby notify the user. In this case, the user opens the first door 83, and mounts the unmounted photosensitive drum cartridge 2 or properly mounts the photosensitive drum cartridge 2 that has not been properly mounted. Then, the user closes the first door 83. The control unit 10 restarts this sequence (Step 200).

In Step 203, when the detected voltage P is smaller than the threshold C, the sequence proceeds to Step 204, and the detection voltage is turned OFF. After that, in Step 205, the contact-separation member 71 is driven to the separation position SP. Next, in Step 206, a detection voltage is applied, and a detected voltage Q in the separation position SP is detected by the capacitance detecting unit 95.

Subsequently, in Step 207, a difference (P−Q) between the detected voltage P and the detected voltage Q is compared to a threshold D stored in the control unit 10 in advance. The threshold D is determined in advance as a value in the range expressed by Expression (4) below. In Expression (4), "(P−Q)min" is a minimum value of the difference between the detected voltage P and the detected voltage Q in the range of the photosensitive drum film thickness of 0% to 100% by taking into account of use environments and fluctuations in detected result.

$$0 < D < (P-Q)\min \qquad \text{Ex. (4)}$$

When the difference (P−Q) between the detected voltage P and the detected voltage Q is equal to or smaller than the threshold D, the sequence proceeds to Step 212, and the detection voltage is turned OFF. Then, in Step 213, the control unit 10 controls the indicator of the apparatus operation portion 13 to display a message indicating that the developing cartridge is not properly mounted, such as a message "Properly mount the developing cartridge", to thereby notify the user. In this case, the user opens the second door 84, and mounts the unmounted developing cartridge 3 or properly mounts the developing cartridge 3 that has not been properly mounted. Then, the user closes the second door 84. The control unit 10 restarts this sequence (Step 200).

In Step 207, when the difference (P−Q) between the detected voltage P and the detected voltage Q is larger than the threshold D, the sequence proceeds to Step 208, and the detection voltage is turned OFF. After that, the sequence proceeds to Step 209, and the contact-separation member 71 is driven to the contact position CP. Then, in Step 214, the image forming apparatus 8 becomes the standby state for waiting for a print job. When receiving a print job in the standby state, the image forming apparatus 8 starts printing to form an image.

As exemplified by this sequence, it is preferred to determine the mount state of the developing cartridge 3 after determining the mount state of the photosensitive drum cartridge 2. This is because the mount state of the photosensitive drum cartridge 2 may be checked merely based on the detected voltage P in the contact state, which enables quick notification to the user that image formation cannot be executed because the cartridge is not properly mounted.

Although the difference (P−Q) is used to compare the detected voltage X and the detected voltage Y, another parameter such as a ratio therebetween may be used as long as the comparison is possible.

The other configurations and control are the same as in the first embodiment, and hence the same configurations are denoted by the same reference symbols and detailed description thereof is omitted.

In this embodiment, at least the following three states may be discriminated by the capacitance detecting unit 95 alone regardless of the use environments and the film thickness of the photosensitive drum:

(1) the state in which the photosensitive drum cartridge 2 is not properly mounted;

(2) the state in which the photosensitive drum cartridge 2 is properly mounted but the developing cartridge 3 is not properly mounted; and (3) the state in which the developing cartridge 3 and the photosensitive drum cartridge 2 are both properly mounted.

The image forming apparatus 8 according to this embodiment described above is summarized as follows. In the image forming apparatus 8, the photosensitive drum cartridge (first unit) 2 and the developing cartridge (second unit) 3 are mountable, and an image is formed on a recording medium. The image forming apparatus 8 includes the photosensitive drum (image bearing member) 20, which is retained in the photosensitive drum cartridge 2 and bears a developer image. The image forming apparatus 8 includes the charging member (first member) 21, which is retained in the photosensitive drum cartridge 2 and forms a capacitor by being paired with the photosensitive drum 20. The image forming apparatus 8 includes the developer carrying member (second member) 30, which is retained in the developing cartridge 3 and is provided to be contactable to the photosensitive drum 20.

The image forming apparatus 8 further includes the current detecting unit (detecting unit) 95 configured to detect a current flowing between the photosensitive drum 20 and the charging member 21. The image forming apparatus includes the contact-separation member 71, which is movable between the contact position (first position) CP for bringing the photosensitive drum 20 and the developer carrying member 30 into contact with each other and the separation position (second position) SP for separating the photosensitive drum 20 and the developer carrying member 30 from each other.

The value of the current detecting unit 95 detected when a voltage is applied to the charging member 21 with the contact-separation member 71 being located at the contact position CP is referred to as "first detected result". The value of the current detecting unit 95 detected when a voltage is applied to the charging member 21 with the contact-separation member 71 being located at the separation position SP is referred to as "second detected result". Then, the image forming apparatus 8 includes the control unit (control portion) 10, which is configured to transmit an information signal relating to the mount states of the developing cartridge 3 and the photosensitive drum cartridge 2 based on the first detected result and the second detected result.

The control unit (control portion) 10 is configured to transmit an information signal relating to the following three states:

(1) the state in which the photosensitive drum cartridge 2 is not mounted to the apparatus main body 8A;

(2) the state in which the photosensitive drum cartridge 2 is mounted to the apparatus main body 8A but the developing cartridge 3 is not mounted; and (3) the state in which the photosensitive drum cartridge 2 and the developing cartridge 3 are mounted to the apparatus main body 8A.

When it is determined from the first result that the photosensitive drum cartridge 2 is not mounted, the control unit (control portion) 10 transmits the information signal relating to the state in which the photosensitive drum cartridge 2 is not mounted, without obtaining the second result.

The above-mentioned apparatus configuration may detect the mount states of the two cartridges without using two detecting units. Thus, a more inexpensive image forming apparatus and a more compact image forming apparatus may be provided. Further, in the image forming apparatus which is configured to perform charging control by detecting the capacitance, such as constant current control, the mount states of the developing cartridge and the photosensitive drum cartridge may be determined without adding an additional member.

As described in this embodiment, the present invention may be carried out also in the configuration in which the photosensitive drum 20 and the developer carrying member 30 are configured to be in contact with and separated from each other, and the capacitance between the photosensitive drum 20 and the conductive member included in the photosensitive drum cartridge 20 is detected.

Fifth Embodiment

A fifth embodiment of the present invention is now described below. In this embodiment, the first unit is the photosensitive drum cartridge 2, the second unit is the developing cartridge 3, the first member is the charging member 21, the second member is the developer carrying member 30, the first position is the contact position CP, and the second position is the separation position SP.

Figure 14B:
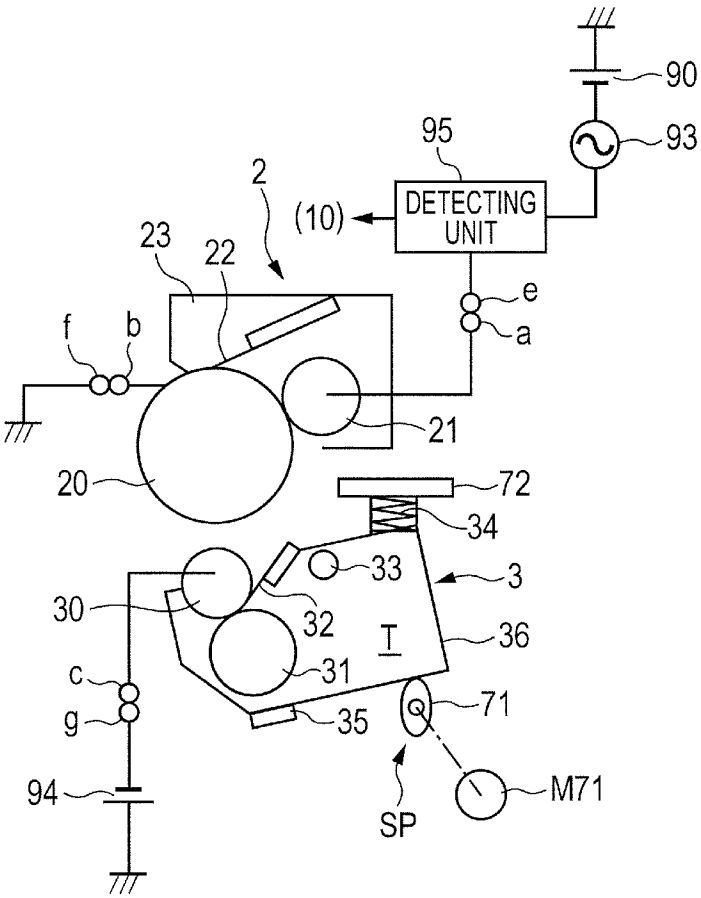
FIG. 14B is a schematic diagram of a separation state of the developing cartridge and its electrical connection according to a fifth embodiment of the present invention.
Figure 14A:
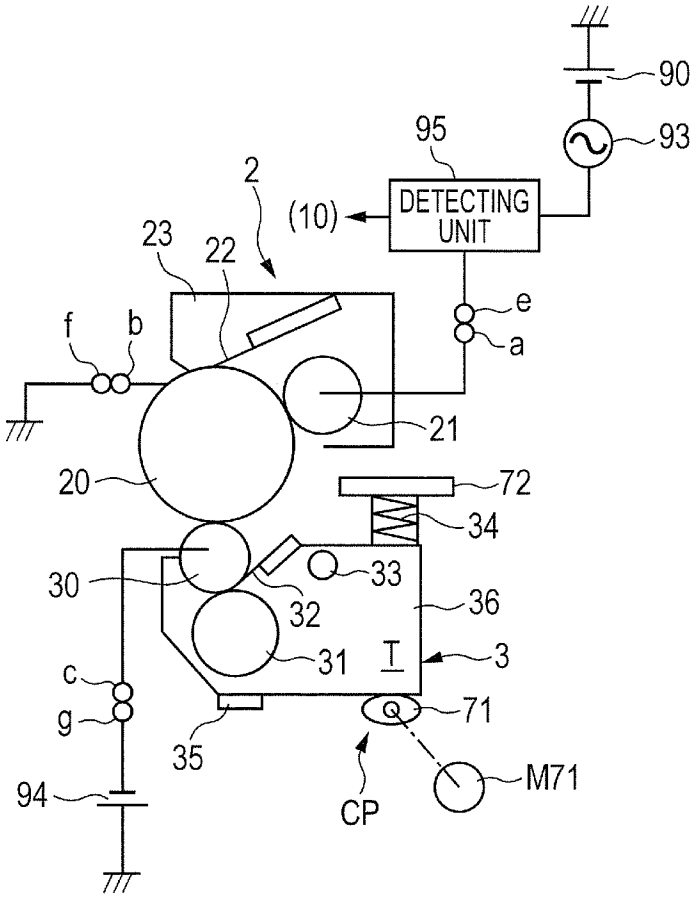
FIG. 14A is a schematic diagram of a contact state of the developing cartridge and its electrical connection.

FIG. 14A is a schematic diagram of the contact state in which the developer carrying member 30 is brought into contact with the photosensitive drum 20. FIG. 14B is a schematic diagram of the separation state in which the developer carrying member 30 is separated from the photosensitive drum 20 in a non-contact state.

When the photosensitive drum cartridge 2 is positioned and fixed at the mount portion 2A of the apparatus main body 8A, the photosensitive drum 20 is connected to the ground through the connection of the electrical contacts "b" and "f". The charging member 21 is connected to the charging voltage applying unit 90 configured to apply a predetermined charging voltage and the detection voltage applying unit 93 via the capacitance detecting unit 95 through the connection of the electrical contacts "a" and "e". The detection voltage applying unit 93 includes the AC voltage applying unit 91 configured to apply an AC voltage. In this embodiment, a voltage obtained by superimposing an AC voltage on a DC voltage was used as the charging voltage.

The developing voltage applying unit 94 is connected to the developer carrying member 30 mounted to the mount portion 3A of the apparatus main body 8A through the connection of the electrical contacts "c" and "g". In this embodiment, the developing voltage applying unit 94 is connected to the developer carrying member 30 when the developing cartridge 3 assumes any one of the contact position and the separation position. However, it is sufficient that the developing voltage applying unit is connected to the developer carrying member 30 when the developing cartridge 3 assumes at least the contact position.

In the case where the photosensitive drum cartridge 2 and the developing cartridge 3 are not mounted to the apparatus main body 8A or not properly mounted to the apparatus main body 8A, respectively, the electrical contacts "b" and "f", "a" and "e", and "c" and "g" are not connected.

The other configurations and control are the same as in the fourth embodiment, and hence the same configurations are denoted by the same reference symbols and detailed description thereof is omitted.

Also in this embodiment, the same three mount states as those (1) to (3) of the fourth embodiment may be discriminated by the capacitance detecting unit 95 alone. Therefore, the mount states of two cartridges may be detected without using two detecting units. Thus, a more inexpensive image forming apparatus and a more compact image forming apparatus may be provided. Further, in the image forming apparatus which is configured to control charging by detecting the capacitance by constant current control, the mount states of the developing cartridge and the photosensitive drum cartridge may be determined without adding an additional member.

Even when the capacitance detecting unit 95 as the current detecting unit is not provided on the ground side of the photosensitive drum 20, the present invention may be carried out as long as the capacitance detecting unit 95 may detect the current amount of the detection voltage applying unit 93 as described in this embodiment.

Sixth Embodiment

A sixth embodiment of the present invention is now described below. In this embodiment, the first unit is the photosensitive drum cartridge 2, the second unit is the developing cartridge 3, the first member is the cleaning device 22, the second member is the developer carrying member 30, the first position is the contact position CP, and the second position is the separation position SP.

Figure 15B:
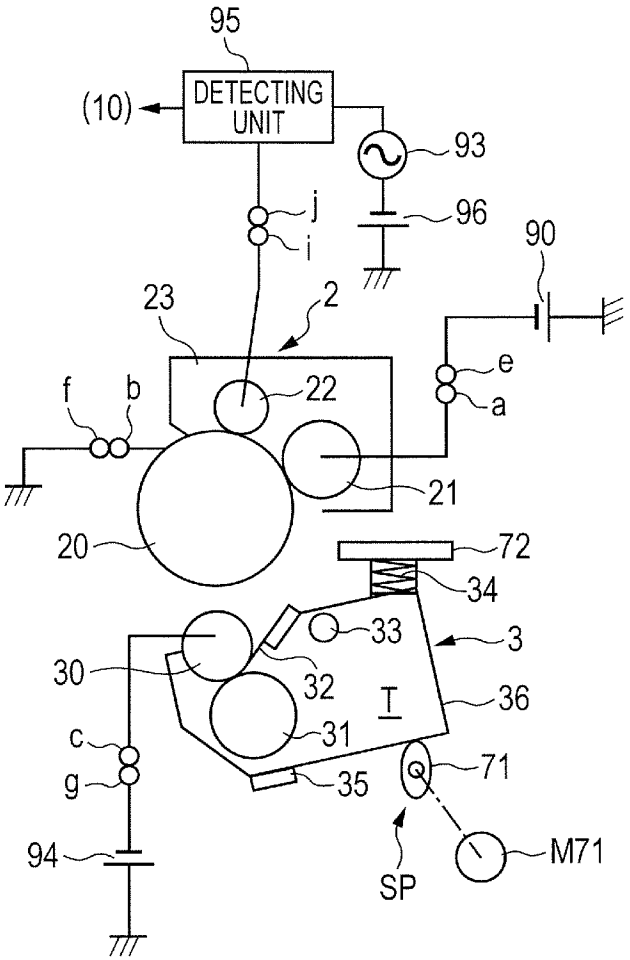
FIG. 15B is a schematic diagram of a separation state of the developing cartridge and its electrical connection according to a sixth embodiment of the present invention.
Figure 15A:
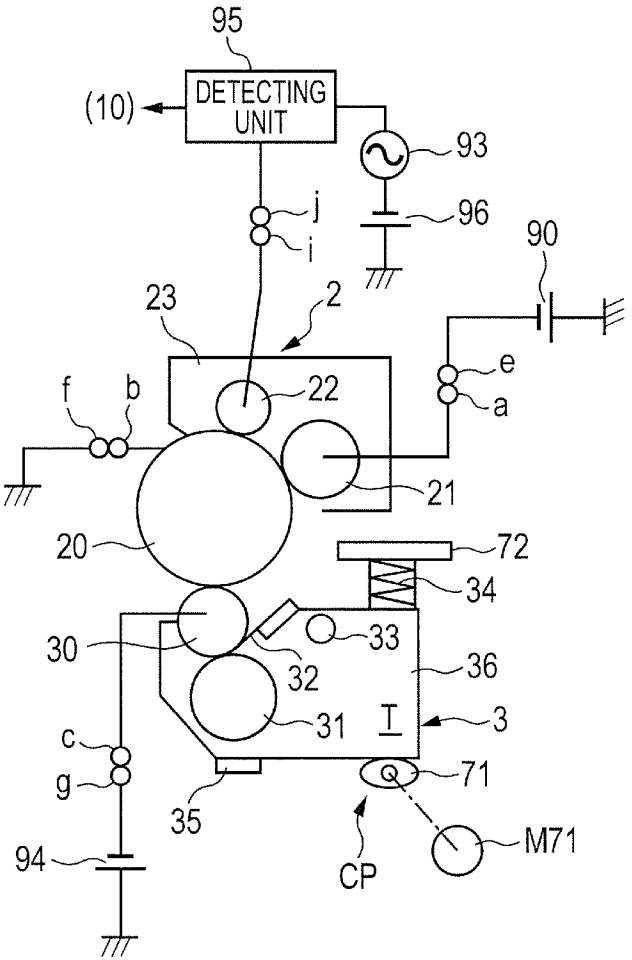
FIG. 15A is a schematic diagram of a contact state of the developing cartridge and its electrical connection.

FIG. 15A is a schematic diagram of the contact state in which the developer carrying member 30 is brought into contact with the photosensitive drum 20. FIG. 15B is a schematic diagram of the separation state in which the developer carrying member 30 is separated from the photosensitive drum 20 in a non-contact state.

In this embodiment, the cleaning device 22 uses a cleaning roller made of a conductive support having an elastic member formed thereon.

When the photosensitive drum cartridge 2 is positioned and fixed at the mount portion 2A, the photosensitive drum 20 is connected to the ground through the connection of the electrical contacts "b" and "f". The charging member 21 is connected to the charging voltage applying unit 90 through the electrical contacts "a" and "e". The cleaning device 22 is connected to cleaning voltage applying unit 96 configured to apply a predetermined cleaning voltage and the detection voltage applying unit 93 via the capacitance detecting unit (current detecting unit) 95 through the connection of the electrical contacts "i" and "j". The detection voltage applying unit 93 includes the AC voltage applying unit 91 configured to apply an AC voltage.

In this embodiment, as the cleaning voltage in the image formation, only a DC voltage of +100V was applied, and as the detection voltage, a sinewave AC voltage having a frequency of 2 kHz and an amplitude of 0.9 kV was applied without applying a DC voltage. However, the detection voltage is not limited thereto. Any voltage may be applied as long as the capacitance between the cleaning device 22 and the photosensitive drum 20 may be detected.

The developing voltage applying unit 94 is connected to the developer carrying member 30 of the developing cartridge 3 mounted to the mount portion 3A through the connection of the electrical contacts "c" and "g". In this embodiment, the developing voltage applying unit 94 is connected to the developer carrying member 30 when the developing cartridge 3 assumes any one of the contact position and the separation position. However, it is sufficient that the developing voltage applying unit is connected to the developer carrying member 30 when the developing cartridge 3 assumes at least the contact position.

In the case where the photosensitive drum cartridge 2 and the developing cartridge 3 are not mounted to the image forming apparatus 8 or not properly mounted to the predetermined positions, respectively, the electrical contacts "b" and "f", "a" and "e", "i" and "j", and "c" and "g" are not connected.

The other configurations and control are the same as in the fourth embodiment, and hence the same configurations are denoted by the same reference symbols and detailed description thereof is omitted.

Also in this embodiment, the same three mount states as those (1) to (3) of the fourth embodiment may be discriminated by the capacitance detecting unit 95 alone. Therefore, the mount states of two cartridges may be detected without using two detecting units. Thus, a more inexpensive image forming apparatus and a more compact image forming apparatus may be provided. The present invention may be carried out as long as the member which is paired with the photosensitive drum 20 to form a capacitor is a cleaning member included in the photosensitive drum cartridge 2 as in this embodiment.

As described above, the photosensitive drum 20 and the developer carrying member 30 are configured to be in contact with and separated from each other, and the photosensitive drum cartridge 2 including the photosensitive drum 20 and the developing cartridge 3 including the developer carrying member 30 are constituted as separate units. In this case, the present invention may be carried out by the configuration of detecting the capacitance between the developer carrying member 30 and the conductive member included in the developing cartridge 3. Alternatively, the present invention may be carried out by the configuration of detecting the capacitance between the photosensitive drum 20 and the conductive member included in the photosensitive drum cartridge 2.

The conductive member may be disposed in the developing container or the cleaning container. For example, the present invention may be carried out by the configuration in which a member such as a plate antenna, which is a metal antenna configured to detect the remaining amount of toner, is disposed in the developing container, and the capacitance between the developer carrying member and the plate antenna is detected.

(Other Matters Relating to First to Sixth Embodiments)

(1) The developing cartridge 3 mounted to the mount portion 3A of the apparatus main body 8A may be controlled to standby normally at the separation position as a home position, be moved to the contact position at the time of image formation, and be returned to the separation position at the time of non-image formation. Alternatively, the developing cartridge 3 may be controlled to be located normally at the contact position.

(2) For detecting the mount of the cartridge provided with the capacitor (Step 103), the first detected result is compared in magnitude to the threshold (first predetermined value). Alternatively, however, the second detected result may be compared in magnitude to the threshold. Specifically, in this case, when the mount of the cartridge is to be detected, the contact-separation member 71 is disposed at the separation position (second position) SP.

(3) The image forming apparatus is not limited to an electrophotographic image forming apparatus described in the embodiments of the present invention. The present invention is also applicable to an electrostatic recording image forming apparatus or a magnetic recording image forming apparatus using a dielectric for electrostatic recording or a magnetic material for magnetic recording as an image bearing member.

(Effects of First to Sixth Embodiments)

The effects of the above-mentioned first to sixth embodiments are summarized as follows. In each embodiment, a plurality of cartridges, the photosensitive drum cartridge 2

(image bearing member cartridge) and the developing cartridge 3, are removably mountable to the apparatus main body of the image forming apparatus. In this case, it is necessary to detect the mount state of each cartridge in order to determine whether or not the image forming apparatus 8 is ready for image formation. To deal with this, in the embodiments of the present invention, the capacitor is provided in any one of the photosensitive drum cartridge 2 and the developing cartridge 3. The value relating to the capacitance of the capacitor is detected both when the contact-separation member 71 assumes the position (first position) CP for bringing the photosensitive drum 20 (image bearing member) and the developer carrying member 30 into contact with each other and when the contact-separation member 71 assumes the position (second position) SP for separating the photosensitive drum 20 and the developer carrying member 30 from each other. The detected results in those two situations (detected voltage X and detected voltage Y) are used to detect the mount state of each cartridge. Specifically, the following three states may be discriminated:

(1) the state in which one of the two cartridges of the photosensitive drum cartridge 2 and the developing cartridge 3 which is provided with the capacitor is not mounted (first state);

(2) the state in which one of the two cartridges provided with the capacitor is mounted but the other cartridge (cartridge without capacitor) is not mounted (second state); and (3) the state in which the cartridge provided with the capacitor and the cartridge without any capacitor are both mounted (third state).

That is, the mount state of a plurality of cartridges may be grasped only with the use of a simple structure in which the capacitor is provided to one cartridge. In other words, detailed information on whether or not the image forming apparatus is ready for image formation may be obtained by a simple structure. Note that, the state in which the cartridge is mounted refers to the state in which the cartridge is located in the apparatus main body of the image forming apparatus at the position and posture at which image formation is possible. On the other hand, the state in which the cartridge is not mounted refers to not only the state in which the cartridge is removed from the apparatus main body of the image forming apparatus but also the state in which the cartridge is located in the apparatus main body but is not located at the position and posture at which image formation is possible.

The value detected by the capacitance detecting unit 95 (detecting unit) when the contact-separation member 71 assumes the first position is used as the first detected result. The value detected by the detecting unit 95 when the contact-separation member 71 assumes the second position is used as the second detected result. Then, the above-mentioned three states are discriminated as follows.

Based on the magnitude correlation between the first detected result or the second detected result and a first predetermined value, it is determined whether or not the cartridge provided with the capacitor is mounted. For example, in the first embodiment, the apparatus state is determined to be the first state (1) when the maximum value Xmax of the detected voltage X (first detected result) is equal to or larger than the threshold A (first predetermined value). When the maximum value Xmax of the detected voltage X is smaller than the threshold A, on the other hand, the apparatus state is determined to be the second or third state (2) or (3).

In the case where the apparatus state is determined to be the state (2) or (3), it is further determined whether the apparatus state is the state (2) or (3) by comparing the first detected result and the second detected result. In the first embodiment, it is determined whether the apparatus state is the state (2) or (3) by calculating a difference between the first detected result and the second detected result and based on the magnitude correlation between the difference and a second predetermine value. For example, in the first embodiment, it is determined that the image forming apparatus is in the state (2) and is not ready for image formation when the minimum value (X−Y)min of the difference "X-Y" between the detected voltage X and the detected voltage Y is equal to or smaller than the threshold B (second predetermine value), that is, when the minimum value "(X−Y)min" falls within the range satisfying "(X−Y)min≤B". When the difference (X−Y) min is larger than the threshold B, on the other hand, it is determined that the image forming apparatus is in the state (3) and is ready for image formation. In comparing the first detected result and the second detected result, it is not always necessary to calculate the difference between those detected results. For example, the magnitude correlation between the ratio of the detected results and a threshold may be used for comparison.

Seventh Embodiment

Another embodiment of the present invention is now described below. In each of the above-mentioned embodiments, the image bearing member (photosensitive drum 20) and the developer carrying member 30 are provided in different cartridges (photosensitive drum cartridge 2 and developing cartridge 3) to be mounted to the apparatus main body of the image forming apparatus. Contrary, in the following embodiments, the image bearing member, the developer carrying member, and the capacitor are provided in the same process cartridge (cartridge CR), and this process cartridge is removably mountable to the apparatus main body. The image forming apparatus in this embodiment may detect the mount state of the process cartridge. In the case where the process cartridge is mounted to the apparatus main body, the image forming apparatus further detects whether or not the image bearing member and the developer carrying member are switchable between the contact state and the separation state.

(1) Overall Outline of Exemplary Image Forming Apparatus

Figure 16:
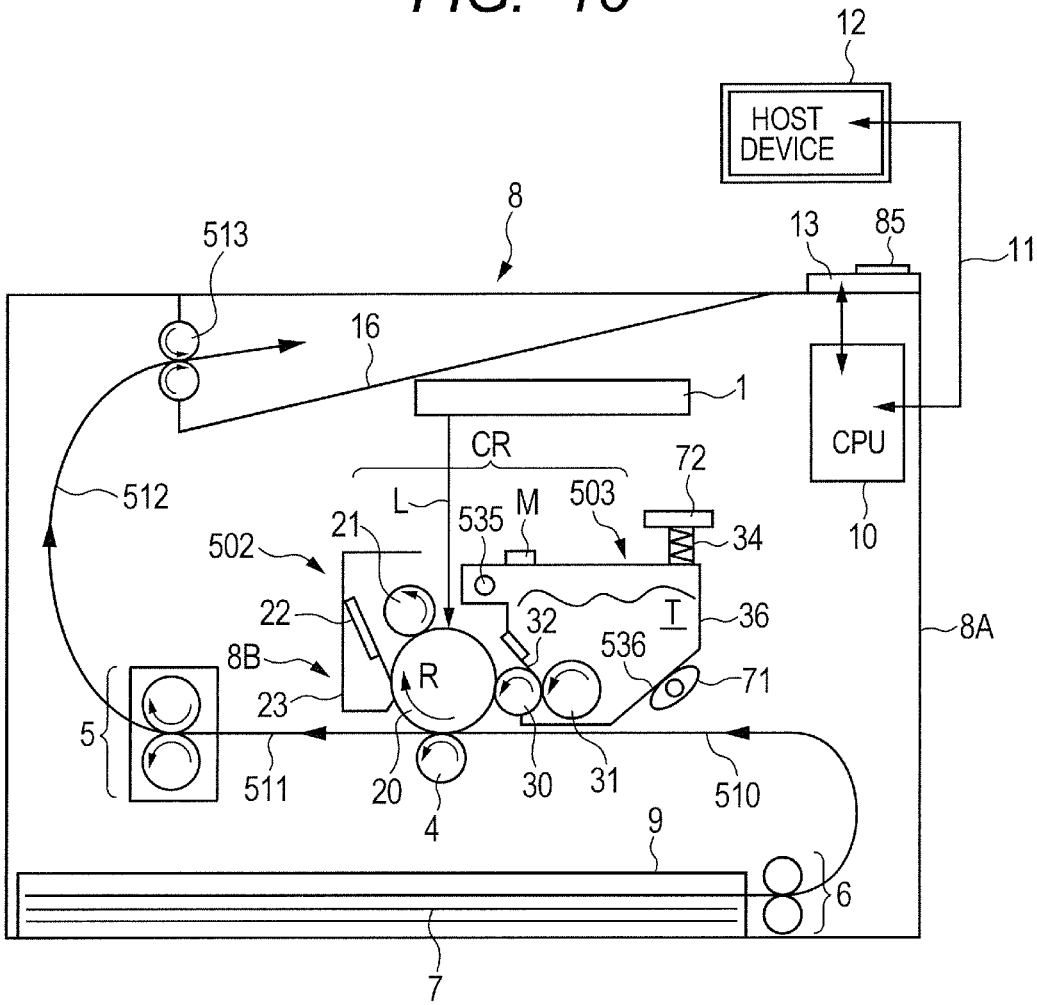
FIG. 16 is a schematic configuration diagram of an image forming apparatus according to a seventh embodiment of the present invention.

FIG. 16 is a schematic configuration diagram of an image forming apparatus 8 according to another embodiment of the present invention. The image forming apparatus 8 in this embodiment is an electrophotographic image forming apparatus that forms an image on a transfer material (recording medium) 7 by executing a series of image forming process of charging, exposure, development, transfer, and cleaning on the photosensitive drum 20 as a rotatable image bearing member.

Specifically, the image forming apparatus 8 is configured to output an image-formed product by forming, on the transfer material 7, an image corresponding to image data (electrical image information) which is input from a host device 12 connected to a control unit (control portion: CPU) 10 via an interface 11. The transfer material 7 is plain paper, glossy paper, a resin sheet, a postcard, an envelope, or the like.

The control unit 10 is a control portion (control unit) configured to control the overall operation of the image forming apparatus 8, and transmits and receives various kinds of electrical information signals to and from the host device 12 and an apparatus operation portion (control panel) 13. The control unit 10 further performs processing of electrical information signals input from various kinds of process devices and sensors, processing of command signals for the various kinds of process devices, predetermined initial sequence control, and predetermined image forming sequence control. The host device 12 is a personal computer, a network, an image reader, a facsimile machine, or the like. The apparatus operation portion 13 is provided with a main power switch, various kinds of operation keys, an indicator 85, and the like.

The photosensitive drum 20 is rotationally driven at a predetermined circumferential speed (process speed) in the clockwise direction indicated by the arrow R. Around the photosensitive drum 20, there are arranged image forming process units including a charging member 21, an exposure device 1, the developer carrying member 30, a transfer device 4, and a cleaning device 22 in this order along the rotation direction of the photosensitive drum 20.

In this embodiment, the photosensitive drum 20 uses a conductive cylinder such as aluminum having an undercoat layer, a carrier generation layer, and a carrier transport layer formed thereon. The charging member 21 uses a charging roller that comes into contact with the photosensitive drum 20 to be driven by the photosensitive drum 20. The charging member 21 is a conductive support having a semiconductive elastic member formed thereon. The charging member 21 is applied with a predetermined charging voltage, and charges the photosensitive drum 20 uniformly at a predetermined potential with a predetermined polarity.

The surface of the photosensitive drum 20 uniformly charged by the charging member 21 is subjected to image exposure by the exposure device 1. In this embodiment, the exposure device 1 is a laser scanning exposure device, and includes a laser, a polygon mirror, and a lens system. The exposure device 1 outputs a laser light L that has been modulated in accordance with an image signal (image data) to expose the surface of the photosensitive drum 20 in a main scanning direction. In this way, an electrostatic latent image corresponding to a scanning exposure pattern is formed on the surface of the photosensitive drum 20.

The electrostatic latent image formed on the photosensitive drum surface is developed (visualized) into a developer image (toner image) by the rotatable developer carrying member 30. The developer carrying member 30 is a member configured to carry a developer for developing the electrostatic latent image formed on the surface of the photosensitive drum 20 and applies the developer to the photosensitive drum 20. In this embodiment, the developer carrying member 30 uses a developing roller that comes into contact with the photosensitive drum 20 to be rotationally driven in the counterclockwise direction indicated by the arrow along the forward direction of the rotation of the photosensitive drum 20 at a predetermined circumferential speed ratio.

The developer carrying member 30 is a conductive metal support having a semiconductive elastic member such as urethane rubber formed thereon, and carries and conveys toner T as a developer. The developer carrying member 30 is applied with a predetermined developing voltage, and develops the electrostatic latent image with the toner T. The toner T uses non-magnetic single component toner.

A rotatable developer feeding member 31 is disposed in contact with the developer carrying member 30. In this embodiment, the developer feeding member 31 is an elastic sponge roller made of a conductive metal support having a semiconductor elastic member such as foamed urethane formed on its surface. The developer feeding member 31 is disposed side by side with the developer carrying member 30, and comes into contact with the developer carrying member 30 to be rotationally driven in the counter direction to the rotation direction of the developer carrying member 30 at a predetermined circumferential speed ratio in the contact portion with the developer carrying member 30. In this way, the toner T is applied as a thin layer from the developer feeding member onto the surface of the rotating developer carrying member 30.

A developer layer thickness regulating member 32 is disposed in contact with the developer carrying member 30 on the downstream side of the developer feeding member 31 in the rotation direction of the developer carrying member 30. In this embodiment, the developer layer thickness regulating member 32 is a conductive elastic blade, and comes into contact with the developer carrying member 30 by a predetermined pressure to regulate the layer thickness of the toner T that has been applied onto the developer carrying member 30 by the developer feeding member 31. In this embodiment, the elastic blade uses a SUS thin plate having a thin elastomer member formed thereon.

The toner T is applied onto the rotating developer carrying member 30 from the developer feeding member 31 in the contact portion with the developer feeding member 31, and the layer thickness of the applied toner is regulated by the developer layer thickness regulating member 32. The toner is charged with a predetermined polarity by friction. The toner layer having the regulated layer thickness is conveyed by the subsequent rotation of the developer carrying member 30 to a developing position which is the contact portion between the photosensitive drum 20 and the developer carrying member 30. Then, the toner of the toner layer on the developer carrying member 30 side is selectively transferred onto the surface of the photosensitive drum 20 in accordance with the pattern of the electrostatic latent image. In this way, the electrostatic latent image is developed into a toner image.

The toner on the developer carrying member 30 which has not been used for developing the electrostatic latent image is conveyed and returned by the subsequent rotation of the developer carrying member 30 to the contact portion between the developer carrying member 30 and the developer feeding member 31, and is scraped off from the developer carrying member 30 by the developer feeding member 31. Together with the scraping-off of the toner by the return conveyance, the toner T is applied onto the surface of the developer carrying member 30 by the developer feeding member 31. The above-mentioned operation is repeated to execute the development of the electrostatic latent image formed on the surface of the photosensitive drum 20.

The transfer device 4 is a device that transfers the toner image formed on the photosensitive drum 20 onto the transfer material 7. In this embodiment, the transfer device 4 is a rotatable transfer roller made of a conductive support having a semiconductive elastic member formed thereon, and is disposed side by side with the photosensitive drum 20 and comes into contact with the photosensitive drum 20 to form a transfer nip portion. The transfer device 4 is rotationally driven in the forward direction of the rotation of the photosensitive drum 20 at a circumferential speed substantially corresponding to the rotary circumferential speed of the photosensitive drum 20.

The transfer materials 7 that are stacked and contained in a feed cassette 9 are individually fed in a separate manner by the operation of a feed mechanism (not shown) including a feed roller 6 at a predetermined control timing. The transfer material 7 is introduced to the transfer nip portion along a sheet path 510, and is conveyed while being nipped by the transfer nip portion. The transfer device 4 is applied with a predetermined transfer voltage when the transfer material 7 is being conveyed while being nipped by the transfer nip portion. In this way, the toner image formed on the photosensitive drum 20 is electrostatically transferred onto the transfer material 7 sequentially.

The transfer material 7 after passing the transfer nip portion is separated from the surface of the photosensitive drum 20 and is conveyed to a fixing device 5 along a sheet path 511. The fixing device 5 fixes an unfixed toner image onto the transfer material 7 as a fixed image, and then the transfer material 7 is discharged, as an image-formed product, by a discharge roller 513 along a sheet path 512 to a discharge tray 16 provided outside the apparatus.

The surface of the photosensitive drum 20 after the separation of the transfer material is cleaned by removing a residue such as a transfer residual developer by the cleaning device 22, and is used for image formation repeatedly. In this embodiment, the cleaning device 22 is a blade cleaning device that uses a cleaning blade made of an elastic blade. The cleaning blade is disposed so that a distal edge portion thereof may be brought into counter contact with the surface of the rotating photosensitive drum 20. The residue on the photosensitive drum surface is wiped off by the cleaning blade.

(2) Process Cartridge

The members constituting the image forming apparatus are consumed through repeated use. The photosensitive drum 20 and the toner T are consumable members with particularly high consumption frequency. The image forming apparatus 8 in this embodiment has a process cartridge structure so that a consumed member may be easily removed and replaced from the image forming apparatus. A process cartridge (hereinafter referred to as cartridge) CR is mountable (removably mountable) to a predetermined mount portion 8B in an apparatus main body (image forming apparatus main body) 8A of the image forming apparatus 8 in a predetermined manner. The cartridge CR in this embodiment integrates a charging/cleaning device 502 and a developing device 503 into a unit.

In the charging/cleaning device 502 in this embodiment, the photosensitive drum 20 as an image bearing member, the charging member 21, and the cleaning device 22 are incorporated in a cleaning container (cleaning frame) 23. The photosensitive drum 20 and the charging member 21 are rotatably supported by bearings on the cleaning container 23. The cleaning device 22 is fixedly supported on the cleaning container 23.

In the developing device 503, the developer carrying member 30, the developer feeding member 31, the developer layer thickness regulating member 32, a development pressure member (a compression spring being an elastic member (bias member)) 34, and a storage unit (memory) M are incorporated in a developing frame (developing container) 36. The developer carrying member 30 and the developer feeding member 31 are rotatably supported by bearings on the developing frame 36. The developer layer thickness regulating member 32, a development pressure member 34, and the storage unit M are fixedly supported on the developing frame 36. The developing frame 36 as a developing container contains the toner T as a developer (dry developer).

The developing frame 36 is coupled to the cleaning container 23 so as to be swingable about a swing center portion 535. In this way, the charging/cleaning device 502 and the developing device 503 are coupled together to form the cartridge CR.

In the state in which the cartridge CR is mounted to the mount portion 8B in the apparatus main body 8A in a predetermined manner, the cleaning container 23 of the charging/cleaning device 502 is positioned and fixed at a positioning portion (not shown) of the apparatus main body 8A by being pressed by a pressing mechanism (not shown). In other words, the charging/cleaning device 502 is positioned and fixed at the positioning portion of the apparatus main body 8A.

In the state in which the charging/cleaning device 502 is positioned and fixed, the photosensitive drum 20 is in contact with the transfer device 4 of the apparatus main body 8A with a predetermined pressing force. In the image forming operation, power is transmitted from a drive output portion (not shown) of the apparatus main body 8A to a drive input portion (not shown) of the charging/cleaning device 502, thereby rotationally driving the photosensitive drum 20.

Electrical contacts "a" and "b" (FIGS. 17A and 17B) of the charging/cleaning device 502 are electrically connected to electrical contacts "e" and "f" of the apparatus main body 8A, respectively. In this way, a predetermined charging voltage may be applied from charging voltage applying unit 90 of the apparatus main body 8A to the charging member 21 of the charging/cleaning device 502. Although a DC voltage is used as the charging voltage in this embodiment, this is not a limitation. A charging voltage obtained by superimposing an AC voltage on a DC voltage may be used instead. The conductive cylinder of the photosensitive drum 20 is connected to the ground.

When the cartridge CR is not mounted to the mount portion 8B or not properly mounted to the mount portion 8B, the electrical contacts "a" and "b" of the charging/cleaning device 502 are not connected to the electrical contacts "e" and "f" of the apparatus main body 8A.

In the state in which the cartridge CR is mounted to the mount portion 8B in a predetermined manner, the development pressure member 34 of the developing device 503 is received by a force receiving portion 72 of the apparatus main body 8A. A contact-separation member 71 of the apparatus main body 8A corresponds to a force receiving portion 536 of the developing device 503.

Electrical contacts "c" and "d" of the developing device 503 are electrically connected to electrical contacts "g" and "h" of the apparatus main body 8A. In this way, developing voltage applying unit 94 and capacitance detecting unit 95 of the apparatus main body 8A are connected to the developer carrying member 30 of the developing device 503, and a predetermined DC voltage as a developing voltage may be applied from the developing voltage applying unit 94 to the developer carrying member 30. In addition, a predetermined detection voltage may be applied from detection voltage applying unit 93 to the developer feeding member 31 of the developing device 503.

The detection voltage applying unit 93 includes at least AC voltage applying unit 91 configured to apply an AC voltage. In this embodiment, the detection voltage applying unit 93 includes DC voltage applying unit 92 configured to apply a DC voltage and the AC voltage applying unit 91.

The developing device 503 is pivotable about the swing center portion 535 by rotation operation of a cam being the contact-separation member 71 of the apparatus main body 8A. This pivot operation enables the developing device 503 to move (pivot) to two positions, a contact position of FIG. 17A and a separation position of FIG. 17B.

The contact position is a developing device movement position at which the developer carrying member 30 included in the developing device 503 may be brought into contact with a predetermined pressing force with the photosensitive drum 20 included in the charging/cleaning device 502 positioned and fixed to the apparatus main body 8A. In other words, the contact position is an image forming position of the developing device 503.

The separation position is a developing device movement position at which the developer carrying member 30 included in the developing device 503 may be separated by a predetermined distance from the photosensitive drum 20 included in the charging/cleaning device 502 positioned and fixed to the apparatus main body 8A. In other words, the separation position is a non-image forming position of the developing device 503.

Figure 17A:
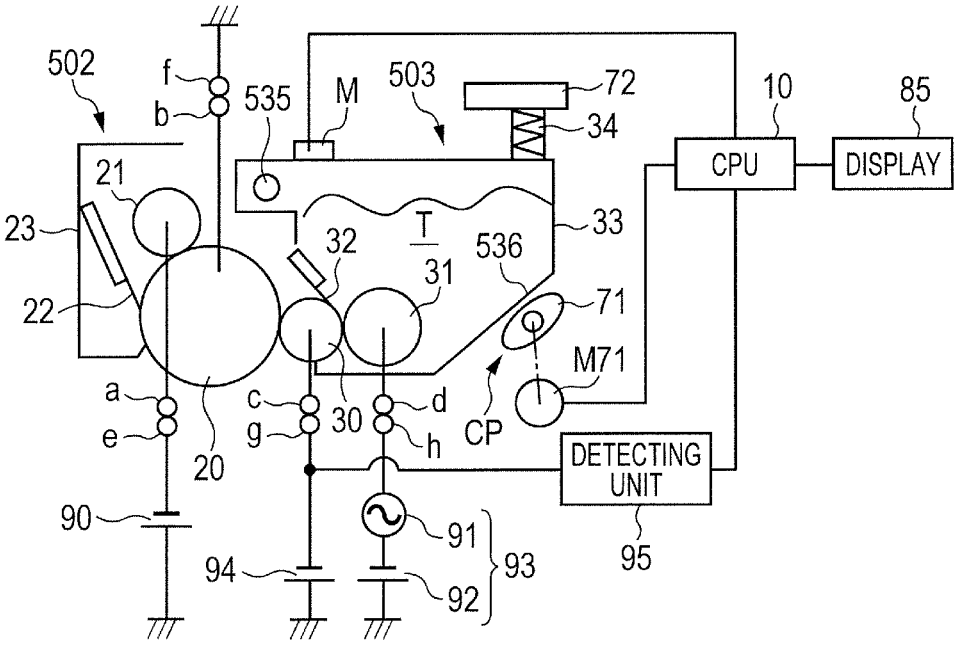
FIG. 17A is a schematic diagram of a contact state of a developing device with respect to a photosensitive drum and its electrical connection.
Figure 17B:
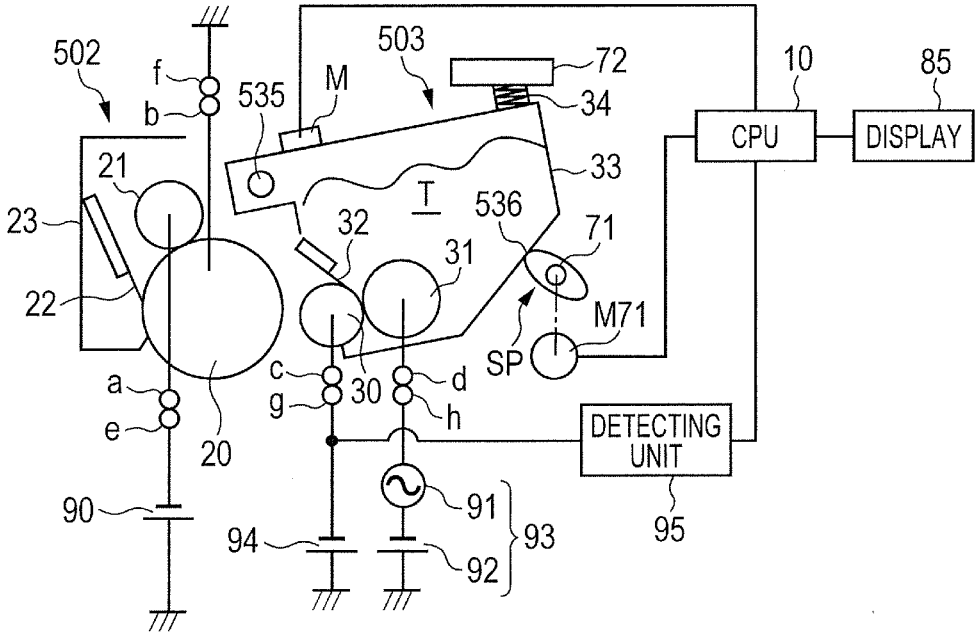
FIG. 17B is a schematic diagram of a separation state of the developing device with respect to the photosensitive drum and its electrical connection.

The cam as the contact-separation member 71 is positioned correspondingly to the force receiving portion 536 of the developing device 503. The contact-separation member 71 includes a large elevated portion and a small elevated portion. The contact-separation member 71 is controlled in posture by a drive source M71 controlled by the control unit 10 to a first rotation angle posture in which the small elevated portion corresponds to the force receiving portion 536 of the developing device 503 as illustrated in FIG. 17A. Further, the contact-separation member 71 is controlled in posture to a second rotation angle posture in which the large elevated portion corresponds to the force receiving portion 536 of the developing device 503 as illustrated in FIG. 17B.

The developing device 503 is always applied with a pivoting moment about the swing center portion 535 by a bias force of the development pressure member 34 interposed between the upper surface of the developing frame 36 and the force receiving portion 72 of the apparatus main body. Regarding the pivoting moment, the relative positions of the swing center portion 535, the development pressure member 34, and the force receiving portion 72 are set so that the developer carrying member 30 of the developing device 503 may face the photosensitive drum 20 of the charging/cleaning device 502.

The contact-separation member 71 does not interfere with the developing device 503 in the first rotation angle posture in which the small elevated portion corresponds to the force receiving portion 536 of the developing device 503. Thus, the developing device 503 pivots by the above-mentioned pivoting moment of the development pressure member 34 until the developer carrying member 30 is brought into contact with a predetermined pressing force with the photosensitive drum 20 of the charging/cleaning device 502 and received by the photosensitive drum 20. In other words, the developing device 503 is moved to the contact position of FIG. 17A. The first rotation angle posture of the contact-separation member 71 for bringing the developing device 503 into the contact position is hereinafter referred to as "contact position (first position) CP".

In the state in which the developing device 503 is moved to the contact position, in the image forming operation, power is transmitted from the drive output portion (not shown) of the apparatus main body 8A to the drive input portion (not shown) of the developing device 503, thereby rotationally driving the developer carrying member 30 and the developer feeding member 31.

The contact-separation member 71 acts to push up the developing device 503 against the bias force of the development pressure member 34 in the second rotation angle posture in which the large elevated portion corresponds to the force receiving portion 536 of the developing device 503. In other words, the developing device 503 receives a larger counter force from the contact-separation member 71 than the force received from the development pressure member 34.

Thus, the developing device 503 is pivoted about the swing center portion 535 in the direction of separating the developer carrying member 30 from the photosensitive drum 20 while compressing the development pressure member 34 provided between the upper surface of the developing frame 36 and the force receiving portion 72 of the apparatus main body 8A against the bias force. The developing device 503 is then retained at a pivot position away from the photosensitive drum 20 by a predetermined distance. In other words, the developing device 503 is moved to the separation position of FIG. 17B. The second rotation angle posture of the contact-separation member 71 for bringing the developing device 503 into the separation position is hereinafter referred to as "separation position (second position) SP".

When the cartridge CR is mounted to the mount portion 8B, the electrical contacts "c" and "d" of the developing device 503 are maintained to be electrically connected to the electrical contacts "g" and "h" of the apparatus main body 8A, respectively, when the developing device 503 is moved to any one of the contact position and the separation position.

When the cartridge CR is not mounted to the mount portion 8B or not properly mounted to the mount portion 8B, the electrical contacts "c" and "d" of the developing device 503 are not connected to the electrical contacts "g" and "h" of the apparatus main body 8A.

The storage unit (memory) M of the developing device 503 and the control unit 10 are configured to transmit and receive information therebetween via a communication unit (not shown) when the developing device 503 assumes any one of the contact position and the separation position.

In this embodiment, the cam is used as the contact-separation member 71 so that the developing device 503 may be movable to the contact position and the separation position. However, this is not a limitation. Another configuration may be used.

(3) Detection of Remaining Amount of Toner of Developing Device 503

The capacitance detecting unit 95 detects a value relating to the capacitance of the capacitor formed by the developer carrying member 30 and the developer feeding member 31. In this embodiment, the capacitance detecting unit (detecting unit) 95 is a current detecting unit configured to detect a current flowing between the developer carrying member 30 and the developer feeding member 31. The capacitance detecting unit 95 is configured to detect the capacitance between the developer carrying member 30 and the developer feeding member 31 by detecting an AC current amount which is induced in the developer carrying member 30 when a predetermined detection voltage containing at least an AC component is applied to the developer feeding member 31. In this embodiment, the developer feeding member 31 functions as a conductive member for generating the capacitance between the developer carrying member 30 and the developer feeding member 31 by being paired with the developer carrying member 30.

This embodiment uses a circuit for outputting to the control unit 10 a detected voltage obtained by dropping a predetermined reference voltage V0 in accordance with the detected AC current amount. Specifically, a larger amount of the AC current is induced in the developer carrying member 30 as the capacitance between the developer carrying member 30 and the developer feeding member 31 becomes larger, and as a result, the detected voltage of the capacitance detecting unit 95 in this embodiment has a smaller value.

In this embodiment, the capacitance detecting unit 95 is used to detect the remaining amount of the toner (developer) T in the developing device. The capacitance detecting unit 95 outputs the detected voltage corresponding to the capacitance between the developer carrying member 30 and the developer feeding member 31 to the control unit 10. As a larger amount of toner is present between the developer carrying member 30 and the developer feeding member 31, the capacitance between the developer carrying member 30 and the developer feeding member 31 becomes larger. Contrary, when the toner is consumed by the developing operation and the amount of toner between the developer carrying member 30 and the developer feeding member 31 becomes smaller, the capacitance between the developer carrying member 30 and the developer feeding member 31 becomes smaller.

Thus, the remaining amount of toner may be detected in a manner that a detection voltage containing at least an AC component is applied to the developer feeding member 31, and a voltage corresponding to the amount of an AC current induced in the developer carrying member is detected by the capacitance detecting unit 95.

The remaining amount of toner may be detected when the developing device 503 is in any one of the contact state and the separation state. However, the detected voltage of the capacitance detecting unit 95 differs depending on whether the developing device 503 assumes the contact position or the separation position.

This is because, in the contact state, as compared to the separation state, when a predetermined detection voltage is applied to the developer feeding member 31, an induced current flows also through other members as well as the developer carrying member 30. Specifically, the induced current flows also through the charging member 21 connected to the ground via the photosensitive drum 20 connected to the ground and the charging voltage applying unit 90. It is therefore desired to detect the remaining amount of toner in any one of the contact state and the separation state.

Figure 18:
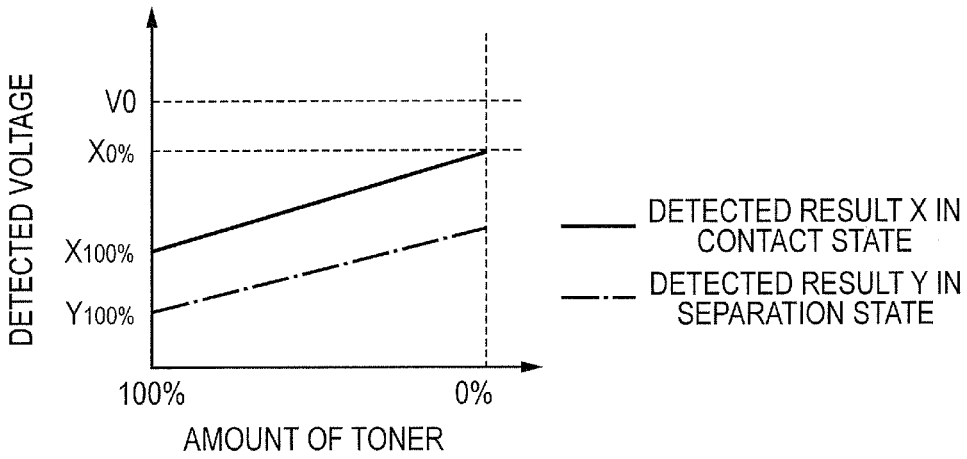
FIG. 18 is a schematic graph showing a relationship between the amount of toner and a detected result of the capacitance detecting unit.

FIG. 18 shows the relationship between the remaining amount of toner in the developing device 503 and the detected voltage of the capacitance detecting unit 95. The cartridge CR was properly mounted to the mount portion 8B of the apparatus main body 8A. The solid line represents a detected result X of the detected voltage of the capacitance detecting unit 95 with respect to the remaining amount of toner, which was detected in the contact position (contact state). The dashed line represents a detected result Y of the detected voltage of the capacitance detecting unit with respect to the remaining amount of toner, which was detected in the separation position (separation state).

The applied detection voltage was a sinewave AC voltage having a frequency of 50 kHz and an amplitude of 0.1 kV. The use environments of the image forming apparatus 8 were a temperature of 23° C. and a humidity of 50% RH. The remaining amount of toner of a new process cartridge CR is defined as 100%, and the remaining amount of toner after the toner is too consumed to output a solid image is defined as 0%. V0 is a reference voltage.

As shown in FIG. 18, both the detected result X detected in the contact position and the detected result Y detected in the separation position indicate that the detected voltage of the capacitance detecting unit 95 increases as the remaining amount of toner becomes smaller. This is because the capacitance between the developer carrying member 30 and the developer feeding member 31 decreases when the toner is consumed. The detected result X detected in the contact position has a larger detected voltage than that of the detected result Y detected in the separation position. This is because the apparent capacitance between the developer carrying member 30 and the developer feeding member 31 becomes smaller in the contact state than in the separation state due to the influence of the photosensitive drum 20 or the charging member 21.

In other words, in the contact state, as compared to the separation state, when a predetermined detection voltage is applied to the developer feeding member 31, an induced current flows also through other members as well as the developer carrying member 30. Specifically, the induced current flows also through the charging member 21 connected to the ground via the photosensitive drum 20 and the charging voltage applying unit 90 that are connected to the ground.

The detected voltage of the capacitance detecting unit 95 detected in the contact position or the separation position has a correlation with the remaining amount of toner of the developing device 503. Therefore, by storing the relationship between the detected voltage of the capacitance detecting unit 95 and the remaining amount of toner in the storage unit M in advance, the remaining amount of toner of the developing device 503 can be detected based on the detected voltage of the capacitance detecting unit 95. Although the relationship between the detected voltage of the capacitance detecting unit 95 and the remaining amount of toner is stored in the storage unit M of the developing device 503 in this embodiment, the relationship may be stored in another storage unit.

Although the use environments of the image forming apparatus 8 were a temperature of 23° C. and a humidity of 50% RH, the same effects may be obtained in other use environments, though the magnitude of the detected result slightly differs.

(4) Detection of Various Apparatus States of Image Forming Apparatus

The configuration in which the developing device 503 of the cartridge CR is movable is more complicated and has a problem in that the developing device 503 is not moved normally due to component fluctuations and assembly fluctuations.

To deal with the problem, it is determined whether or not the cartridge CR mounted to the apparatus main body 8A is properly mounted to a predetermined mount portion 8B, and it is determined whether or not the developing device 503 is moved between the contact position and the separation position without fail, thereby determining whether the apparatus state is normal or abnormal. Specifically, the control unit 10 discriminates various apparatus states of the image forming apparatus to determine whether the apparatus state is normal or abnormal.

FIGS. 19A, 19B, 19C, and 19D show detected results of the capacitance detecting unit 95 in various states of the cartridge CR.

In this experiment, the contact-separation member 71 was driven and turned to the contact position CP. Then, a detection voltage containing at least an AC voltage was applied to the developer feeding member 31, and a detected voltage X (first detected result) was detected by the capacitance detecting unit 95. After the detection of the detected voltage X, the detection voltage was turned OFF.

Subsequently, the contact-separation member 71 was driven and turned to the separation position SP. Then, the same detection voltage as the voltage applied in the case of the contact position CP was applied to the developer feeding member 31, and a detected voltage Y (second detected result) was detected by the capacitance detecting unit 95. After the detection of the detected voltage Y, the detection voltage was turned OFF.

In this experiment, the developing device 503 having the remaining amount of toner of 80% was used, and the applied detection voltage was a sinewave AC voltage having a frequency of 50 kHz and an amplitude of 0.1 kV. The use environments of the image forming apparatus 8 were a temperature of 23° C. and a humidity of 50% RH.

Figure 19A:
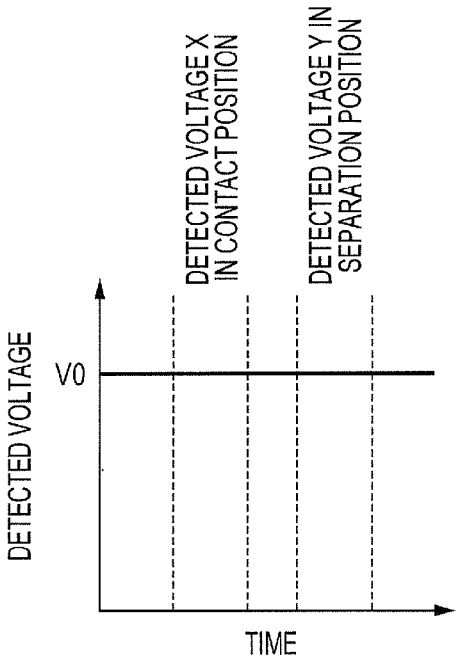
FIGS. 19A, 19B, 19C, and 19D are schematic graphs showing detected results of the capacitance detecting unit in various apparatus states.

FIG. 19A shows a detected result when the cartridge CR was not mounted or not properly mounted to the mount portion 8B of the apparatus main body 8A. In this case, the capacitance between the developer carrying member 30 and the developer feeding member 31 cannot be detected. Thus, the detected voltage X in the contact position CP and the detected voltage Y in the separation position SP both have a value substantially equal to the reference voltage V0.

Figure 19B:
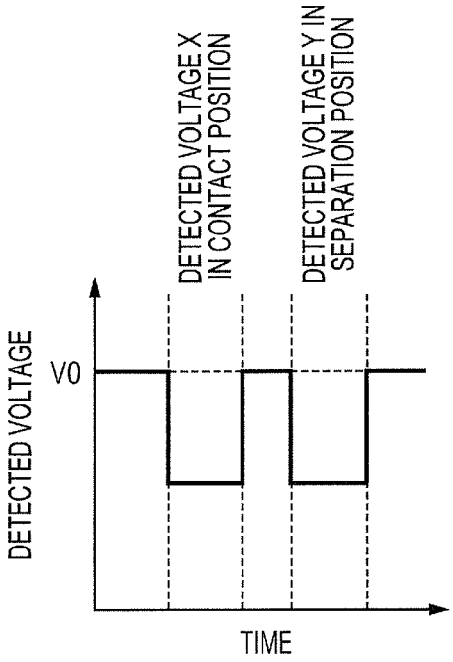

FIG. 19B shows a result when a separation failure has occurred in the developing device 503 of the cartridge CR mounted to the mount portion 8B of the apparatus main body 8A. The cartridge CR is mounted, and hence the detected voltage X in the contact position has a value substantially equal to the detected voltage X of FIG. 18 measured when the remaining amount of toner is 80%. In the separation position SP, a separation failure has occurred, and hence the photosensitive drum 20 and the developer carrying member 30 are not separated but remain in contact with each other. Thus, the detected voltage Y in the separation position SP has a value substantially equal to the detected voltage X in the contact position CP.

Figure 19C:
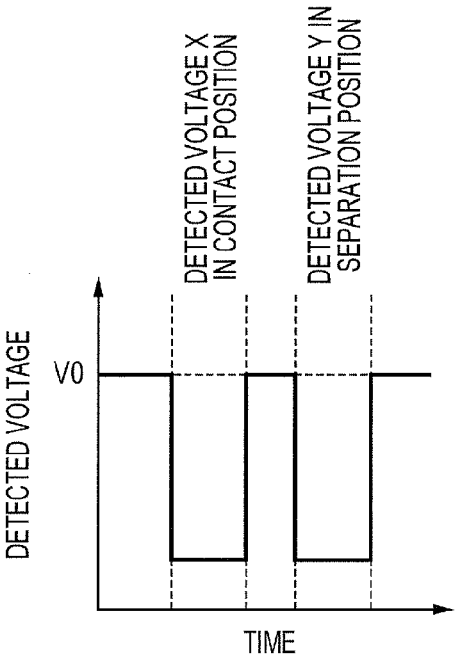

FIG. 19C shows a result when a contact failure has occurred in the developing device 503 of the cartridge CR mounted to the mount portion 8B of the apparatus main body 8A. The cartridge CR is mounted, and hence the detected voltage Y in the separation position has a value substantially equal to the detected voltage Y of FIG. 18 measured when the remaining amount of toner is 80%. In the contact position CP, a contact failure has occurred, and hence the photosensitive drum 20 and the developer carrying member 30 are not brought into contact with but remain separate from each other. Therefore, the capacitance is not affected by the photosensitive drum 20 and the charging member 21, and hence an apparent capacitance is not reduced as compared to the capacitance in the separation position SP. Thus, the detected voltage X in the contact position CP has a value substantially equal to the detected voltage Y in the separation position SP.

Figure 19D:
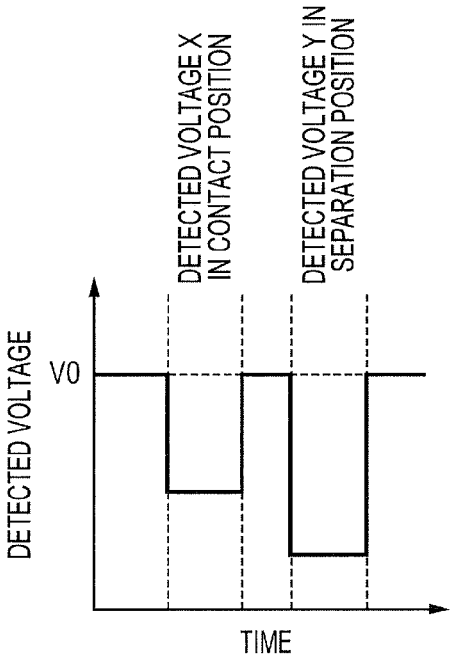

FIG. 19D shows a detected result when the contact-separation operation of the developing device 503 was normally performed. The developing device is in a normal contact state, and hence the detected voltage X in the contact position CP has a value substantially equal to the detected voltage X of FIG. 18 measured when the remaining amount of toner is 80%. The developing device is in a normal separation state, and hence the detected voltage Y in the separation position SP has a value substantially equal to the detected voltage Y of FIG. 18 measured when the remaining amount of toner is 80%. Thus, the outputs of the detected voltage X and the detected voltage Y are different from each other by the influence of the photosensitive drum and the charging roller.

In other words, the detected voltage X in the contact position of the developing device 503 has a larger value than the detected voltage Y because the developer carrying member 30 and the photosensitive drum are brought into contact with each other and an apparent capacitance becomes smaller than that in the separation state. In such a case where a predetermined difference or more occurs between the detected voltage X and the detected voltage Y, it is regarded that the contact-separation operation is normally performed.

Although the cartridge CR having the remaining amount of toner of 80% was used in the above-mentioned experiment, the same results may be obtained also by using a cartridge CR having another remaining amount of toner.

In view of the results described above, the photosensitive drum 20 and the developer carrying member 30 are configured to be in contact with and separated from each other. The capacitance detecting unit 95, which is connectable to the developer carrying member 30, is used. Then, the capacitance between the developer carrying member 30 and the developer feeding member 31 is detected when the contact-separation member 71 assumes the contact position CP and the separation position SP. It is understood from the above that this configuration may discriminate the following states (1) to (3) regardless of the use environments and the remaining amount of toner:

(1) the state in which the cartridge CR is not mounted or not properly mounted;

(2) the state in which the cartridge CR is properly mounted but a separation failure or a contact failure has occurred in the developing device 503; and (3) the state in which the cartridge CR is properly mounted and the contact-separation operation of the developing device 503 is normally performed.

In other words, the above-mentioned three apparatus states (1) to (3) of the cartridge CR may be discriminated by the capacitance detecting unit 95 used for the detection of the remaining amount of toner, thus detecting the abnormality in the contact-separation operation of the developing device 503. Specifically, it is possible to perform cartridge mount detection as to whether or not the cartridge CR is mounted. Further, it is possible to perform contact-separation detection as to whether the photosensitive drum 20 and the developer carrying member 30 may have the contact state in which the photosensitive drum 20 and the developer carrying member 30 are brought into contact with each other and the separation state in which the photosensitive drum 20 and the developer carrying member 30 are not in contact with but separated from each other.

The capacitance detecting unit 95 used for the detection of the remaining amount of toner is used, and hence an additional member or a detecting unit is not necessary for abnormality detection. Further, an AC voltage is used as the detection voltage, and hence it is not necessary to rotationally drive the photosensitive drum 20 and the developer carrying member 30 for detection.

Figure 20:
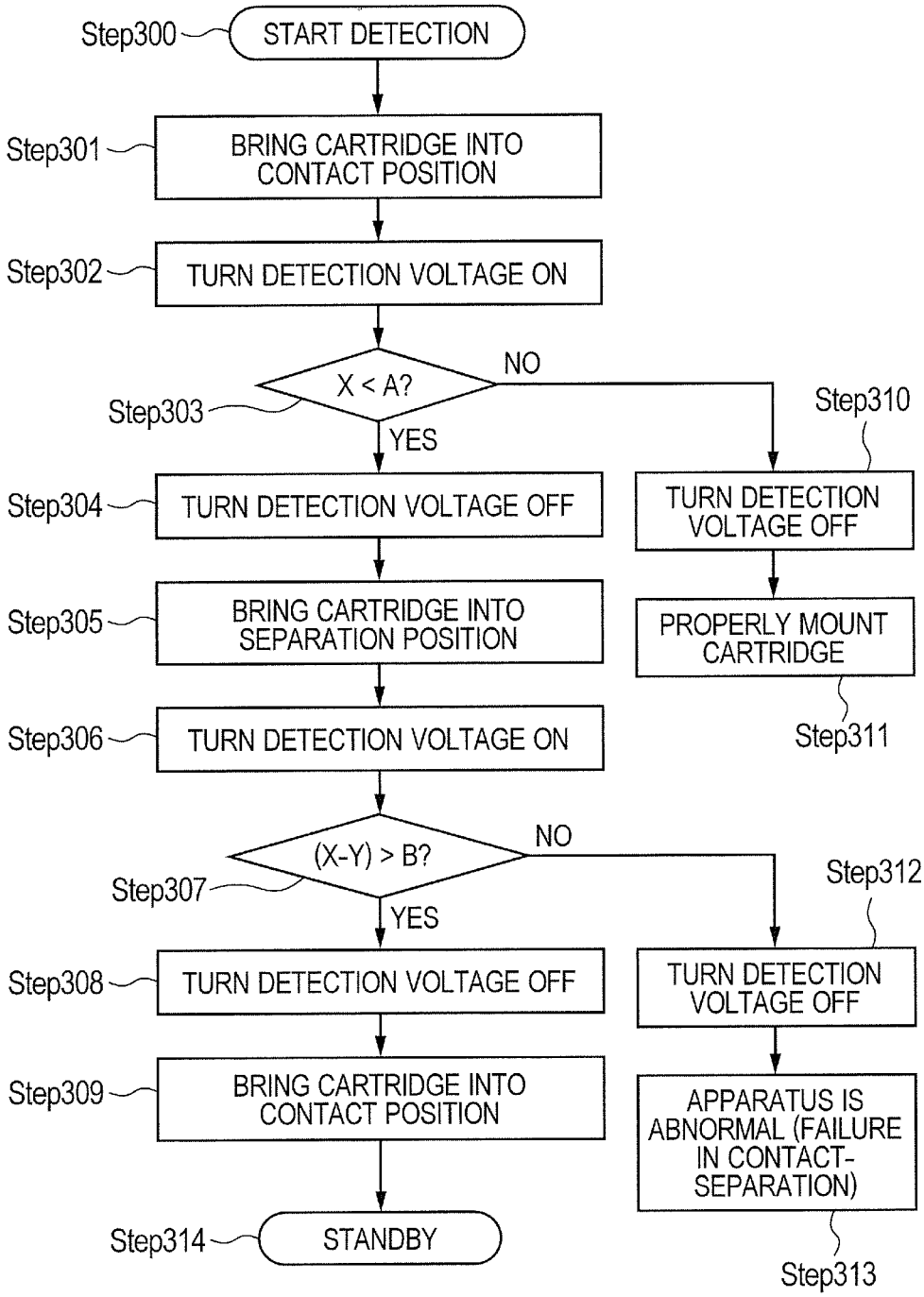
FIG. 20 is a sequence chart for detecting the apparatus state.

FIG. 20 is a sequence chart of the above-mentioned abnormality detection according to this embodiment. This sequence is executed by the control unit 10.

This sequence is started when the main power switch is turned ON or at any timing of non-image formation (Step 300). First, in Step 301, the contact-separation member 71 is driven to the contact position CP. Next, in Step 302, the detection voltage applying unit 93 is turned ON to apply a detection voltage, and a detected voltage X (first detected result) in the contact position is detected by the capacitance detecting unit 95.

Subsequently, in Step 303, the detected voltage X is compared to a threshold A (first predetermined value) stored in the storage unit (not shown) in the image forming apparatus in advance. The threshold A is determined in advance as a value in the range expressed by Expression (1) below. In Expression (1), "Xmax" is a maximum value of the detected voltage X in the range of the remaining amount of toner of 0% to 100% by taking into account of use environments and fluctuations in detected result.

$$X\max < A < V0 \qquad \text{Ex. (1)}$$

For example, the threshold A is set in the range of X0%<A<V0 using X0% shown in FIG. 18.

When the detected voltage X is equal to or larger than the threshold A, the sequence proceeds to Step 310, the detection voltage applying unit 93 is turned OFF, and the detection voltage is turned OFF. Then, in Step 311, the control unit 10 controls the display portion 85 of the apparatus operation portion 13 to display a message indicating that the cartridge CR is not properly mounted, such as a message "Properly mount the process cartridge", to thereby notify the user.

In response to the notification, the user mounts the unmounted cartridge CR or properly mounts the cartridge CR that has not been properly mounted. The control unit 10 restarts this sequence (Step 300).

In Step 303, when the detected voltage X is smaller than the threshold A, the sequence proceeds to Step 304, and the detection voltage applying unit 93 is turned OFF to turn OFF the detection voltage. After that, in Step 305, the contact-separation member 71 is driven to the separation position SP.

Next, in Step 306, the detection voltage applying unit 93 is turned ON to apply a detection voltage, and a detected voltage Y (second detected result) in the separation position is detected by the capacitance detecting unit 95. Subsequently, in Step 307, a difference (X−Y) between the detected voltage X and the detected voltage Y is compared to a threshold B (second predetermined value) stored in the storage unit (not shown) in the image forming apparatus in advance. The threshold B is determined in advance as a value in the range expressed by Expression (2) below. In Expression (2), "(X−Y)min" is a minimum value of the difference between the detected voltage X and the detected voltage Y in the range of the remaining amount of toner of 0% to 100% by taking into account of use environments and fluctuations in detected result.

$$0<B<(X-Y)\text{min} \qquad \text{Ex. (2)}$$

For example, the threshold B is set in the range of 0<B<(X100%−Y100%) using X100% and Y100% shown in FIG. 18.

When the difference (X−Y) between the detected voltage X and the detected voltage Y is equal to or smaller than the threshold B, the sequence proceeds to Step 312, and the detection voltage applying unit 93 is turned OFF to turn OFF the detection voltage. Then, in Step 313, the control unit 10 controls the display portion 85 to display a message indicating that the apparatus main body is abnormal, such as a message "Apparatus is abnormal", to thereby notify and prompt the user to take measures.

Specifically, the control unit 10 performs the contact-separation detection to determine that the apparatus main body is normal when the contact state and the separation state are possible, and determine that the apparatus main body is abnormal when the contact state and the separation state are impossible.

In Step 307, when the difference (X−Y) between the detected voltage X and the detected voltage Y is larger than the threshold B, the sequence proceeds to Step 308, and the detection voltage is turned OFF. After that, the sequence proceeds to Step 309, and the contact-separation member 71 is driven to the contact position CP. Then, the sequence proceeds to Step 314, and the image forming apparatus 8 becomes the standby state for waiting for a print job. When the control unit 10 receives a print job in the standby state, the image forming apparatus 8 starts printing to form an image.

As exemplified by this sequence, it is preferred to determine whether the contact-separation operation is normally performed (contact-separation detection) after determining the mount state of the cartridge CR (cartridge mount detection). Specifically, the control unit 10 detects the mount state of the cartridge CR, and, when it is determined that the cartridge CR is not mounted, determines that the apparatus main body is abnormal without performing the contact-separation detection. On the other hand, when it is determined that the cartridge CR is mounted, the control unit 10 subsequently performs the contact-separation detection.

This is because the mount state of the cartridge CR may be checked merely based on the detected voltage X in the contact state, which enables quick notification to the user that image formation cannot be executed because the cartridge CR is not mounted or not properly mounted.

As described above, in this embodiment, the above-mentioned states (1) to (3) of the cartridge CR may be discriminated by the capacitance detecting unit 95 used for the detection of the remaining amount of toner, thus detecting the abnormality in contact-separation of the developing device 503. In the image forming apparatus which is configured to detect the remaining amount of toner by detecting the capacitance between the conductive members such as the developer carrying member and the developer feeding member, the abnormality in contact-separation may be detected without adding an additional member or a detecting unit. Further, it is not necessary to drive the process cartridge CR for detection.

Thus, a more inexpensive image forming apparatus and a more compact image forming apparatus may be provided. In addition, the apparatus state may be detected more quickly, and hence an image forming apparatus with higher usability may be provided.

Eighth Embodiment

An eighth embodiment of the present invention is now described below. In this embodiment, a detection voltage is applied to the developer layer thickness regulating member 32, and an induced current flowing through the developer carrying member 30 is detected. In this embodiment, the developer layer thickness regulating member functions as a conductive member for generating the capacitance between the developer carrying member 30 and the developer layer thickness regulating member 32 by being paired with the developer carrying member 30. The present invention may be employed also in such a configuration that a detection voltage containing an AC voltage is applied to the developer layer thickness regulating member 32, and an induced current flowing through the developer carrying member 30 is detected.

Figure 21A:
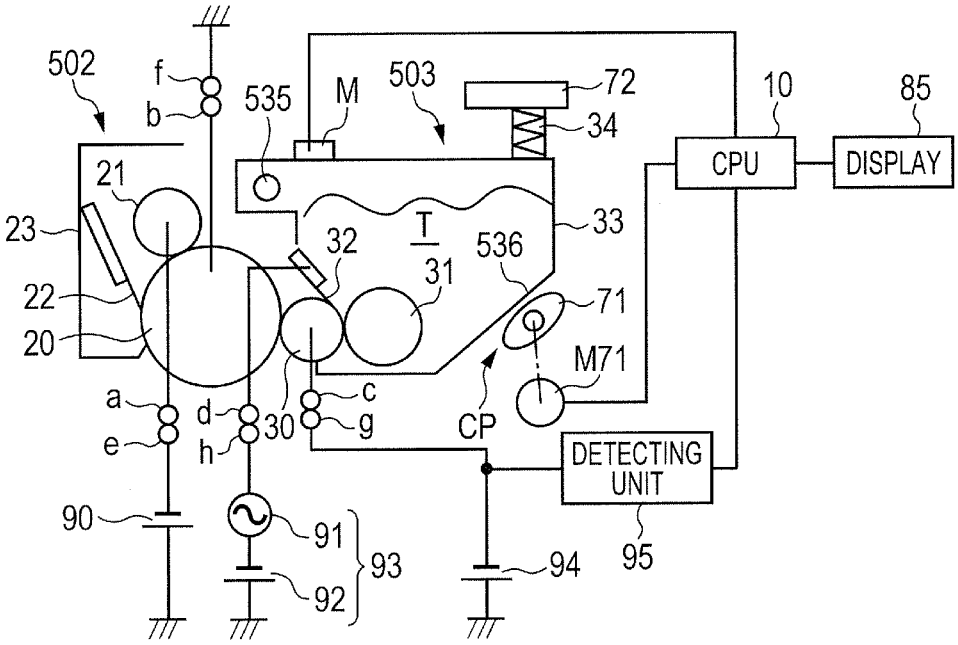
FIG. 21A is a schematic diagram of a contact state of the developing device with respect to the photosensitive drum and its electrical connection.
Figure 21B:
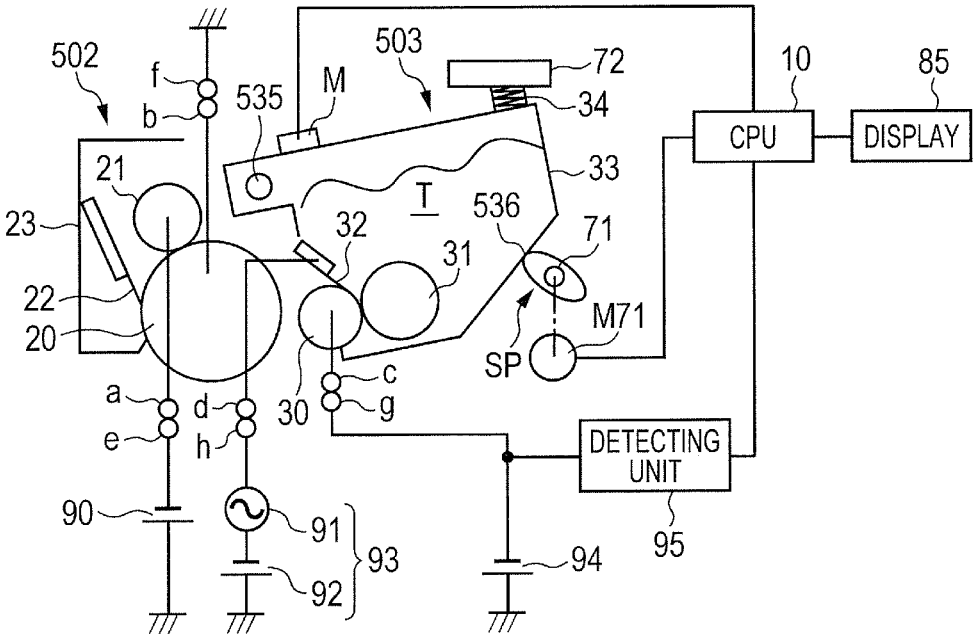
FIG. 21B is a schematic diagram of a separation state of the developing device with respect to the photosensitive drum and its electrical connection according to an eighth embodiment of the present invention.

FIG. 21A is a schematic diagram of the contact state in which the developer carrying member 30 is brought into contact with the photosensitive drum 20. FIG. 21B is a schematic diagram of the separation state in which the developer carrying member 30 is separated from the photosensitive drum 20 in a non-contact state.

When the cartridge CR is positioned and fixed at the mount portion 8B of the of the apparatus main body 8A, the photosensitive drum 20 is connected to the ground. The charging member 21 is connected to the charging voltage applying unit 90 configured to apply a predetermined charging voltage. Although a DC voltage is used as the charging voltage in this embodiment, this is not a limitation. A charging voltage obtained by superimposing an AC voltage on a DC voltage may be used instead.

When the developing device 503 assumes the contact position or the separation position, the developer layer thickness regulating member 32 is connected to the detection voltage applying unit 93. The detection voltage applying unit 93 includes at least the AC voltage applying unit 91 configured to apply an AC voltage. In this embodiment, the detection voltage applying unit 93 includes the DC voltage applying unit 92 configured to apply a DC voltage and the AC voltage applying unit 91. When the developing device 503 is moved from the contact position to the separation position or even when the developing device 503 is moved conversely from the separation position to the developing position, the developer layer thickness regulating member 32 is connected to the detection voltage applying unit 93.

When the developing device 503 assumes the contact position or the separation position, the developer carrying member 30 is connected to the developing voltage applying unit 94 configured to apply a predetermined DC voltage as a developing voltage and to the capacitance detecting unit 95. Specifically, when the developing device 503 is moved from the contact position to the separation position or even when the developing device 503 is moved conversely from the separation position to the developing position, the developer carrying member 30 is connected to the developing voltage applying unit 94 and the capacitance detecting unit 95.

In the case where the cartridge CR is not mounted to the mount portion 8B or not properly mounted to the mount portion 8B, the electrical contacts "a" and "e", "b" and "f", "c" and "g", and "d" and "h" are not connected.

In this embodiment, the developer layer thickness regulating member 32 uses a conductive blade formed on a conductive support. However, this is not a limitation. The developer layer thickness regulating member 32 only needs to have a conductive member so that an AC current may be induced in the developer carrying member 30 when the AC current is applied to the conductive member.

The other configurations and control are the same as in the seventh embodiment, and hence the same configurations are denoted by the same reference symbols and detailed description thereof is omitted.

Also in this embodiment, the same three mount states as those (1) to (3) of the seventh embodiment may be discriminated by the capacitance detecting unit 95. In the image forming apparatus in which the capacitance detecting unit 95 is connected to the developer carrying member 30, the abnormality in contact-separation of the developing device 503 may be detected without adding an additional member or a detecting. Further, it is not necessary to drive the cartridge CR for detection.

Thus, a more inexpensive image forming apparatus and a more compact image forming apparatus may be provided. In addition, the apparatus state may be detected more quickly, and hence an image forming apparatus with higher usability may be provided.

Ninth Embodiment

A ninth embodiment of the present invention is now described below. In the case where the developer carrying member 30 has an elastic member such as urethane rubber, if the developer carrying member 30 comes into contact with the photosensitive drum 20 for a long time, the contact portion may be depressed to generate a failure image, such as a banding image. This contact state lasts for a long time, for example, before the first use of the cartridge CR by a user from the manufacturing and shipment of the cartridge CR.

Aimed at preventing the generation of a banding image, there is known a cartridge that includes a contact preventing member in advance before shipment for preventing the contact between the developer carrying member 30 and the photosensitive drum 20. The contact preventing member is a member that needs to be removed by a user before the first use of the cartridge CR.

The user, however, may forget to remove the contact preventing member. Particularly in the case where the cartridge CR is shipped while being included in the apparatus main body 8A, the user is likely to forget to remove the contact preventing member before the start of the use.

If the user forgets to remove the contact preventing member and starts using the cartridge CR for image formation, an image failure such as an image with a blank area is generated. This is because an image is formed in the state in which the developer carrying member 30 and the photosensitive drum 20 are separated from each other.

Further, torque of the drive portion of the apparatus main body 8A for driving the cartridge becomes larger, and hence the apparatus main body 8A or the cartridge CR may break down.

To deal with the problems, it is necessary to detect whether or not the contact preventing member is mounted to the cartridge CR without driving the cartridge CR. The image forming apparatus is required to detect the unremoved state of the contact preventing member and notify the user. In this embodiment, the unremoved state of the contact preventing member is detected (contact preventing member detection).

Figure 22:
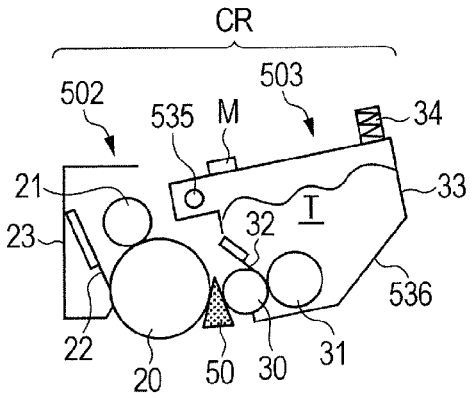
FIG. 22 is a schematic diagram of a process cartridge according to a ninth embodiment of the present invention.

FIG. 22 illustrates a schematic diagram of the cartridge CR according to this embodiment. The contact preventing member 50 is removably mountable to the cartridge CR so as to prevent the contact between the photosensitive drum 20 and the developer carrying member 30. The contact preventing member 50 is fixed outside an image region on both sides or each side of an end portion in the shaft direction between the photosensitive drum 20 and the developer carrying member 30, and prevents the contact between an image region of the photosensitive drum 20 and an image region of the developer carrying member 30 in the shaft direction. Preventing the contact therebetween prevents, an adverse effect on an image caused by depression of the elastic portion of the developer carrying member 30 even when the cartridge CR is left unused for a long time.

The contact preventing member 50 is shipped in the state of being mounted to the cartridge CR. The contact preventing member 50 is a member to be removed from the cartridge CR by a user before the use of the cartridge CR. The cartridge CR having the contact preventing member 50 mounted thereon is removably mountable to the apparatus main body 8A, and may be included in the apparatus main body before shipment.

Figure 23A:
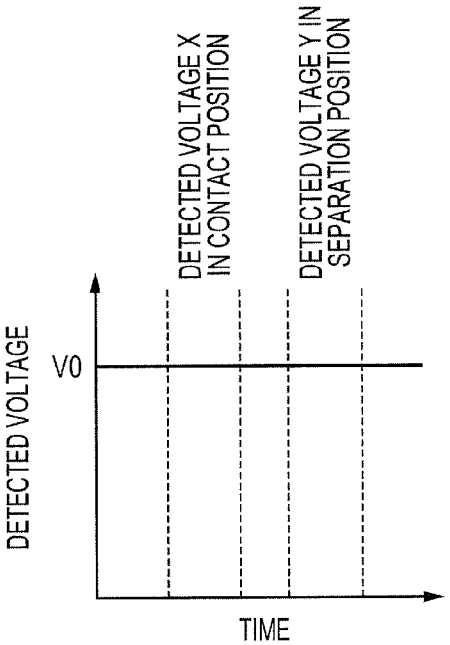
FIGS. 23A, 23B, and 23C are schematic graphs showing detected results of the capacitance detecting unit in various apparatus states.
Figure 23B:
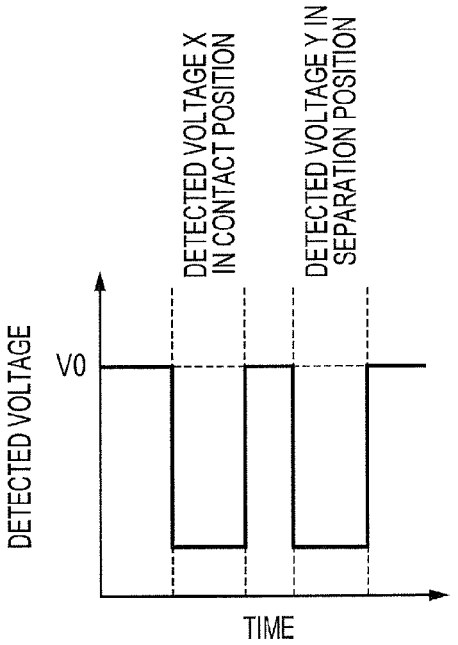
Figure 23C:
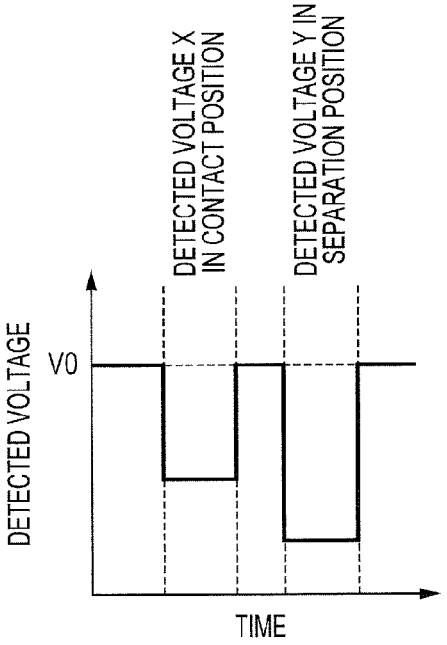

FIGS. 23A, 23B and 23C show detected results of the capacitance detecting unit 95 in various states of the cartridge CR.

In this experiment, the contact-separation member 71 was driven and turned to the contact position CP. Then, a detection voltage containing at least an AC voltage was applied to the developer feeding member 31, and a detected voltage X (first detected result) was detected by the capacitance detecting unit 95. After the detection of the detected voltage X, the detection voltage was turned OFF.

Subsequently, the contact-separation member 71 was driven and turned to the separation position SP. Then, the same detection voltage as the voltage applied in the case of the separation position SP was applied to the developer feeding member 31, and a detected voltage Y (second detected result) was detected by the capacitance detecting unit 95. After the detection of the detected voltage Y, the detection voltage was turned OFF.

In this experiment, the developing device 503 having the remaining amount of toner of 80% was used, and the applied detection voltage was a sinewave AC voltage having a frequency of 50 kHz and an amplitude of 0.1 kV. The use environments of the image forming apparatus 8 were a temperature of 23° C. and a humidity of 50% RH.

FIG. 23A shows the state in which the cartridge CR is not properly mounted to the apparatus main body. When the cartridge CR is not mounted or not properly mounted, the detected voltages X and Y of the capacitance detecting unit 95 both have a value substantially equal to the reference voltage V0.

FIG. 23B shows the state in which the cartridge CR having the contact preventing member 50 mounted thereon is mounted to the apparatus main body. The detected voltage X in the contact position CP of the contact-separation member 71 has a value substantially equal to the detected voltage Y in the separation position SP because the contact preventing member 50 is mounted to prevent the contact between the photosensitive drum 20 and the developer carrying member 30. The detected voltage Y in the separation position SP of the contact-separation member 71 has a value in the separation state because the photosensitive drum 20 and the developer carrying member 30 are separated from each other.

FIG. 23C shows the state in which the cartridge CR from which the contact preventing member 50 is removed is mounted to the apparatus main body. The contact preventing member 50 is removed, and hence the photosensitive drum 20 and the developer carrying member 30 are allowed to contact with or be separated from each other. Thus, the detected voltage X in the contact position CP and the detected voltage Y in the separation position SP have different values as described above.

Figure 24:
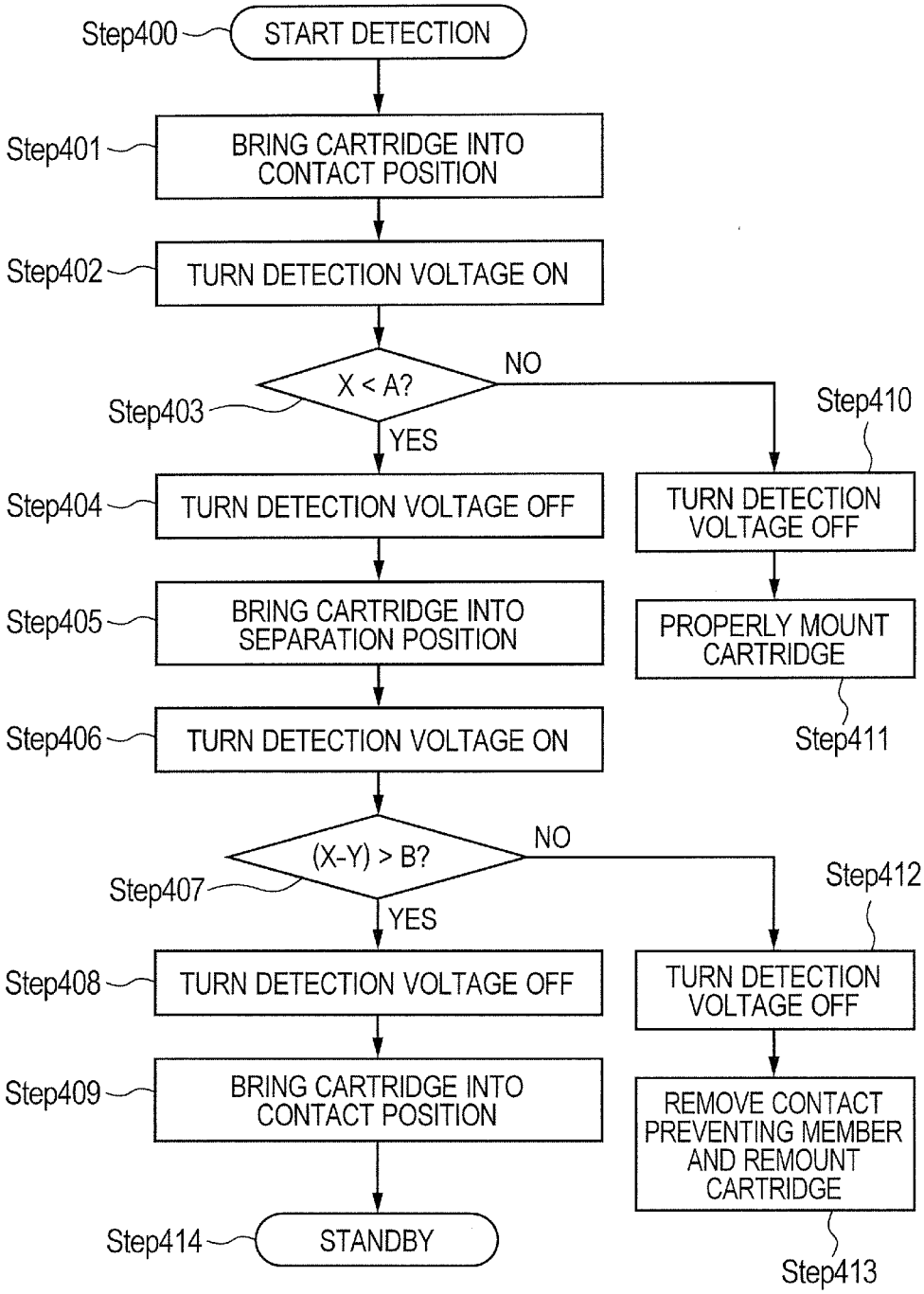
FIG. 24 is a sequence chart for detecting the apparatus state according to the ninth embodiment of the present invention.

FIG. 24 illustrates a sequence chart for detecting the contact preventing member 50 according to this embodiment. This sequence is started when the main power switch is turned ON or at any timing for detecting the mount of the cartridge CR (Step 400).

First, in Step 401, the contact-separation member 71 is driven to the contact position CP. Next, in Step 402, a detection voltage is applied, and a detected voltage X (first detected result) in the contact position CP is detected by the capacitance detecting unit 95. Subsequently, in Step 403, the detected voltage X is compared to a threshold A (first predetermined value) stored in the storage unit (not shown) in the image forming apparatus in advance.

The threshold A is determined in advance as a value in the range expressed by Expression (1) below. In Expression (1), "Xmax" is a maximum value of the detected voltage X in the range of the remaining amount of toner of 0% to 100% by taking into account of use environments and fluctuations in detected result.

$$X\max < A < V0 \qquad \text{Ex. (1)}$$

For example, the threshold A is set in the range of X0%<A<V0 using X0% shown in FIG. 18.

When the detected voltage X is equal to or larger than the threshold A, the sequence proceeds to Step 410, and the detection voltage is turned OFF. Then, in Step 411, the control portion 10 controls the display portion 85 to display a message indicating that the cartridge CR is not properly mounted, such as a message "Properly mount the process cartridge", to thereby notify the user.

In response to the notification, the user mounts the unmounted cartridge CR or properly mounts the cartridge CR that has not been properly mounted. The control unit 10 restarts this sequence (Step 400).

In Step 403, when the detected voltage X is smaller than the threshold A, the sequence proceeds to Step 404, and the detection voltage is turned OFF. After that, in Step 405, the contact-separation member 71 is driven to the separation position SP. Next, in Step 406, a detection voltage is applied, and a detected voltage Y (second detected result) in the separation position SP is detected by the capacitance detecting unit 95.

Subsequently, in Step 407, a difference (X−Y) between the detected voltage X and the detected voltage Y is compared to a threshold B (second predetermined value) stored in the storage unit (not shown) in the image forming apparatus 8 in advance. The threshold B is determined in advance as a value in the range expressed by Expression (2) below. In Expression (2), "(X−Y)min" is a minimum value of the difference between the detected voltage X and the detected voltage Y in the range of the remaining amount of toner of 0% to 100% by taking into account of use environments and fluctuations in detected result.

$$0 < B < (X-Y)\min \qquad \text{Ex. (2)}$$

For example, the threshold B is set in the range of 0<B<(X100%−Y100%) using X100% and Y100% shown in FIG. 18.

When the difference (X−Y) between the detected voltage X and the detected voltage Y is equal to or smaller than the threshold B, the sequence proceeds to Step 412, and the detection voltage is turned OFF. Then, in Step 413, the control unit 10 controls the display portion 85 to display a message indicating that the contact preventing member 50 is still mounted to the cartridge CR, such as a message "Remove the contact preventing member and remount the process cartridge", to thereby notify the user.

In response to the notification, the user removes the cartridge CR from the apparatus main body 8A, and remounts the cartridge CR after removing the contact preventing member. The control unit 10 restarts this sequence (Step 400).

When the difference (X−Y) between the detected voltage X and the detected voltage Y is larger than the threshold B, the sequence proceeds to Step 408, and the detection voltage is turned OFF. After that, the sequence proceeds to Step 409, and the contact-separation member 71 is driven to the contact position CP. Then, the sequence proceeds to Step 414, and the image forming apparatus 8 becomes the standby state for waiting for a print job. When receiving a print job in the standby state, the image forming apparatus 8 starts printing to form an image.

In this way, it is possible to detect the contact preventing member 50, which is removably mountable to the cartridge CR and prevents the contact between the developer carrying member 30 and the photosensitive drum 20.

Specifically, the control unit 10 determines that the contact preventing member 50 is not mounted to the cartridge CR when the developer carrying member 30 and the photosensitive drum 20 are switchable between the contact state and the separation state. On the other hand, the control unit 10 determines that the contact preventing member 50 is mounted to the cartridge CR when the developer carrying member 30 and the photosensitive drum 20 are not switchable between the contact state and the separation state.

In this embodiment, the following states may be discriminated by the capacitance detecting unit 95 connected to the developer carrying member 30:

(1) the state in which the cartridge CR is not properly mounted;

(2) the state in which the cartridge CR having the contact preventing member 50 mounted thereon is mounted; and (3) the state in which the cartridge CR is mounted, and the contact-separation operation of the developing device 503 is normally performed (the cartridge CR from which the contact preventing member 50 is removed is mounted). In addition, the unremoved-state detection for the contact preventing member 50 (contact preventing member detection) is possible. Further, it is not necessary to drive the cartridge CR for detection.

The other configurations and control are the same as in the seventh or eighth embodiment, and hence the same configurations are denoted by the same reference symbols and detailed description thereof is omitted.

As described above, in the image forming apparatus in which the capacitance detecting unit 95 is connected to the developer carrying member 30, the unremoved state of the contact preventing member 50 may be detected without adding an additional member or a detecting unit. Further, it is not necessary to drive the cartridge CR for detection.

Thus, a more inexpensive image forming apparatus and a more compact image forming apparatus may be provided. In addition, the apparatus state may be detected more quickly, and hence an image forming apparatus with higher usability may be provided.

(Other Matters Relating to Seventh to Ninth Embodiments)

(1) The developing device 503 of the cartridge CR mounted to the mount portion 8B of the apparatus main body 8A may be controlled to standby usually at the separation position as a home position, be moved to the contact position at the time of image formation, and be returned to the separation position at the time of non-image formation. Alternatively, the developing device 503 may be controlled to be located usually at the contact position.

(2) For detecting the mount of the cartridge CR (Step 303), the first detected result is compared to the threshold A. Alternatively, however, the second detected result may be used and compared to the threshold. In this case, when the mount of the cartridge CR is to be detected, the contact-separation member 71 is disposed at the separation position (second position) SP for separating the photosensitive drum 20 and the developer carrying member 30 from each other.

(3) In the seventh to ninth embodiments, the capacitance of the capacitor formed by the developer carrying member 30 is detected. Alternatively, however, the capacitance of a capacitor formed by the image bearing member (photosensitive drum 20) may be detected as described in the fourth embodiment.

(4) The image forming apparatus is not limited to an electrophotographic image forming apparatus described in the embodiments of the present invention. The present invention is also applicable to an electrostatic recording image forming apparatus or a magnetic recording image forming apparatus using a dielectric for electrostatic recording or a magnetic material for magnetic recording as an image bearing member.

(Effects of Seventh to Ninth Embodiments)

The effects of the above-mentioned seventh to ninth embodiments are summarized as follows. In each embodiment, the process cartridge (cartridge CR) including the image bearing member (photosensitive drum 20) and the developer carrying member 30 is removably mountable to the apparatus main body 8A of the image forming apparatus 8. In this case, it is necessary to detect the mount state of the process cartridge in order to determine whether or not the image forming apparatus is ready for image formation. In the case where the process cartridge is mounted, it is desired to confirm that the image bearing member and the developer carrying member 30 are switchable between the contact state and the separation state.

To deal with this, the capacitor is provided in the cartridge CR according to the seventh to ninth embodiments. The capacitor is formed by the developer carrying member or the photosensitive drum 20. The value relating to the capacitance of the capacitor is detected both when the contact-separation member 71 assumes the position (first position) CP for bringing the photosensitive drum 20 and the developer carrying member into contact with each other and when the contact-separation member 71 assumes the position (second position) SP for separating the photosensitive drum 20 and the developer carrying member 30 from each other. The detected results in those two situations (first detected result and second detected result) are used to detect the mount state of the cartridge CR and the contact and separation states between the photosensitive drum 20 and the developer carrying member 30. Specifically, the following three states may be detected:

(1) the state in which the cartridge CR is not mounted;

(2) the state in which the cartridge CR is mounted, but the photosensitive drum 20 and the developer carrying member 30 are not switchable between the contact state and the separation state; and (3) the state in which the cartridge CR is mounted, and the photosensitive drum 20 and the developer carrying member 30 are switchable between the contact state and the separation state.

In other words, detailed information on whether or not the image forming apparatus is ready for image formation may be obtained by a simple structure.

The above-mentioned three states are discriminated as follows in a manner that the value detected by the detecting unit (capacitance detecting unit 95) when the contact-separation member 71 assumes the first position is used as the first detected result and the value detected by the detecting unit when the contact-separation member assumes the second position is used as the second detected result.

Based on the magnitude correlation between the first detected result or the second detected result and a first predetermined value, it is determined whether or not the cartridge provided with the capacitor is mounted. For example, in the seventh embodiment, the apparatus state is determined to be the state (1) when the detected voltage X as the first detected result is equal to or larger than the first predetermined value (threshold A). When the detected voltage X is smaller than the threshold A, the apparatus state is determined to be the state (2) or (3).

In the case where the apparatus state is determined to be the state (2) or (3), it is further determined whether the apparatus state is the state (2) or (3) by comparing the first detected result and the second detected result. For example, a difference between the detected results is calculated, and it is determined whether the apparatus state is the state (2) or (3) based on the magnitude correlation between the difference and a second predetermined value. In the seventh embodiment, the apparatus state is determined to be the state (2) when the minimum value (X−Y)min of the difference (X−Y) between the detected voltage X and the detected voltage Y is equal to or smaller than the threshold B, that is, when the difference between the first detected result and the second detected result falls within the range satisfying "(X−Y) min≤B". When the difference "(X−Y)min" is larger than the threshold B, on the other hand, the apparatus state is determined to be the state (3). In comparing the first detected result and the second detected result, it is not always necessary to calculate the difference between those detected results. For example, the magnitude correlation between the ratio of the detected results and a threshold may be used for comparison.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-094684, filed Apr. 18, 2012, No. 2012-094685, filed Apr. 18, 2012 and No. 2013-040556 filed Mar. 1, 2013 which are hereby incorporated by reference herein in their entirety.

What is claimed is:

1. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation by comparing a first detected result and a second detected result to each other, the first detected result being detected by the detecting unit when the contact-separation member assumes the first position, the second detected result being detected by the detecting unit when the contact-separation member assumes the second position.

2. An image forming apparatus according to claim 1, wherein:

the capacitor is provided in a cartridge which is removably mountable to an apparatus main body of the image forming apparatus; and the control unit detects whether or not the cartridge provided with the capacitor is mounted to the apparatus main body.

3. An image forming apparatus according to claim 2, wherein:

the developer carrying member is provided in a developing cartridge which is removably mountable to the apparatus main body of the image forming apparatus;

the image bearing member is provided in an image bearing member cartridge which is removably mountable to the apparatus main body separately from the developing cartridge; and the capacitor is provided in a corresponding one of the developing cartridge and the image bearing member cartridge.

4. An image forming apparatus according to claim 3, wherein the control unit is configured to discriminate the following three states:

(1) a first state in which the corresponding one of the developing cartridge and the image bearing member cartridge which is provided with the capacitor is not mounted to the apparatus main body;

(2) a second state in which the corresponding one of the developing cartridge and the image bearing member cartridge which is provided with the capacitor is mounted to the apparatus main body, but other of the developing cartridge and the image bearing member cartridge which is not provided with the capacitor is not mounted to the apparatus main body; and (3) a third state in which the developing cartridge and the image bearing member cartridge are both mounted to the apparatus main body.

5. An image forming apparatus according to claim 4, wherein:

the control unit discriminates the three states based on a first predetermined value and a second predetermined value;

the control unit determines whether or not the corresponding one of the developing cartridge and the image bearing member cartridge which is provided with the capacitor is mounted to the apparatus main body based on a magnitude correlation between the first predetermined value and one of the first detected result and the second detected result; and the control unit determines, when it is determined that the corresponding one of the developing cartridge and the image bearing member cartridge which is provided with the capacitor is mounted to the apparatus main body, whether the image forming apparatus is in the second state or the third state based on a magnitude correlation between the second predetermined value and one of a difference and a ratio between the first detected result and the second detected result.

6. An image forming apparatus according to claim 2, wherein:

the developer carrying member, the image bearing member, and the capacitor are provided in one process cartridge; and the process cartridge is removably mountable to the apparatus main body of the image forming apparatus.

7. An image forming apparatus according to claim 6, wherein the control unit is configured to discriminate the following three states based on the first detected result and the second detected result:

(1) a first state in which the process cartridge is not mounted to the apparatus main body;

(2) a second state in which the process cartridge is mounted to the apparatus main body, and the developer carrying member and the image bearing member are not switchable between a contact state and a separate state; and (3) a third state in which the process cartridge is mounted to the apparatus main body, and the developer carrying member and the image bearing member are switchable between the contact state and the separate state.

8. An image forming apparatus according to claim 7, wherein:

the control unit discriminates the three states based on a first predetermined value and a second predetermined value;

the control unit determines whether or not the process cartridge is mounted to the apparatus main body based on a magnitude correlation between the first predetermined value and one of the first detected result and the second detected result; and the control unit determines, when it is determined that the process cartridge is mounted to the apparatus main body, whether the image forming apparatus is in the second state or the third state based on a magnitude correlation between the second predetermined value and one of a difference and a ratio between the first detected result and the second detected result.

9. An image forming apparatus according to claim 6, wherein:

the process cartridge comprises a contact preventing member, the contact preventing member being removably mountable to the process cartridge and being configured to maintain a state in which the developer carrying member and the image bearing member are separated from each other; and the control unit detects whether or not the contact preventing member is mounted to the process cartridge based on the first detected result and the second detected result.

10. An image forming apparatus according to claim 2, wherein the control unit detects whether or not a corresponding one of the developing cartridge and the image bearing member cartridge which is provided with the capacitor is mounted to the apparatus main body based on only one of the first detected result and the second detected result.

11. An image forming apparatus according to claim 10, wherein, when it is detected by the control unit based on the only one of the first detected result and the second detected result that the corresponding one of the developing cartridge and the image bearing member cartridge which is provided with the capacitor is not mounted to the apparatus main body, the control unit transmits a signal indicating that the corresponding one of the developing cartridge and the image bearing member cartridge which is provided with the capacitor is not mounted to the apparatus main body without obtaining other of the first detected result and the second detected result.

12. An image forming apparatus according to claim 1, wherein the conductive member comprises a feeding member which feeds a developer to the developer carrying member, and is paired with the developer carrying member to form the capacitor.

13. An image forming apparatus according to claim 1, wherein the conductive member comprises a regulating member which regulates a thickness of a developer carried by the developer carrying member, and is paired with the developer carrying member to form the capacitor.

14. An image forming apparatus according to claim 1, further comprising a developing container which contains a developer to be fed to the developer carrying member, wherein:

the capacitor is disposed inside the developing container; and an amount of the developer contained in the developing container is detected based on a detected result of the detecting unit.

15. An image forming apparatus according to claim 1, wherein the conductive member comprises a charging member which charges the image bearing member, and is paired with the image bearing member to form the capacitor.

16. An image forming apparatus according to claim 1, wherein the image bearing member is connected to a ground.

17. An image forming apparatus according to claim 1, wherein the detecting unit detects a current which varies in accordance with the capacitance of the capacitor.

18. An image forming apparatus according to claim 1, wherein the detecting unit detects a voltage which varies in accordance with the capacitance of the capacitor.

19. An image forming apparatus according to claim 1, wherein, when the control unit detects that the image forming apparatus is not ready for image formation, the control unit notifies a user of a state in which the image forming apparatus is not ready for image formation.

20. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position, wherein the developer carrying member is provided in a developing cartridge which is removably mountable to an apparatus main body of the image forming apparatus, the image bearing member is provided in an image bearing member cartridge which is removably mountable to the apparatus main body separately from the developing cartridge, the capacitor is provided in a corresponding one of the developing cartridge and the image bearing member cartridge, and the control unit is configured to discriminate the following three states:

(1) a first state in which the corresponding one of the developing cartridge and the image bearing member cartridge which is provided with the capacitor is not mounted to the apparatus main body;

(2) a second state in which the corresponding one of the developing cartridge and the image bearing member cartridge which is provided with the capacitor is mounted to the apparatus main body, but other of the developing cartridge and the image bearing member cartridge which is not provided with the capacitor is not mounted to the apparatus main body; and (3) a third state in which the developing cartridge and the image bearing member cartridge are both mounted to the apparatus main body.

21. An image forming apparatus according to claim 20, wherein:

the control unit discriminates the three states based on a first predetermined value and a second predetermined value;

the control unit determines whether or not the corresponding one of the developing cartridge and the image bearing member cartridge which is provided with the capacitor is mounted to the apparatus main body based on a magnitude correlation between the first predetermined value and one of the first detected result and the second detected result; and the control unit determines, when it is determined that the corresponding one of the developing cartridge and the image bearing member cartridge which is provided with the capacitor is mounted to the apparatus main body, whether the image forming apparatus is in the second state or the third state based on a magnitude correlation between the second predetermined value and one of a difference and a ratio between the first detected result and the second detected result.

22. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position, wherein the developer carrying member, the image bearing member, and the capacitor are provided in one process cartridge which is removably mountable to an apparatus main body of the image forming apparatus, and the control unit is configured to discriminate the following three states based on the first detected result and the second detected result:

(1) a first state in which the process cartridge is not mounted to the apparatus main body;

(2) a second state in which the process cartridge is mounted to the apparatus main body, and the developer carrying member and the image bearing member are not switchable between a contact state and a separate state; and (3) a third state in which the process cartridge is mounted to the apparatus main body, and the developer carrying member and the image bearing member are switchable between the contact state and the separate state.

23. An image forming apparatus according to claim 22, wherein:

the control unit discriminates the three states based on a first predetermined value and a second predetermined value;

the control unit determines whether or not the process cartridge is mounted to the apparatus main body based on a magnitude correlation between the first predetermined value and one of the first detected result and the second detected result; and the control unit determines, when it is determined that the process cartridge is mounted to the apparatus main body, whether the image forming apparatus is in the second state or the third state based on a magnitude correlation between the second predetermined value and one of a difference and a ratio between the first detected result and the second detected result.

24. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position, wherein the developer carrying member, the image bearing member, and the capacitor are provided in one process cartridge, which is removably mountable to an apparatus main body of the image forming apparatus, the process cartridge comprises a contact preventing member, the contact preventing member being removably mountable to the process cartridge and being configured to maintain a state in which the developer carrying member and the image bearing member are separated from each other, and the control unit detects whether or not the contact preventing member is mounted to the process cartridge based on the first detected result and the second detected result.

25. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position, wherein the capacitor is provided in a cartridge which is removably mountable to an apparatus main body of the image forming apparatus, and the control unit detects whether or not the cartridge provided with the capacitor is mounted to the apparatus main body based on only one of the first detected result and the second detected result.

26. An image forming apparatus according to claim 25, wherein the control unit compares the first detected result and the second detected result to each other when detecting whether or not the image forming apparatus is ready for image formation.

27. An image forming apparatus according to claim 25, wherein, when it is detected by the control unit based on the only one of the first detected result and the second detected result that the cartridge provided with the capacitor is not mounted to the apparatus main body, the control unit transmits a signal indicating that the cartridge provided with the capacitor is not mounted to the apparatus main body without obtaining other of the first detected result and the second detected result.

28. An image forming apparatus configured to form an image on a recording medium, the image forming apparatus comprising:

an image bearing member on which a latent image is to be formed;

a developer carrying member configured to carry a developer;

a conductive member having a conductive property, the conductive member being paired with one of the developer carrying member and the image bearing member to form a capacitor;

a contact-separation member configured to assume a first position for bringing the developer carrying member into contact with the image bearing member and a second position for separating the developer carrying member from the image bearing member;

a detecting unit configured to detect a value relating to a capacitance of the capacitor when a voltage is applied to the capacitor; and a control unit configured to detect whether or not the image forming apparatus is ready for image formation based on a first detected result and a second detected result, the first detected result being detected by the detecting unit when the contact-separation member assumes the first position, the second detected result being detected by the detecting unit when the contact-separation member assumes the second position, wherein the conductive member comprises a charging member which charges the image bearing member, and is paired with the image bearing member to form the capacitor.

* * * * *